US011629035B2

(12) United States Patent
Zushi et al.

(10) Patent No.: US 11,629,035 B2
(45) Date of Patent: Apr. 18, 2023

(54) CRANE

(71) Applicant: TADANO LTD., Kagawa (JP)

(72) Inventors: Masahide Zushi, Kagawa (JP); Kazu Nagahama, Kagawa (JP)

(73) Assignee: TADANO LTD., Kagawa (JP)

( * ) Notice: Subject to any disclaimer, the term of this patent is extended or adjusted under 35 U.S.C. 154(b) by 482 days.

(21) Appl. No.: 16/968,582

(22) PCT Filed: Feb. 14, 2019

(86) PCT No.: PCT/JP2019/005192
§ 371 (c)(1),
(2) Date: Aug. 8, 2020

(87) PCT Pub. No.: WO2019/159994
PCT Pub. Date: Aug. 22, 2019

(65) Prior Publication Data

US 2021/0039926 A1 Feb. 11, 2021

(30) Foreign Application Priority Data

Feb. 16, 2018 (JP) ..... JP2018-026426

(51) Int. Cl.
*B66C 23/70* (2006.01)
*B66C 13/46* (2006.01)
(Continued)

(52) U.S. Cl.
CPC ..... *B66C 23/708* (2013.01); *B66C 13/46* (2013.01); *B66C 23/42* (2013.01); *B66C 23/88* (2013.01);
(Continued)

(58) Field of Classification Search
CPC ..... B66C 23/708; B66C 23/42; B66C 13/46
See application file for complete search history.

(56) References Cited

U.S. PATENT DOCUMENTS 4,156,331 A 5/1979 Lester et al.
10,322,915 B2 * 6/2019 Kaupert ..... B66C 23/708
(Continued)

FOREIGN PATENT DOCUMENTS

DE 3707521 A1 10/1988
JP 2009-298597 A 12/2009
(Continued)

OTHER PUBLICATIONS

JP 5684996 B2 Machine Translation. (Year: 2015).*
(Continued)

*Primary Examiner* — Michael R Mansen
*Assistant Examiner* — Juan J Campos, Jr.
(74) *Attorney, Agent, or Firm* — Paratus Law Group, PLLC

(57) ABSTRACT

There is provided a crane including: a telescopic boom having an inner boom element and an outer boom element; a telescoping actuator that displaces the inner boom element or the outer boom element in the telescoping direction; a first coupling member that releasably couples the telescoping actuator to one of the boom elements; a second coupling member that releasably couples the pair of boom elements to each other; an electric drive source provided at the telescoping actuator; a first coupling mechanism that displaces the first coupling member or the second coupling member on the basis of motive power of the electric drive source, thereby switching a coupled state and a non-coupled state of the members that are releasably coupled by one of the coupling members; and a position information detection device that detects information relating to the position of one of the coupling members on the basis of output from the electric drive source.

16 Claims, 31 Drawing Sheets

(51) Int. Cl.
*B66C 23/42* (2006.01)
*B66C 23/88* (2006.01)

(52) U.S. Cl.
CPC ..... *B66C 2700/0371* (2013.01); *B66C 2700/0378* (2013.01)

(56) References Cited

U.S. PATENT DOCUMENTS

| | | | | |
|---|---|---|---|---|
| 2015/0041422 | A1* | 2/2015 | Kaupert | B66C 23/708 212/292 |
| 2015/0128735 | A1 | 5/2015 | Klein et al. | |
| 2016/0244306 | A1* | 8/2016 | Kawabuchi | B66C 23/22 |
| 2017/0305727 | A1 | 10/2017 | Schoonmaker | |

FOREIGN PATENT DOCUMENTS

| | | | |
|---|---|---|---|
| JP | 2012-096928 | A | 5/2012 |
| JP | 2012-166920 | A | 9/2012 |
| JP | 5684996 | B2 | 3/2015 |

OTHER PUBLICATIONS

May 14, 2019, International Search Report issued for related PCT Application No. PCT/JP2019/005192.
May 14, 2019, International Search Opinion issued for related PCT Application No. PCT/JP2019/005192.
Nov. 15, 2021, European Search Report issued for related EP Application No. 19753602.2.
Apr. 5, 2021, Indian Office Action issued for related IN application No. 202017035178.

* cited by examiner

CRANE

CROSS REFERENCE TO PRIOR APPLICATION

This application is a National Stage Patent Application of PCT International Patent Application No. PCT/JP2019/005192 (filed on Feb. 14, 2019) under 35 U.S.C. § 371, which claims priority to Japanese Patent Application No. 2018-026426 (filed on Feb. 16, 2018), which are all hereby incorporated by reference in their entirety.

TECHNICAL FIELD

The present invention relates to a crane including a telescopic boom.

BACKGROUND ART

Patent Literature 1 discloses a movable crane including a telescopic boom in which a plurality of boom elements overlap each other in a nested manner (also referred to as a telescopic manner) and a hydraulic telescoping cylinder that extends and contracts the telescopic boom.

The telescopic boom includes a boom coupling pin that couples the boom elements which overlap each other in an adjacent manner. A boom element that is released from coupling by the boom coupling pin (hereinafter, referred to as a displaceable boom element) can be displaced with respect to another boom element in a longitudinal direction (also referred to as a telescoping direction).

The telescoping cylinder includes a rod member and a cylinder member. Such a telescoping cylinder couples the displaceable boom element to the cylinder member via a cylinder coupling pin. In this state, when the cylinder member is displaced in the telescoping direction, the displaceable boom element is displaced together with the cylinder member, so that the telescopic boom is extended and contracted.

CITATION LIST

Patent Literature

Patent Literature 1: JP 2012-96928 A

SUMMARY OF THE INVENTION

Problems to be Solved by the Invention

The above-described crane includes a hydraulic actuator that displaces the boom coupling pin, a hydraulic actuator that displaces the cylinder coupling pin, and a hydraulic circuit that supplies pressure oil to each of the actuators. Such a hydraulic circuit is provided, for example, around the telescopic boom. For this reason, there is a possibility that the degree of freedom in design around the telescopic boom is reduced.

An object of the present invention is to provide a crane in which the degree of freedom in design around a telescopic boom can be improved.

Solutions to Problems

According to an aspect of the present invention, there is provided a crane including: a telescopic boom including an inner boom element and an outer boom element that overlap each other to be extendable and contractible; a telescoping actuator that displaces one boom element of the inner boom element and the outer boom element in a telescoping direction; a first coupling member that releasably couples the telescoping actuator to the one boom element; a second coupling member that releasably couples the inner boom element and the outer boom element; an electric drive source provided in the telescoping actuator; a first coupling mechanism that displaces one coupling member of the first coupling member and the second coupling member by using power of the electric drive source, to cause the members coupled by the one coupling member to switch between a coupled state and a non-coupled state; and a position information detection device that detects information relating a position of the one coupling member based on an output of the electric drive source.

Effects of the Invention

According to the present invention, it is possible to improve the degree of freedom in design around the telescopic boom.

DESCRIPTION OF EMBODIMENTS

Hereinafter, some examples of embodiment according to the present invention will be described in detail based on the drawings. Incidentally, each embodiment to be described hereinafter is one example of a movable crane according to the present invention, and the present invention is not limited by each embodiment.

1. First Embodiment

Figure 1:
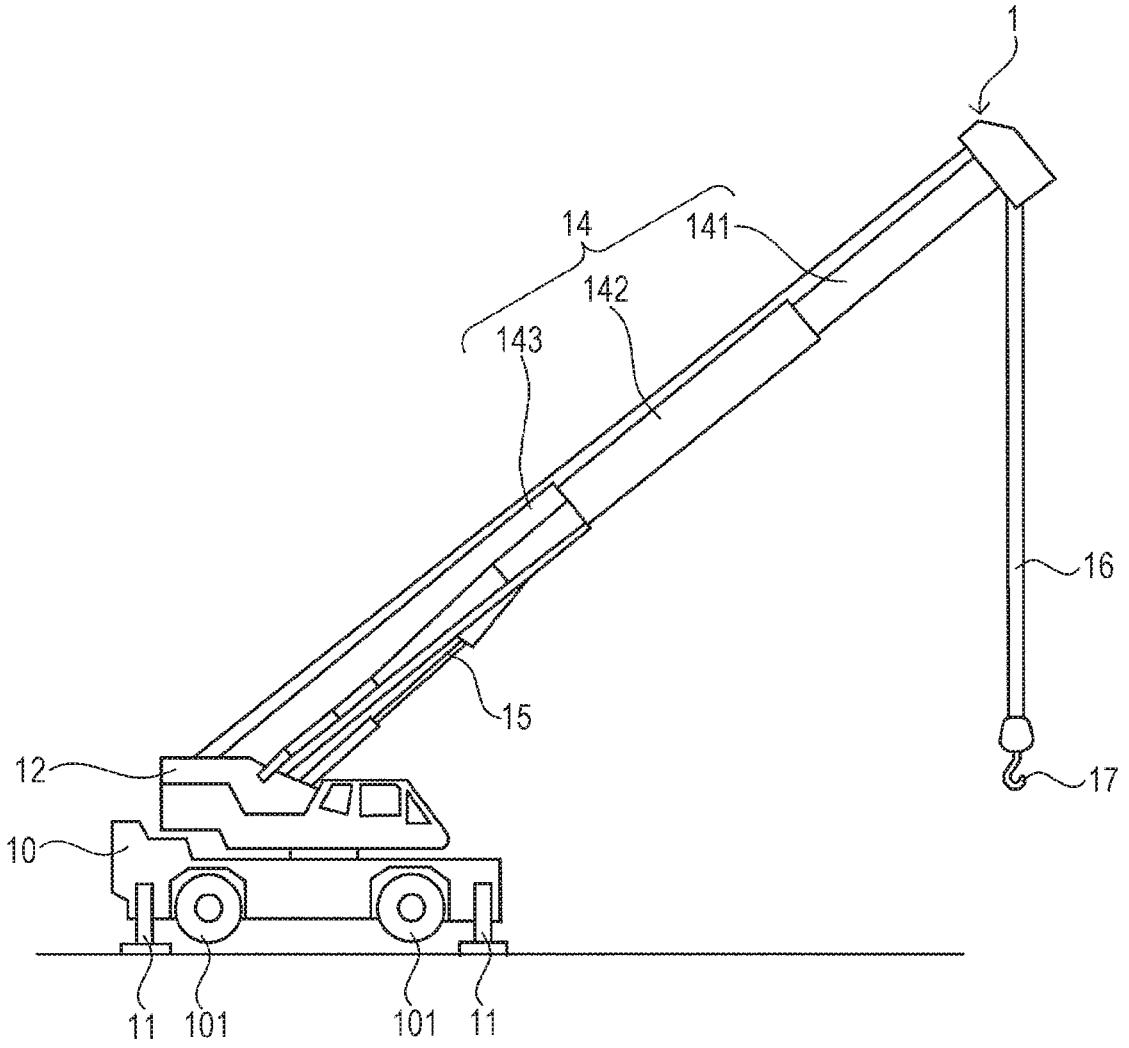
FIG. 1 is a schematic view of a movable crane according to a first embodiment.

FIG. 1 is a schematic view of a movable crane 1 (in the illustrated case, rough terrain crane) according to the present embodiment.

Examples of the movable crane include an all terrain crane, a truck crane, a loading truck crane (also referred to as a cargo crane), and the like. However, the crane according to the present invention is not limited to the movable crane, and the present invention is applicable also to other cranes including a telescopic boom.

Hereinafter, first, the outline of the movable crane 1 and a telescopic boom 14 provided in the movable crane 1 will be described. Thereafter, a specific structure and operation of an actuator 2 that is a feature of the movable crane 1 according to the present embodiment will be described.

[1.1 Regarding Movable Crane]

The movable crane 1 illustrated in FIG. 1 includes a traveling body 10 including a plurality of wheels 101; outriggers 11 provided at four corners of the traveling body 10; a turning table 12 that is turnably provided in an upper portion of the traveling body 10; the telescopic boom 14 of which a proximal end portion is fixed to the turning table 12; the actuator 2 (unillustrated in FIG. 1) that extends and contracts the telescopic boom 14; a raising and lowering cylinder 15 that raises and lowers the telescopic boom 14; a wire 16 that is hung from a distal end portion of the telescopic boom 14; and a hook 17 provided at a distal end of the wire 16.

[Regarding Telescopic Boom]

Subsequently, the telescopic boom 14 will be described with reference to FIGS. 1 and 2A to 2E. FIGS. 2A to 2E are schematic views for describing a structure and a telescoping operation of the telescopic boom 14.

FIG. 1 illustrates the telescopic boom 14 in an extended state. Meanwhile, FIG. 2A illustrates the telescopic boom 14 in a contracted state. FIG. 2E illustrates the telescopic boom 14 in which only a distal end boom element 141 to be described later is extended.

The telescopic boom 14 includes a plurality (at least a pair) of boom elements. The plurality of boom elements have a cylindrical shape and are assembled together in a telescopic manner. Specifically, in the contracted state, the plurality of boom elements are the distal end boom element 141, an intermediate boom element 142, and a proximal end boom element 143 in order from inside.

Incidentally, in the case of the present embodiment, the distal end boom element 141 and the intermediate boom element 142 are displaceable boom elements in a telescoping direction. The proximal end boom element 143 is restricted from being displaced in the telescoping direction.

The telescopic boom 14 extends the boom elements in order from the boom element disposed inside (namely, the distal end boom element 141) to make a state transition from the contracted state illustrated in FIG. 2A to the extended state illustrated in FIG. 1.

In the extended state, the intermediate boom element 142 is disposed between the proximal end boom element 143 on a proximal-most end side and the distal end boom element 141 on a distal-most end side. Incidentally, a plurality of the intermediate boom elements may be provided.

The telescopic boom 14 is substantially the same as a telescopic boom known from the related art; however, for convenience of describing the structure and the operation of the actuator 2 to be described later, hereinafter, structures of the distal end boom element 141 and the intermediate boom element 142 will be described.

[Regarding Distal End Boom Element]

The distal end boom element 141 has a cylindrical shape and has an internal space where the actuator 2 can be accommodated. The distal end boom element 141 includes a pair of cylinder pin receiving portions 141*a* and a pair of boom pin receiving portions 141*b* in a proximal end portion thereof.

The pair of cylinder pin receiving portions 141*a* are coaxially formed in the proximal end portion of the distal end boom element 141. The pair of cylinder pin receiving portions 141*a* are engageable with and disengageable from a pair of cylinder coupling pins 454*a* and 454*b* (also referred to as a first coupling member) provided in a cylinder member 32 of a telescoping cylinder 3, respectively (namely, enter any one of an engaged state and a disengaged state).

The cylinder coupling pins 454*a* and 454*b* are displaced in an axial direction thereof according to the operation of a cylinder coupling mechanism 45 provided in the actuator 2 to be described later. In a state where the pair of cylinder coupling pins 454*a* and 454*b* and the pair of cylinder pin receiving portions 141*a* are engaged with each other, the distal end boom element 141 can be displaced together with the cylinder member 32 in the telescoping direction.

The pair of boom pin receiving portions 141*b* are coaxially formed closer to a proximal end side than the cylinder pin receiving portions 141*a*. The boom pin receiving portions 141*b* are engageable with and disengageable from a pair of boom coupling pins 144*a*, respectively (also referred to as a second coupling member).

Each of the pair of boom coupling pins 144*a* couples the distal end boom element 141 and the intermediate boom element 142. The pair of boom coupling pins 144*a* are displaced in an axial direction thereof according to the operation of a boom coupling mechanism 46 provided in the actuator 2.

In a state where the distal end boom element 141 and the intermediate boom element 142 are coupled by the pair of boom coupling pins 144*a*, the boom coupling pins 144*a* are inserted through the boom pin receiving portions 141*b* of the distal end boom element 141 and a first boom pin receiving portion 142*b* or a second boom pin receiving portion 142*c* of the intermediate boom element 142 to be described later in a bridging manner.

In the state where the distal end boom element 141 and the intermediate boom element 142 are coupled (also referred to as a coupled state), the distal end boom element 141 cannot be displaced with respect to the intermediate boom element 142 in the telescoping direction.

Meanwhile, in a state where coupling between the distal end boom element 141 and the intermediate boom element 142 is released (also referred to as a non-coupled state), the distal end boom element 141 can be displaced with respect to the intermediate boom element 142 in the telescoping direction.

[Regarding Intermediate Boom Element]

The intermediate boom element 142 has a cylindrical shape as illustrated in FIGS. 2A to 2E and has an internal space where the distal end boom element 141 can be accommodated. The intermediate boom element 142 includes a pair of cylinder pin receiving portions 142*a*, a pair of first boom pin receiving portions 142*b*, and a pair of third boom pin receiving portions 142*d* in a proximal end portion thereof.

The pair of cylinder pin receiving portions 142*a* and the pair of first boom pin receiving portions 142*b* are substantially the same as the pair of cylinder pin receiving portions 141*a* and the pair of boom pin receiving portions 141*b* that the distal end boom element 141 includes, respectively.

The pair of third boom pin receiving portions 142*d* are coaxially formed closer to the proximal end side than the pair of first boom pin receiving portions 142*b*. Boom coupling pins 144*b* can be inserted through the pair of third boom pin receiving portions 142*d*, respectively. The boom coupling pins 144*b* couple the intermediate boom element 142 and the proximal end boom element 143.

In addition, the intermediate boom element 142 includes a pair of second boom pin receiving portions 142*c* in a distal end portion thereof. The pair of second boom pin receiving portions 142*c* are coaxially formed in the distal end portion of the intermediate boom element 142. The pair of boom coupling pins 144*a* can be inserted through the pair of second boom pin receiving portions 142*c*, respectively.

[Regarding Actuator]

Hereinafter, the actuator 2 will be described with reference to FIGS. 3A to 18C. The actuator 2 is an actuator that extends and contracts the telescopic boom 14 (refer to FIGS. 1 and 2A to 2E) described above.

First, the outline of the actuator 2 will be described. For example, the actuator 2 includes the telescoping cylinder 3 (also referred to as a telescoping actuator) that displaces the distal end boom element 141 (also referred to as one boom element) of the distal end boom element 141 (also referred to as an inner boom element) and the intermediate boom element 142 (also referred to as an outer boom element), which overlap each other in an adjacent manner, in the telescoping direction; at least one electric motor 41 (also referred to as an electric drive source) provided in the telescoping cylinder 3; the cylinder coupling mechanism 45 (also referred to as a first coupling mechanism or a second coupling mechanism) that displaces the pair of cylinder coupling pins 454*a* and 454*b* (also referred to as the first coupling member) by using power of the electric motor 41, to cause the telescoping cylinder 3 and the distal end boom element 141 to switch between the coupled state and the non-coupled state; and the boom coupling mechanism 46 (also referred to as the first coupling mechanism or the second coupling mechanism) that displaces the pair of boom coupling pins 144*a* (also referred to as the second coupling member) by using power of the electric motor 41, to cause the distal end boom element 141 and the intermediate boom element 142 to switch between the coupled state and the non-coupled state. Incidentally, when the cylinder coupling mechanism 45 is the first coupling mechanism, the boom coupling mechanism 46 becomes the second coupling mechanism. Meanwhile, when the cylinder coupling mechanism 45 is the second coupling mechanism, the boom coupling mechanism 46 becomes the first coupling mechanism.

Subsequently, a specific configuration of each part provided in the actuator 2 will be described. The actuator 2 includes the telescoping cylinder 3 and a pin displacement module 4. In the contracted state (state illustrated in FIG. 2A) of the telescopic boom 14, the actuator 2 is disposed in the internal space of the distal end boom element 141.

[Regarding Telescoping Cylinder]

The telescoping cylinder 3 includes a rod member 31 (also referred to as a fixed side member and refer to FIGS. 2A to 2E) and the cylinder member 32 (also referred to as a movable side member). The telescoping cylinder 3 as described above displaces a boom element (for example, the distal end boom element 141 or the intermediate boom element 142), which is coupled to the cylinder member 32, in the telescoping direction via the cylinder coupling pins 454*a* and 454*b* to be described later. Since the telescoping cylinder 3 is substantially the same as a telescoping cylinder known from the related art, detailed description thereof will be omitted.

[Regarding Pin Displacement Module]

Figure 8:
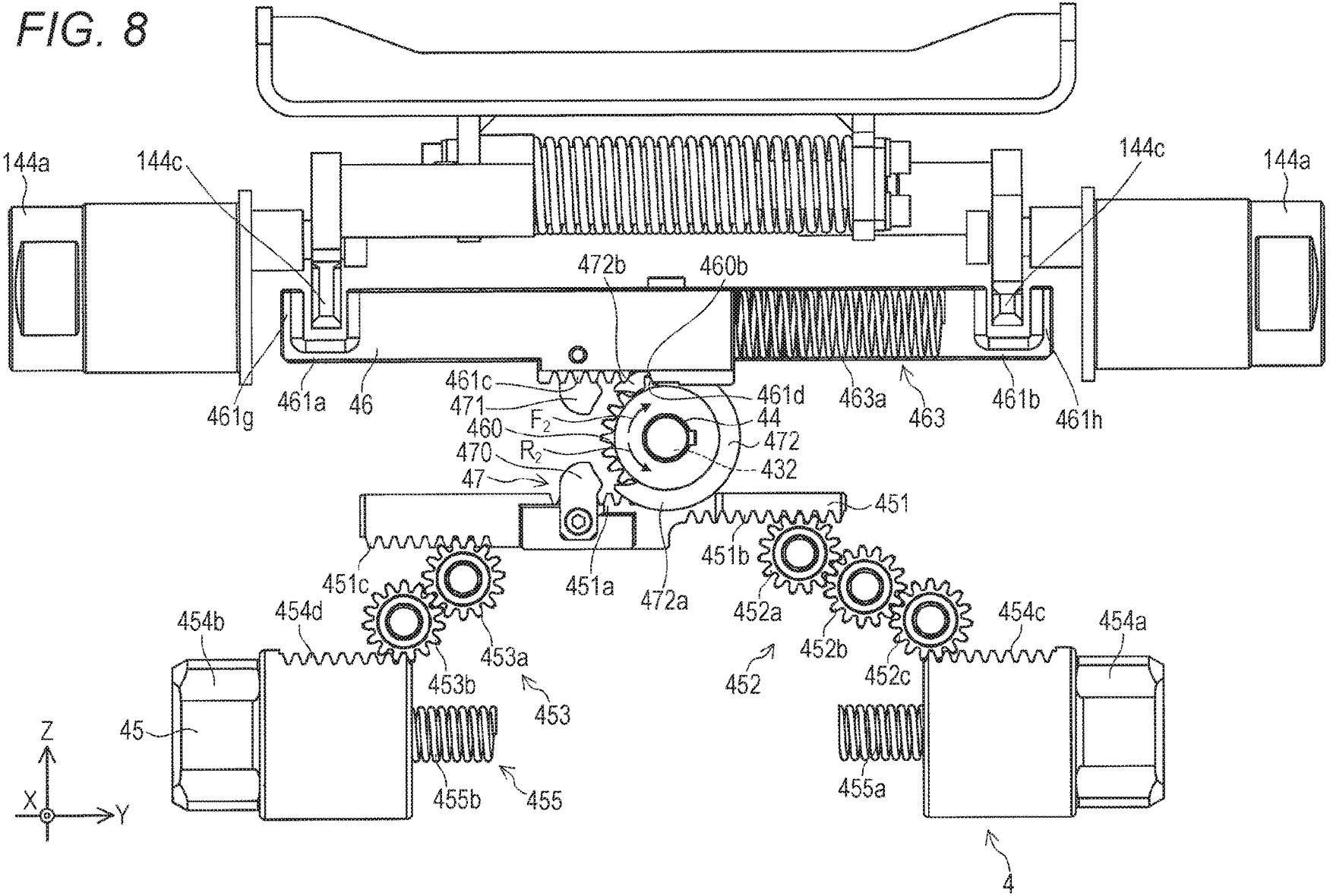
FIG. 8 is a front view of the pin displacement module in an extended state and in a state of holding the boom coupling pins.
Figure 9:
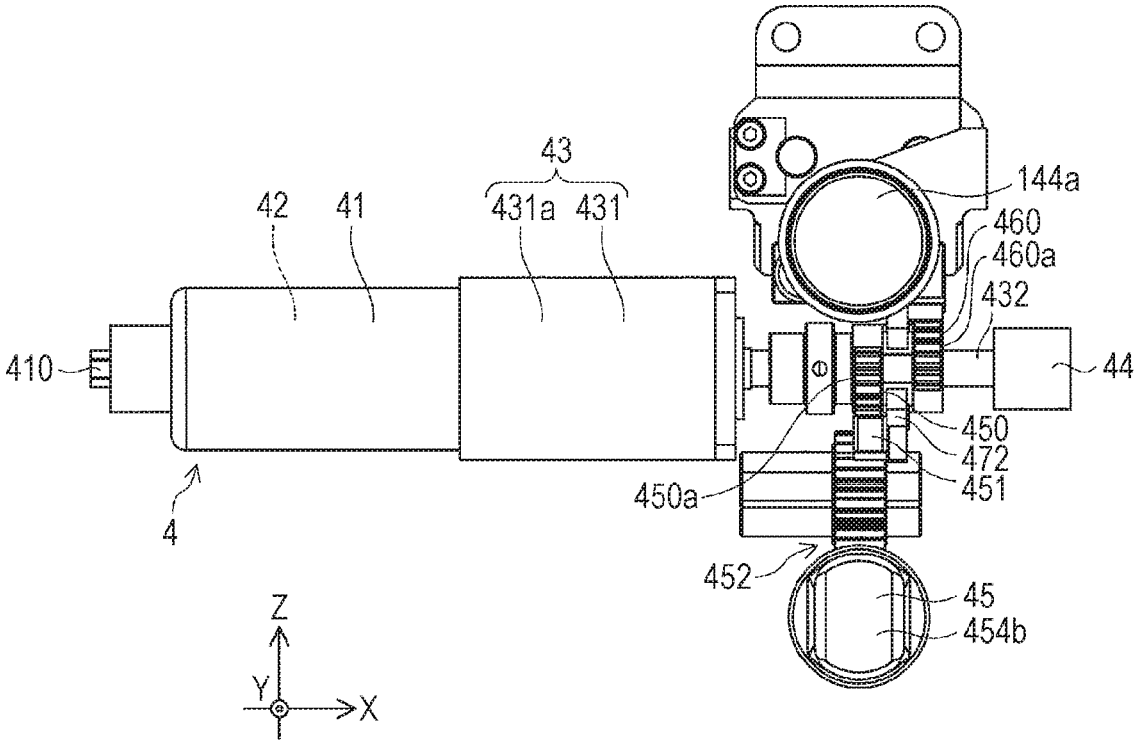
FIG. 9 is a view as seen from left in FIG. 8.

The pin displacement module 4 includes a housing 40, the electric motor 41, a brake mechanism 42, a transmission mechanism 43, a position information detection device 44, the cylinder coupling mechanism 45, the boom coupling mechanism 46, and a lock mechanism 47 (refer to FIG. 8).

Hereinafter, each member forming the actuator 2 will be described based on a state where the member is assembled in the actuator 2. In addition, in a description of the actuator 2, the Cartesian coordinate system (X, Y, Z) illustrated in each drawing will be used. However, the disposition of each part forming the actuator 2 is not limited to disposition in the present embodiment.

In the Cartesian coordinate system illustrated in each drawing, an X-direction coincides with the telescoping direction of the telescopic boom 14 in the state of being installed in the movable crane 1. An X-direction positive side is also referred to as an extending direction in the telescoping direction. Meanwhile, an X-direction negative side is also referred to as a contracting direction in the telescoping direction. In addition, for example, a Z-direction coincides with an upward and downward direction of the movable crane 1. For example, a Y-direction coincides with a vehicle width direction of the movable crane 1. However, the Y-direction and the Z-direction are not limited to the above-described directions as long as the Y-direction and the Z-direction are two directions orthogonal to each other. For example, the Y-direction and the Z-direction may be deviated from the upward and downward direction and the vehicle width direction of the movable crane 1 depending on the tilt angle of the telescopic boom 14 and the turn angle of the turning table 12 with respect to the traveling body 10.

[Regarding Housing]

The housing 40 is fixed to the cylinder member 32 of the telescoping cylinder 3. The cylinder coupling mechanism 45 and the boom coupling mechanism 46 are accommodated in an internal space of the housing 40. In addition, the housing 40 supports the electric motor 41 via the transmission mechanism 43. Furthermore, the housing 40 supports also the brake mechanism 42 to be described later. Namely, the housing 40 integrates the above-described members into a single unit. Such a configuration contributes to reduction in size of the pin displacement module 4, improvement in productivity, and improvement in system reliability.

Specifically, the housing 40 includes a first housing element 400 having a box shape and a second housing element 401 having a box shape.

The cylinder coupling mechanism 45 to be described later is accommodated in an internal space of the first housing element 400. The rod member 31 is inserted through the first housing element 400 in the X-direction. An end portion of the cylinder member 32 is fixed to a side wall on the X-direction positive side (the left side in FIG. 4 and the right side in FIG. 7) of the first housing element 400. Side walls on both sides of the first housing element 400 in the Y-direction includes through-holes 400*a* and 400*b* (refer to FIGS. 3B and 7), respectively.

The pair of cylinder coupling pins 454*a* and 454*b* of the cylinder coupling mechanism 45 are inserted through the through-holes 400*a* and 400*b* as described above, respectively.

The second housing element 401 is provided on a Z-direction positive side of the first housing element 400. The boom coupling mechanism 46 to be described later is accommodated in an internal space of the second housing element 401. A transmission shaft 432 (refer to FIG. 8) of the transmission mechanism 43 to be described later is inserted through the second housing element 401 in the X-direction.

Side walls on both sides of the second housing element 401 in the Y-direction include through-holes 401*a* and 401*b* (refer to FIGS. 3B and 7), respectively. A pair of second rack bars 461*a* and 461*b* of the boom coupling mechanism 46 are inserted through the through-holes 401*a* and 401*b*, respectively.

[Regarding Electric Motor]

The electric motor 41 is supported on the housing 40 via a speed reducer 431 of the transmission mechanism 43. Specifically, in a state where an output shaft (unillustrated) of the electric motor 41 is parallel with the X-direction (also referred to as a longitudinal direction of the cylinder member 32), the electric motor 41 is disposed around the cylinder member 32 (for example, on the Z-direction positive side) and around the second housing element 401 (for example, on the X-direction negative side). Such disposition can reduce the size of the pin displacement module 4 in the Y-direction and the Z-direction.

The electric motor 41 is connected to an electric power source (unillustrated) provided in, for example, the turning table 12 via an electric power supply cable. In addition, the electric motor 41 is connected to a control unit (unillustrated) provided in, for example, the turning table 12 via a control signal transmission cable.

Each of the above-described cables can be released and wound by a cord reel provided on the outside of the proximal end portion of the telescopic boom 14 or in the turning table 12 (refer to FIG. 1).

Incidentally, a movable crane with a structure in the related art includes proximity sensors (unillustrated) for detecting the position of the cylinder coupling pins 454*a* and 454*b* and the boom coupling pins 144*a* and 144*b* and an electric power supply cable and a signal transmission cable for each of the proximity sensors.

For this reason, it is not required to provide new members (for example, a cable, a cord reel, and the like) for electric power supply and signal transmission to the electric motor 41. Incidentally, in the case of the present embodiment, the detection of the position of the cylinder coupling pins 454*a* and 454*b* and the boom coupling pins 144*a* and 144*b* is performed by the position information detection device 44 to be described later. For this reason, in the present embodiment, the above proximity sensor is not required.

In addition, the electric motor 41 includes a manual operation portion 410 (refer to FIG. 3B) that can be operated by a manual handle (unillustrated). The manual operation portion 410 is used to manually perform a state transition of the pin displacement module 4. When the manual operation portion 410 is rotated by the above manual handle at the occurrence of failures or the like, the output shaft of the electric motor 41 rotates, so that the state of the pin displacement module 4 makes a transition. Incidentally, in the case of the present embodiment, the electric drive source is configured with a single electric motor. However, the electric drive source may be configured with a plurality (for example, two) of electric motors.

[Regarding Brake Mechanism]

The brake mechanism 42 applies a braking force to the electric motor 41. The brake mechanism 42 as described above prevents the rotation of the output shaft of the electric motor 41 in a state where the electric motor 41 is stopped. Accordingly, in a state where the electric motor 41 is stopped, the state of the pin displacement module 4 is maintained. In addition, during braking, when an external force having a predetermined magnitude is applied to the cylinder coupling mechanism 45 or the boom coupling mechanism 46, the brake mechanism 42 allows the rotation of the electric motor 41 (namely, sliding). Such a configuration is effective in preventing damage to the electric motor 41, gears, and the like forming the actuator 2. Incidentally, when such a configuration is adopted, for example, a frictional brake can be adopted as the brake mechanism 42. The predetermined magnitude in the above external force is appropriately determined according to usage situations or the configuration of the actuator 2.

Specifically, in a contracted state of the cylinder coupling mechanism 45 to be described later or in a contracted state of the boom coupling mechanism 46, the brake mechanism 42 operates to maintain the state of the cylinder coupling mechanism 45 or the boom coupling mechanism 46.

The brake mechanism 42 is disposed closer to a front stage than the transmission mechanism 43 to be described later. Specifically, the brake mechanism 42 is disposed coaxially with the output shaft of the electric motor 41 to be closer to the X-direction negative side than the electric motor 41 (namely, on the opposite side of the electric motor 41 from the transmission mechanism 43) (refer to FIG. 3B). Such disposition can reduce the size of the pin displacement module 4 in the Y-direction and the Z-direction. Incidentally, the front stage represents an upstream side (side close to the electric motor 41) in a transmission path where power of the electric motor 41 is transmitted to the cylinder coupling mechanism 45 or the boom coupling mechanism 46. Meanwhile, a rear stage represents a downstream side (side distant from the electric motor 41) in the transmission path where power of the electric motor 41 is transmitted to the cylinder coupling mechanism 45 or the boom coupling mechanism 46.

In addition, in a case where the brake mechanism 42 is disposed closer to the front stage than the transmission mechanism 43 (the speed reducer 431 to be described later), the required brake torque is smaller than in a case where the brake mechanism 42 is disposed closer to the rear stage than the transmission mechanism 43. Accordingly, the size of the brake mechanism 42 can be reduced.

Incidentally, the brake mechanism 42 may be various brake devices such as a mechanical type and an electromagnetic type. In addition, the position of the brake mechanism 42 is not limited to the position in the present embodiment.

[Regarding Transmission Mechanism]

The transmission mechanism 43 transmits power (namely, rotary motion) of the electric motor 41 to the cylinder coupling mechanism 45 or the boom coupling mechanism 46. The transmission mechanism 43 includes the speed reducer 431 and the transmission shaft 432 (refer to FIG. 8).

The speed reducer 431 reduces the rotation of the electric motor 41 to transmit the reduced rotation to the transmission shaft 432. The speed reducer 431 is, for example, a planetary gear mechanism accommodated in a speed reducer case 431*a*, and is provided coaxially with the output shaft of the electric motor 41. Such disposition can reduce the size of the pin displacement module 4 in the Y-direction and the Z-direction.

An end portion on the X-direction negative side of the transmission shaft 432 is connected to an output shaft (unillustrated) of the speed reducer 431. In this state, the transmission shaft 432 rotates together with the output shaft of the speed reducer 431. The transmission shaft 432 is inserted through the housing 40 (specifically, the second housing element 401) in the X-direction. Incidentally, the transmission shaft 432 may be integral with the output shaft of the speed reducer 431.

An end portion on the X-direction positive side of the transmission shaft 432 protrudes further to the X-direction positive side than the housing 40. A detection unit 44*a* of the position information detection device 44 to be described later is provided in the end portion on the X-direction positive side of the transmission shaft 432.

[Regarding Position Information Detection Device]

The position information detection device 44 detects information relating the position of the pair of cylinder coupling pins 454*a* and 454*b* and the pair of boom coupling pins 144*a* (may be the pair of boom coupling pins 144*b*, and the same hereinafter) based on an output (for example, a rotational displacement of the output shaft) of the electric motor 41. As an example of the information relating position, the displacement amount from a reference position of the pair of cylinder coupling pins 454*a* and 454*b* or the pair of boom coupling pins 144*a* is provided.

Specifically, the position information detection device 44 detects information relating the position of the pair of cylinder coupling pins 454*a* and 454*b* when the pair of cylinder coupling pins 454*a* and 454*b* and the pair of cylinder pin receiving portions 141*a* of a boom element (for example, the distal end boom element 141) are in the engaged state (for example, the state illustrated in FIG. 2A) or in the disengaged state (the state illustrated in FIG. 2E).

Figure 2C:
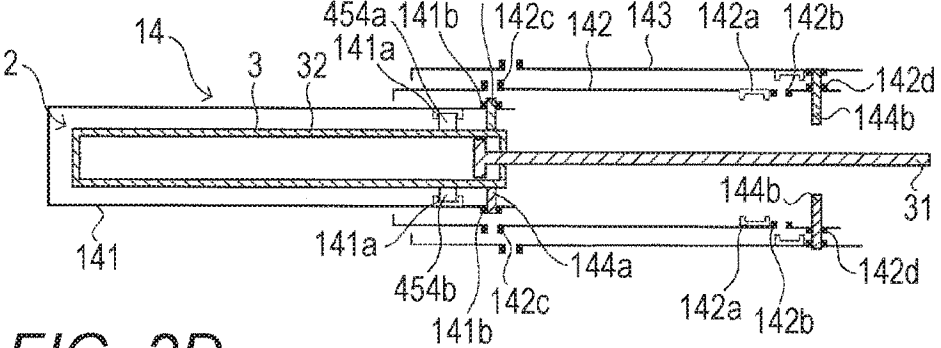
FIGS. 2A to 2E are schematic views for describing a structure and a telescoping operation of a telescopic boom.
Figure 2D:
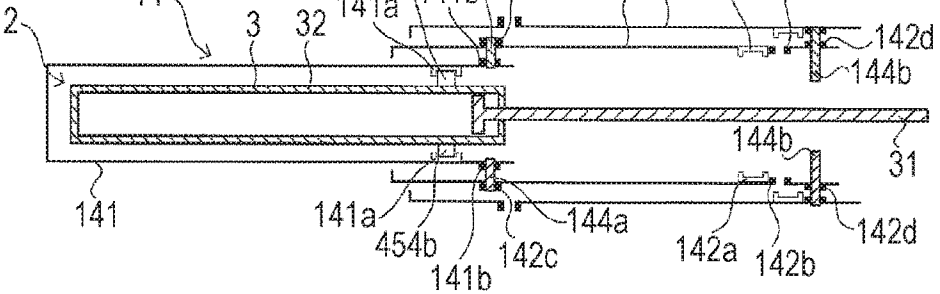
Figure 2E:
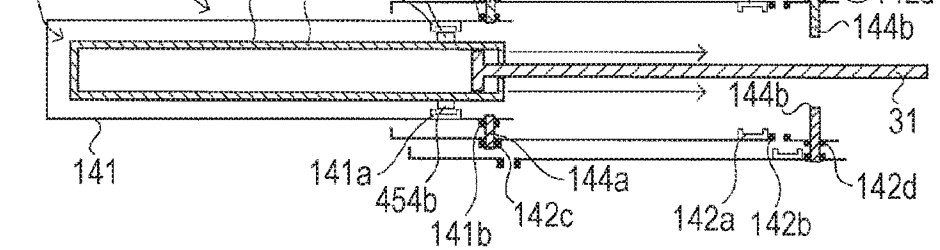
Figure 2A:
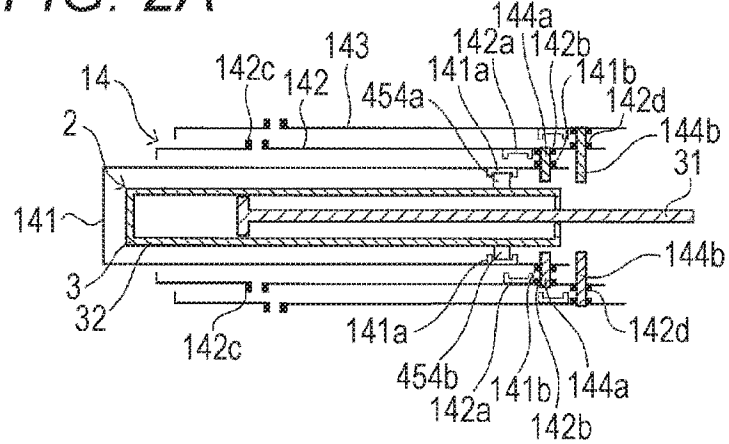
Figure 2B:
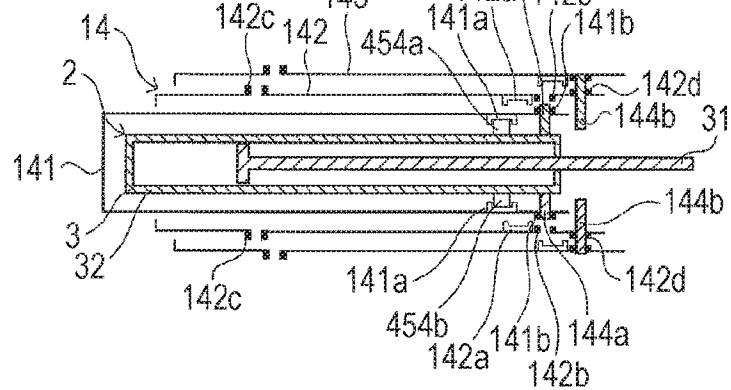
Figure 3A:
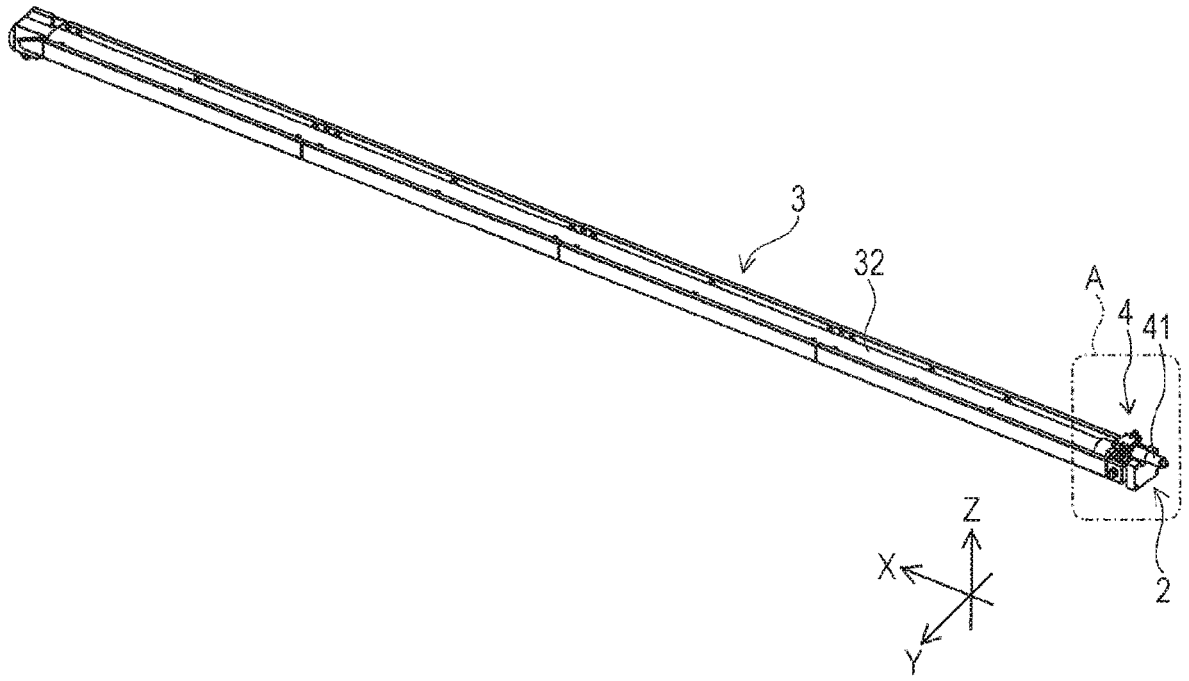
FIG. 3A is a perspective view of an actuator.
Figure 3B:
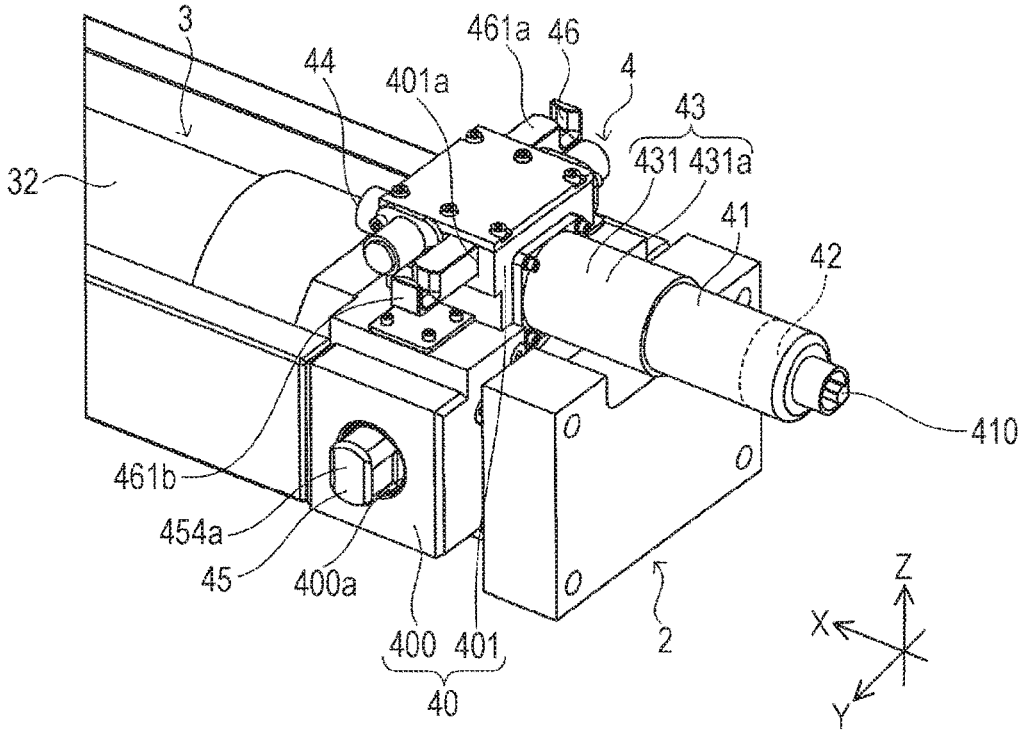
FIG. 3B is an enlarged view of portion A in FIG. 3A.
Figure 4:
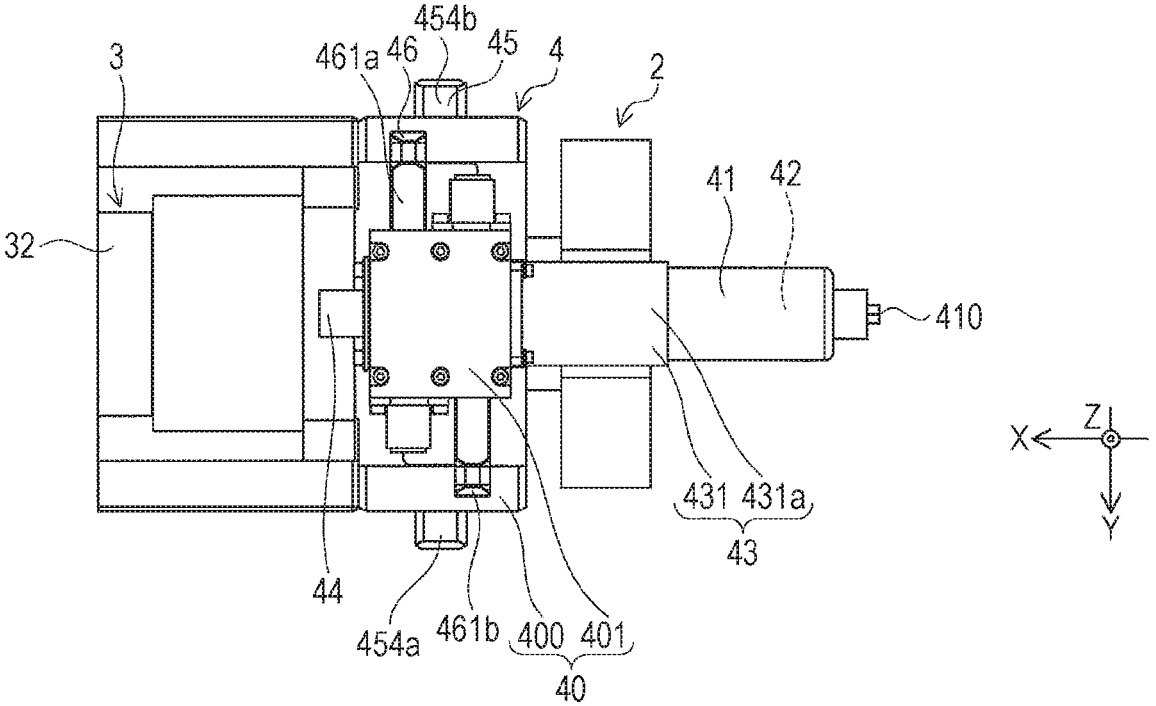
FIG. 4 is a partial plan view of the actuator.
Figure 5:
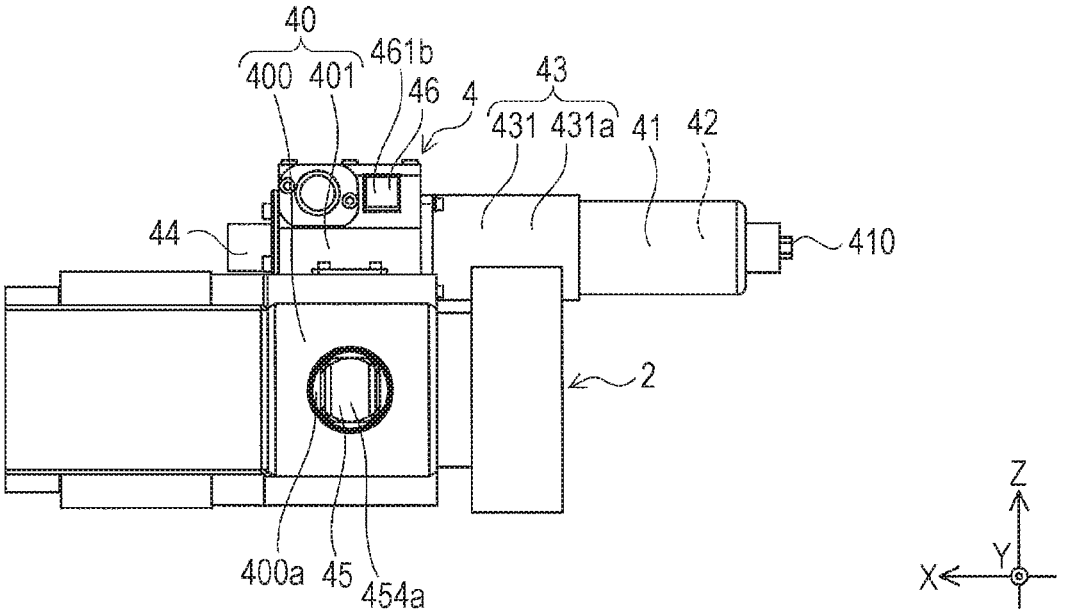
FIG. 5 is a partial side view of the actuator.
Figure 6:
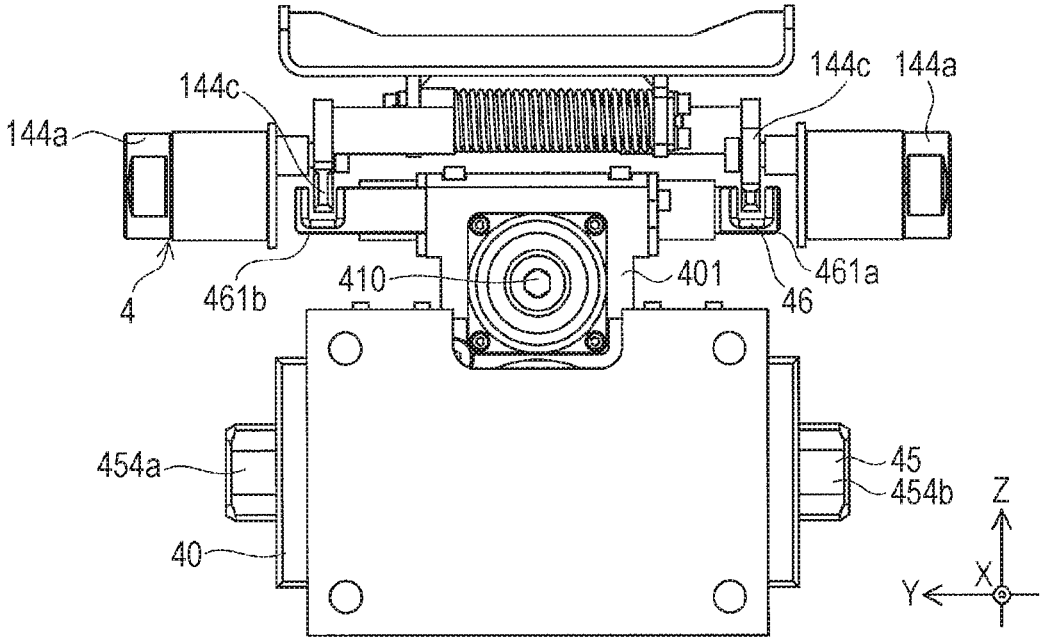
FIG. 6 is a view of the actuator in a state of holding boom coupling pins as seen from right in FIG. 5.
Figure 7:
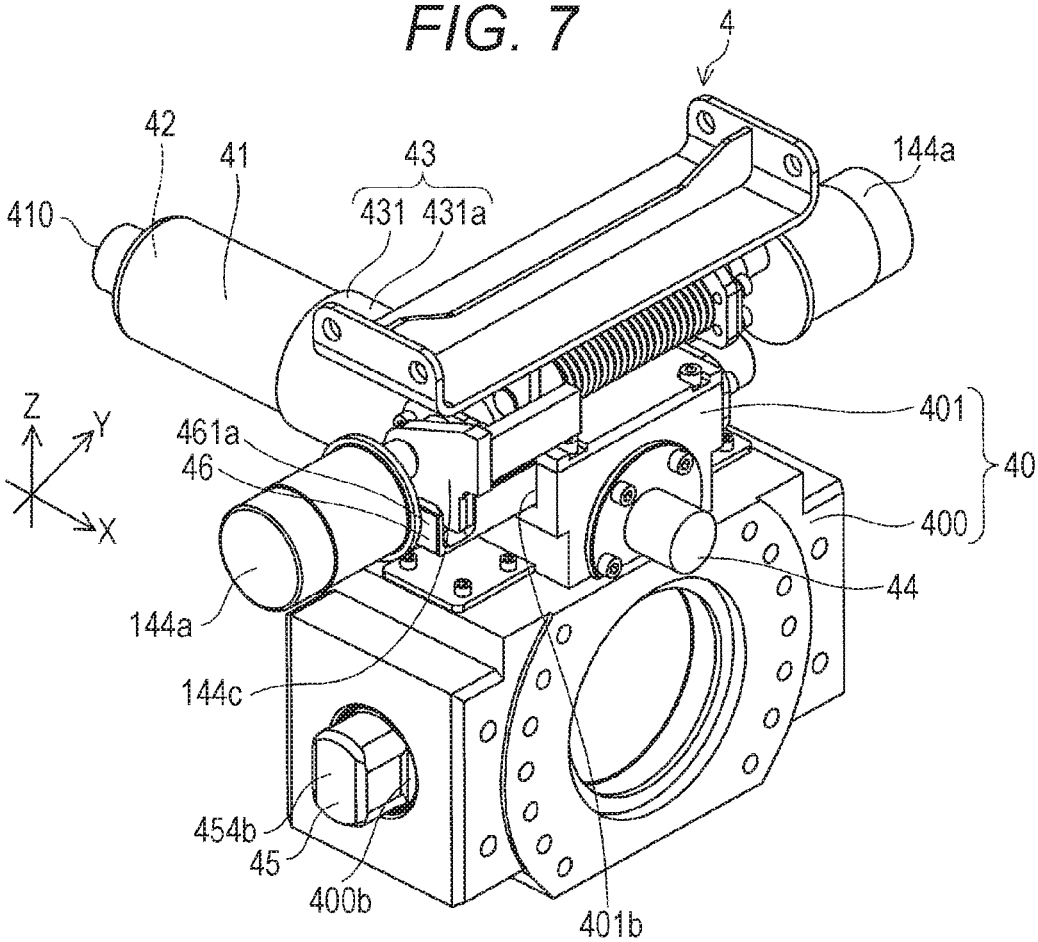
FIG. 7 is a perspective view of a pin displacement module in a state of holding the boom coupling pins.

In addition, the position information detection device 44 detects information relating the position of the pair of boom coupling pins 144*a* when the pair of boom coupling pins 144*a* and the pair of first boom pin receiving portions 142*b* (may be the pair of second boom pin receiving portions 142*c*) of a boom element (for example, the intermediate boom element 142) are in an engaged state (for example, the state illustrated in FIGS. 2A and 2D) or in a disengaged state (for example, the state illustrated in FIG. 2B).

Such detected information relating the position of the pair of cylinder coupling pins 454*a* and 454*b* and the pair of boom coupling pins 144*a* and 144*b* is used, for example, for various control of the actuator 2 including operation control of the electric motor 41.

Figure 17A:
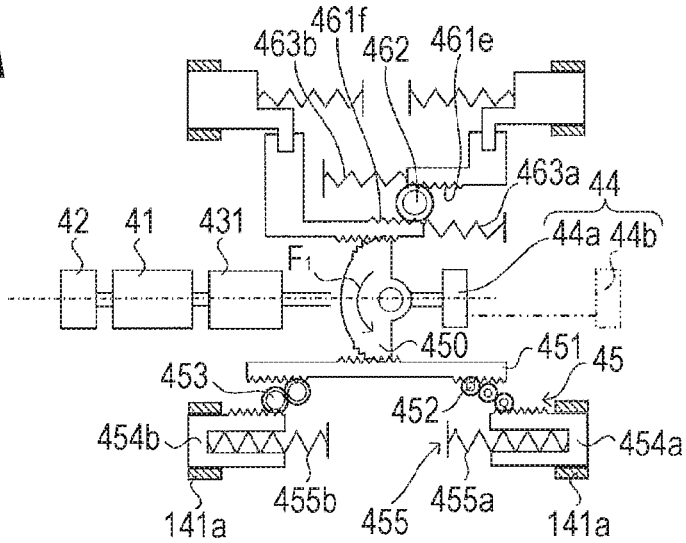
FIG. 17A is a schematic view for describing an operation of the cylinder coupling mechanism.
Figure 18A:
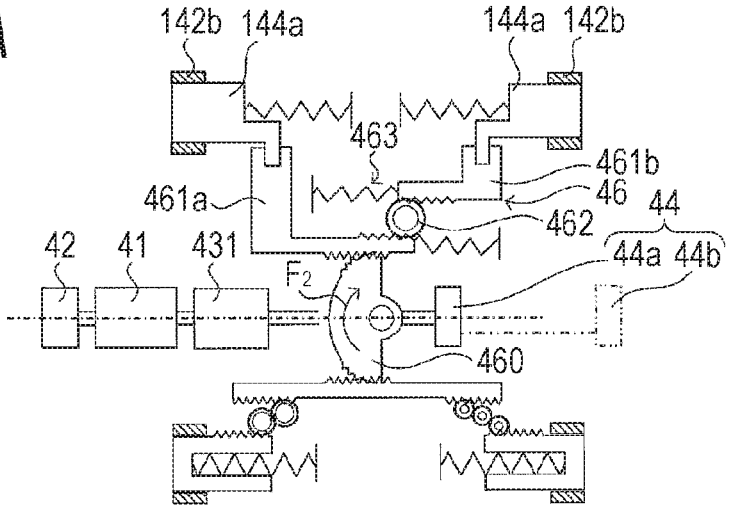
FIG. 18A is a schematic view for describing an operation of the boom coupling mechanism.

The position information detection device 44 as described above includes a detection unit 44*a* and a control unit 44*b* (refer to FIGS. 17A and 18A).

The detection unit 44*a* is, for example, a rotary encoder and outputs information (for example, pulse signal or code signal) corresponding to the rotational displacement of the output shaft of the electric motor 41. The output method of the rotary encoder is not particularly limited. The rotary encoder may be an incremental type that outputs a pulse signal (relative angle signal) corresponding to a rotational displacement amount (rotational angle) from a measurement start position or may be an absolute type that outputs a code signal (absolute angle signal) corresponding to an absolute angle position with respect to a reference point.

In a case where the detection unit 44*a* is an incremental rotary encoder, even when the control unit 44*b* returns from a non-energized state to an energized state, the position information detection device 44 can detect information relating the position of the pair of cylinder coupling pins 454*a* and 454*b* and the pair of boom coupling pins 144*a*.

The detection unit 44*a* is provided in the output shaft of the electric motor 41 or in a rotary member (for example, a rotary shaft, a gear, or the like) that rotates together with the output shaft. Specifically, in the case of the present embodiment, the detection unit 44*a* is provided in the end portion on the X-direction positive side of the transmission shaft 432 (also referred to as a rotary member). In other words, in the case of the present embodiment, the detection unit 44*a* is provided closer to the rear stage (namely, on the X-direction positive side) than the speed reducer 431.

In the case of the present embodiment, the detection unit 44*a* outputs information corresponding to the rotational displacement of the transmission shaft 432. The number of revolutions (rotational speed) of the transmission shaft 432 is obtained by reducing the number of revolutions (rotational speed) of the electric motor 41 using the speed reducer 431. In the case of the present embodiment, as the detection unit 44*a*, a rotary encoder that provides sufficient resolution for the number of revolutions (rotational speed) of the transmission shaft 432 is adopted. Incidentally, since a first tooth-missing gear 450 of the cylinder coupling mechanism 45 to be described later and a second tooth-missing gear 460 of the boom coupling mechanism 46 are fixed to the transmission shaft 432, the information output by the detection unit 44*a* is also information corresponding to the rotational displacement of the first tooth-missing gear 450 and the second tooth-missing gear 460.

The detection unit 44*a* having such a configuration transmits information, which corresponds to the rotational displacement of the output shaft of the electric motor 41, to the control unit 44*b*. The control unit 44*b* that has received the information calculates information relating the position of the pair of cylinder coupling pins 454*a* and 454*b* or the pair of boom coupling pins 144*a* based on the received information. Then, the control unit 44*b* controls the electric motor 41 according to the calculation result.

The control unit 44*b* is, for example, an in-vehicle computer configured with an input terminal, an output terminal, a CPU, a memory, and the like. The control unit 44*b* calculates information relating the position of the pair of cylinder coupling pins 454*a* and 454*b* or the boom coupling pins 144*a* based on an output of the detection unit 44*a*.

Specifically, the control unit 44*b* calculates information relating the above position using data (tables, maps, or the like) representing a correlation between the output of the detection unit 44*a* and the information (displacement amount from the reference position) regarding the position of the pair of cylinder coupling pins 454*a* and 454*b* and the pair of boom coupling pins 144*a*.

When the output of the detection unit 44*a* is a code signal, information relating the above position is calculated based on data (tables, maps, or the like) representing a correlation between the code signal and the displacement amount from the reference position in the pair of cylinder coupling pins 454*a* and 454*b* and the pair of boom coupling pins 144*a*.

The control unit 44*b* is provided in the turning table 12. However, the position where the control unit 44*b* is provided is not limited to the turning table 12. The control unit 44*b* may be provided in, for example, a case (unillustrated) in which the detection unit 44*a* is disposed.

Incidentally, the position of the detection unit 44*a* is not limited to the position in the present embodiment. For example, the detection unit 44*a* may be disposed closer to the front stage (namely, on the X-direction negative side) than the speed reducer 431. Namely, the detection unit 44*a* may acquire information to be transmitted to the control unit 44*b*, based on the rotation of the electric motor 41 but before reduction by the speed reducer 431. In the configuration where the detection unit 44*a* is disposed in the front stage of the speed reducer 431, the resolution is higher than in the configuration where the detection unit 44*a* is disposed in the rear stage of the speed reducer 431. Incidentally, in this case, the detection unit 44*a* may be disposed closer to the X-direction positive side or the X-direction negative side than the brake mechanism 42.

Incidentally, the detection unit 44*a* is not limited to the above-described rotary encoder. For example, the detection unit 44*a* may be a limit switch. The limit switch is disposed closer to the rear stage than the speed reducer 431. Such a limit switch operates mechanically according to an output of the electric motor 41. Alternatively, the detection unit 44*a* may be a proximity sensor. The proximity sensor is disposed closer to the rear stage than the speed reducer 431. In addition, the proximity sensor is disposed to face a member that rotates according to an output of the electric motor 41. Such a proximity sensor outputs a signal according to the distance from the above rotating member. Then, the control unit 44*b* controls operation of the electric motor 41 according to an output of the limit switch or the proximity sensor.

[Regarding Cylinder Coupling Mechanism]

Figure 13:
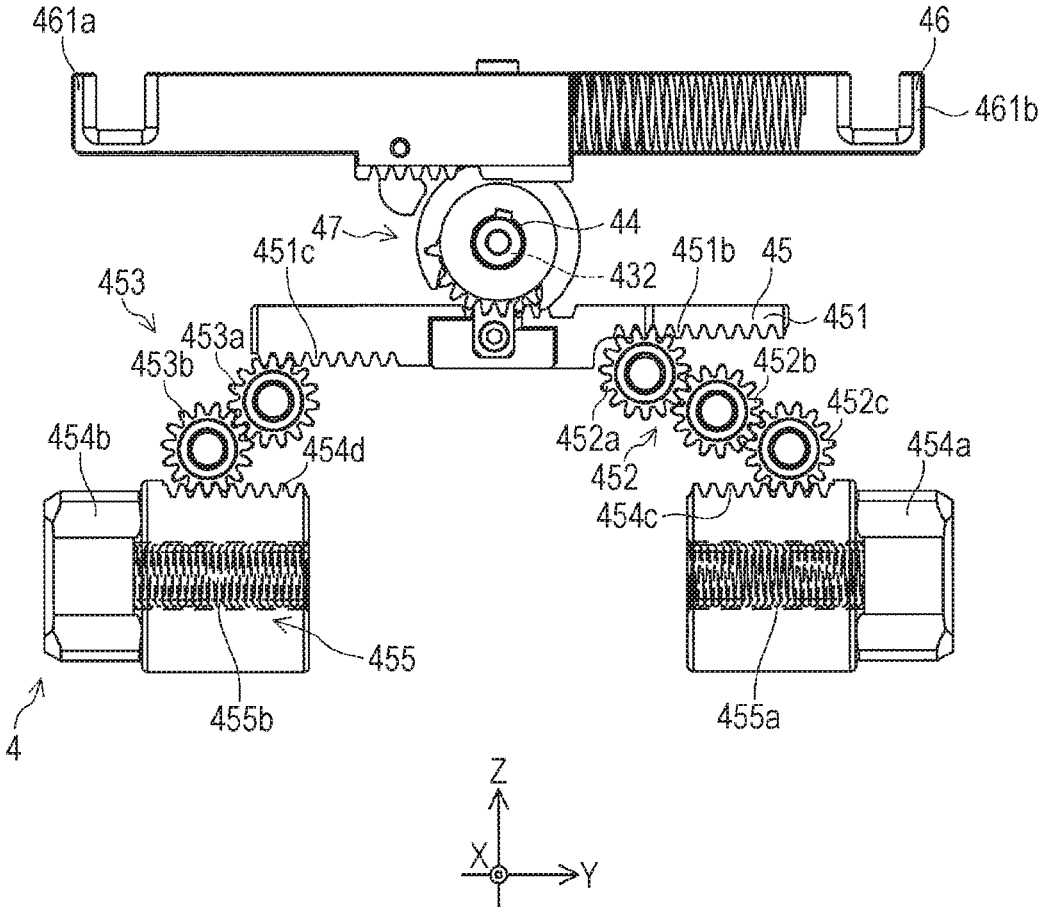
FIG. 13 is a front view of the pin displacement module in which the boom coupling mechanism is in an extended state and the cylinder coupling mechanism is in a contracted state.

The cylinder coupling mechanism 45 operates based on power (namely, rotary motion) of the electric motor 41 to make a state transition between an extended state (also referred to as a first state and refer to FIGS. 8 and 12) and a contracted state (also referred to as a second state and refer to FIG. 13).

In the extended state, the pair of cylinder coupling pins 454*a* and 454*b* to be described later and the pair of cylinder pin receiving portions 141*a* of a boom element (for example, the distal end boom element 141) enter the engaged state (also referred to as a cylinder pin insertion state). In the engaged state, the boom element and the cylinder member 32 enter the coupled state.

Meanwhile, in the contracted state, the pair of cylinder coupling pins 454*a* and 454*b* and the pair of cylinder pin receiving portions 141*a* (refer to FIGS. 2A to 2E) enter the disengaged state (the state illustrated in FIG. 2E and also referred to as a cylinder pin removal state). In the disengaged state, the boom element and the cylinder member 32 enter the non-coupled state.

Hereinafter, a specific configuration of the cylinder coupling mechanism 45 will be described. The cylinder coupling mechanism 45 includes the first tooth-missing gear 450, a first rack bar 451, a first gear mechanism 452, a second gear mechanism 453, the pair of cylinder coupling pins 454*a* and 454*b*, and a first biasing mechanism 455. Incidentally, in the case of the present embodiment, the pair of cylinder coupling pins 454*a* and 454*b* are assembled in the cylinder coupling mechanism 45. However, the pair of cylinder coupling pins 454*a* and 454*b* may be provided independently from the cylinder coupling mechanism 45.

[Regarding First Tooth-Missing Gear]

The first tooth-missing gear 450 (also referred to as a switch gear) has a substantially annular disk shape and includes a first tooth portion 450*a* (refer to FIG. 9) in a part of an outer peripheral surface thereof. The first tooth-missing gear 450 is externally fitted and fixed to the transmission shaft 432 to rotate together with the transmission shaft 432.

The first tooth-missing gear 450 as described above forms the switch gear, together with the second tooth-missing gear 460 (refer to FIG. 8) of the boom coupling mechanism 46. The switch gear selectively transmits power of the electric motor 41 to any one coupling mechanism of the cylinder coupling mechanism 45 and the boom coupling mechanism 46.

Incidentally, in the case of the present embodiment, the first tooth-missing gear 450 and the second tooth-missing gear 460 that are the switch gear are assembled in the cylinder coupling mechanism 45 that is the first coupling mechanism and in the boom coupling mechanism 46 that is the second coupling mechanism, respectively. However, the switch gear may be provided independently from the first coupling mechanism and the second coupling mechanism.

In the following description, when the cylinder coupling mechanism 45 makes a state transition from the extended state (refer to FIGS. 8 and 12) to the contracted state (refer to FIG. 13), the rotational direction (direction indicated by arrow $F_1$ in FIG. 17A) of the first tooth-missing gear 450 is toward a "front side" in the rotational direction of the first tooth-missing gear 450.

Meanwhile, during a state transition from the contracted state to the extended state, the rotation direction of the first tooth-missing gear 450 is toward a "rear side" in the rotational direction of the first tooth-missing gear 450.

Among protrusions forming the first tooth portion 450*a*, a protrusion that is provided on a front-most side in the rotational direction of the first tooth-missing gear 450 is a positioning tooth (unillustrated).

[Regarding First Rack Bar]

The first rack bar 451 is displaced in a longitudinal direction (also referred to as the Y-direction) thereof according to the rotation of the first tooth-missing gear 450. In the extended state (refer to FIGS. 8 and 12), the first rack bar 451 is positioned on a Y-direction negative-most side. Meanwhile, in the contracted state (refer to FIG. 13), the first rack bar 451 is positioned on a Y-direction positive-most side.

During a state transition from the extended state to the contracted state, when the first tooth-missing gear 450 rotates to the front side in the rotational direction, the first rack bar 451 is displaced to a Y-direction positive side (also referred to as one side in the longitudinal direction).

Meanwhile, during a state transition from the contracted state to the extended state, when the first tooth-missing gear 450 rotates to the rear side in the rotational direction, the first rack bar 451 is displaced to the Y-direction negative side (also referred to as the other side in the longitudinal direction). Hereinafter, a specific configuration of the first rack bar 451 will be described.

The first rack bar 451 is, for example, a shaft member that is long in the Y-direction, and is disposed between the first tooth-missing gear 450 and the rod member 31. In this state, the longitudinal direction of the first rack bar 451 coincides with the Y-direction.

The first rack bar 451 includes a first rack tooth portion 451*a* in a surface thereof, the surface being on a side (also referred to as the Z-direction positive side) close to the first tooth-missing gear 450. Only when the above-described state transition is made, the first rack tooth portion 451*a* meshes with the first tooth portion 450*a* of the first tooth-missing gear 450.

Figure 10:
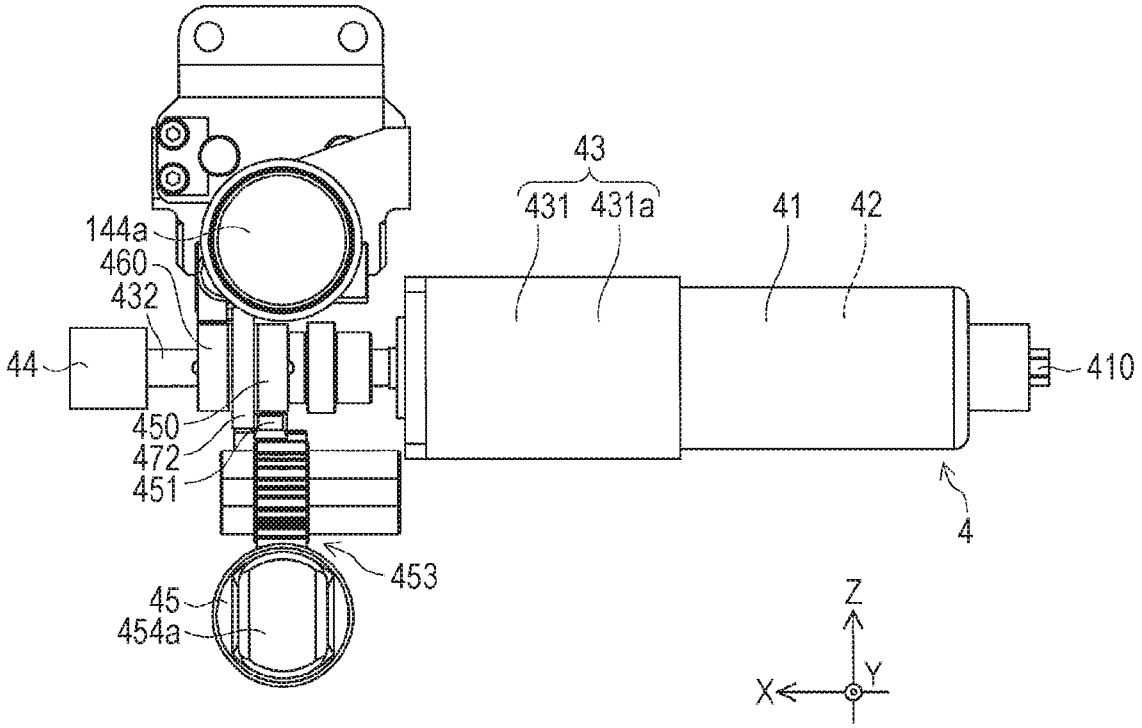
FIG. 10 is a view as seen from right in FIG. 8.
Figure 11:
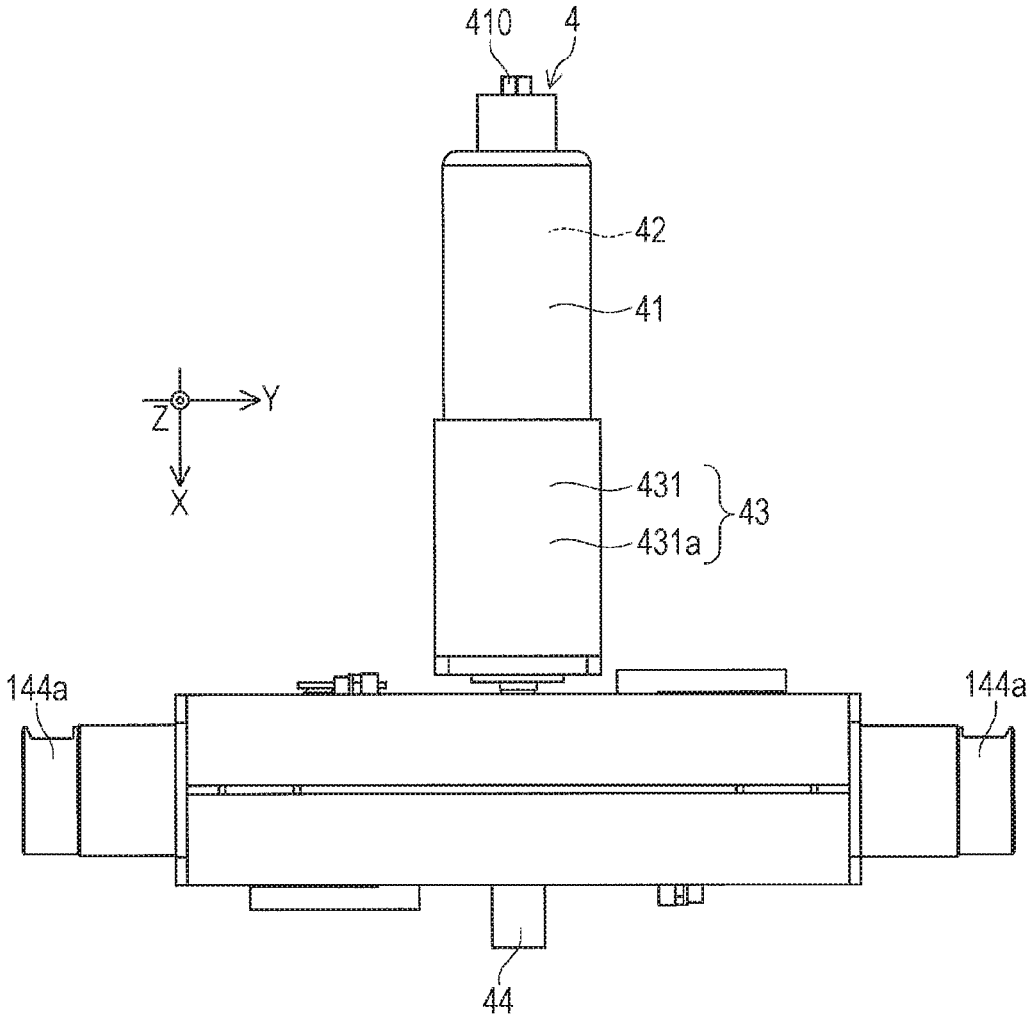
FIG. 11 is a view as seen from above in FIG. 8.
Figure 12:
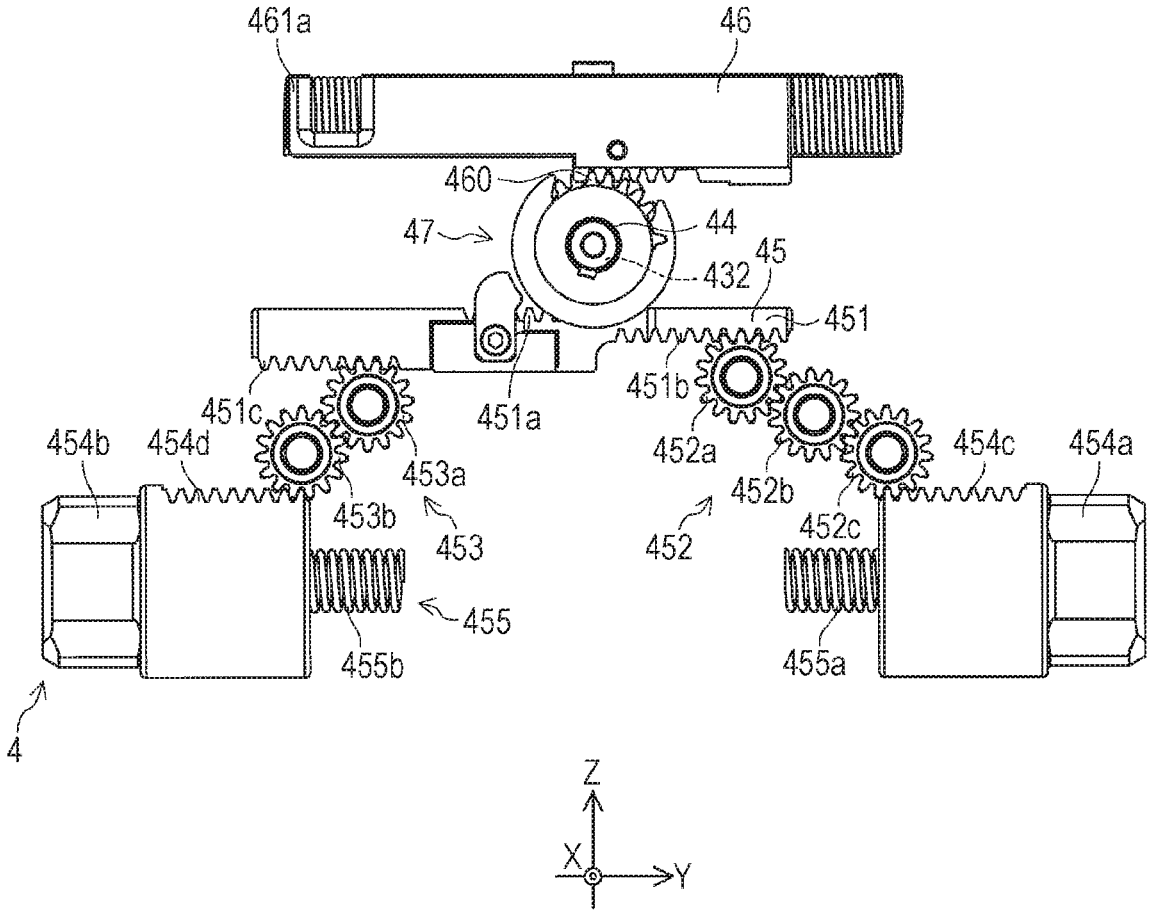
FIG. 12 is a front view of the pin displacement module in which a boom coupling mechanism is in a contracted state and a cylinder coupling mechanism is an extended state.

In the extended state illustrated in FIGS. 8 and 10, a first end surface (unillustrated) on the Y-direction positive side in the first rack tooth portion 451*a* is in contact with the positioning tooth (unillustrated) in the first tooth portion 450*a* of the first tooth-missing gear 450 or faces the positioning tooth in the Y-direction with a slight gap therebetween.

In the extended state, when the first tooth-missing gear 450 rotates to the front side in the rotational direction, the positioning tooth pushes the first end surface to the Y-direction positive side, so that the first rack bar 451 is displaced to the Y-direction positive side.

Hereupon, a tooth portion, which is present closer to the rear side in the rotational direction in the first tooth portion 450*a* than the positioning tooth, meshes with the first rack tooth portion 451*a*. As a result, the first rack bar 451 is displaced to the Y-direction positive side according to the rotation of the first tooth-missing gear 450.

Incidentally, when the first tooth-missing gear 450 rotates to the rear side in the rotational direction from the extended state illustrated in FIG. 8, the first rack tooth portion 451*a* and the first tooth portion 450*a* of the first tooth-missing gear 450 do not mesh with each other.

In addition, the first rack bar 451 includes a second rack tooth portion 451*b* and a third rack tooth portion 451*c* (refer to FIG. 8) on a surface thereof, the surface being on a side (also referred to as a Z-direction negative side) distant from the first tooth-missing gear 450. The second rack tooth portion 451*b* meshes with the first gear mechanism 452 to be described later. Meanwhile, the third rack tooth portion 451*c* meshes with the second gear mechanism 453 to be described later.

[Regarding First Gear Mechanism]

The first gear mechanism 452 is configured with a plurality (in the case of the present embodiment, three) of gear elements 452*a*, 452*b*, and 452*c* (refer to FIG. 8) of which each is a spur gear. Specifically, the gear element 452*a* that is an input gear meshes with the second rack tooth portion 451*b* of the first rack bar 451 and the gear element 452*b*. In the extended state (refer to FIGS. 8 and 12), the gear element 452*a* meshes with an end portion on the Y-direction positive side or a tooth portion of a portion close to the end portion in the second rack tooth portion 451*b* of the first rack bar 451.

The gear element 452*b* that is an intermediate gear meshes with the gear element 452*a* and the gear element 452*c*.

The gear element 452*c* that is an output gear meshes with the gear element 452*b* and a pin side rack tooth portion 454*c* of one cylinder coupling pin 454*a* to be described later. In the extended state, the gear element 452*c* meshes with an end portion on the Y-direction negative side in the pin side rack tooth portion 454*c* of the one cylinder coupling pin 454*a* (refer to FIG. 8). Incidentally, the gear element 452*c* rotates in the same direction as the rotation of the gear element 452*a*.

[Regarding Second Gear Mechanism]

The second gear mechanism 453 is configured with a plurality (in the case of the present embodiment, two) of gear elements 453*a* and 453*b* (refer to FIG. 8) of which each is a spur gear. Specifically, the gear element 453*a* that is an input gear meshes with the third rack tooth portion 451*c* of the first rack bar 451 and the gear element 453*b*. In the extended state, the gear element 453*a* meshes with an end portion on the Y-direction positive side in the third rack tooth portion 451*c* of the first rack bar 451.

The gear element 453*b* that is an output gear meshes with the gear element 453*a* and a pin side rack tooth portion 454*d* of the other cylinder coupling pin 454*b* to be described later (refer to FIG. 8). In the extended state, the gear element 453*b* meshes with an end portion on the Y-direction positive side in the pin side rack tooth portion 454*d* of the other cylinder coupling pin 454*b*. The gear element 453*b* rotates in a direction opposite to the rotation of the gear element 453*a*.

As described above, in the case of the present embodiment, the rotational direction of the gear element 452*c* of the first gear mechanism 452 is opposite to the rotational direction of the gear element 453*b* of the second gear mechanism 453.

[Regarding Cylinder Coupling Pin]

The pair of cylinder coupling pins 454*a* and 454*b* have central axes coinciding with the Y-direction and are coaxial with each other. Hereinafter, in a description of the pair of cylinder coupling pins 454*a* and 454*b*, distal end portions are end portions distant from each other and proximal end portions are end portions close to each other.

The pair of cylinder coupling pins 454*a* and 454*b* include the pin side rack tooth portions 454*c* and 454*d* (refer to FIG. 8) on outer peripheral surfaces thereof, respectively. The pin side rack tooth portion 454*c* of the one (also referred to as the Y-direction positive side) cylinder coupling pin 454*a* meshes with the gear element 452*c* of the first gear mechanism 452.

As the gear element 452*c* in the first gear mechanism 452 rotates, the one cylinder coupling pin 454*a* is displaced in an axial direction (namely, the Y-direction) thereof. Specifically, during a state transition from the contracted state to the extended state, the one cylinder coupling pin 454*a* is displaced to the Y-direction positive side. Meanwhile, during a state transition from the extended state to the contracted state, the one cylinder coupling pin 454*a* is displaced to the Y-direction negative side.

The pin side rack tooth portion 454*d* of the other (also referred to as the Y-direction negative side) cylinder coupling pin 454*b* meshes with the gear element 453*b* of the second gear mechanism 453. As the gear element 453*b* in the second gear mechanism 453 rotates, the other cylinder coupling pin 454*b* is displaced in an axial direction (namely, the Y-direction) thereof.

Specifically, during a state transition from the contracted state to the extended state, the other cylinder coupling pin 454*b* is displaced to the Y-direction negative side. Meanwhile, during a state transition from the extended state to the contracted state, the other cylinder coupling pin 454*b* is displaced to the Y-direction positive side. Namely, in the above-described state transitions, the pair of cylinder coupling pins 454*a* and 454*b* are displaced in the opposite directions in the Y-direction.

The pair of cylinder coupling pins 454*a* and 454*b* are inserted through the through-holes 400*a* and 400*b* of the first housing element 400, respectively. In this state, each of distal end portions of the pair of cylinder coupling pins 454*a* and 454*b* protrudes outside the first housing element 400.

[Regarding First Biasing Mechanism]

In the contracted state of the cylinder coupling mechanism 45, when the electric motor 41 enters a non-energized state, the first biasing mechanism 455 causes the cylinder coupling mechanism 45 to automatically return to the extended state. For this reason, the first biasing mechanism 455 biases the pair of cylinder coupling pins 454*a* and 454*b* in a direction away from each other.

Specifically, the first biasing mechanism 455 is configured with a pair of coil springs 455*a* and 455*b* (refer to FIG. 8). The pair of coil springs 455*a* and 455*b* bias proximal end portions of the pair of cylinder coupling pins 454*a* and 454*b* toward a distal end side, respectively.

Incidentally, when the brake mechanism 42 operates, the cylinder coupling mechanism 45 does not return automatically.

[Summary of Operation of Cylinder Coupling Mechanism]

Figure 17B:
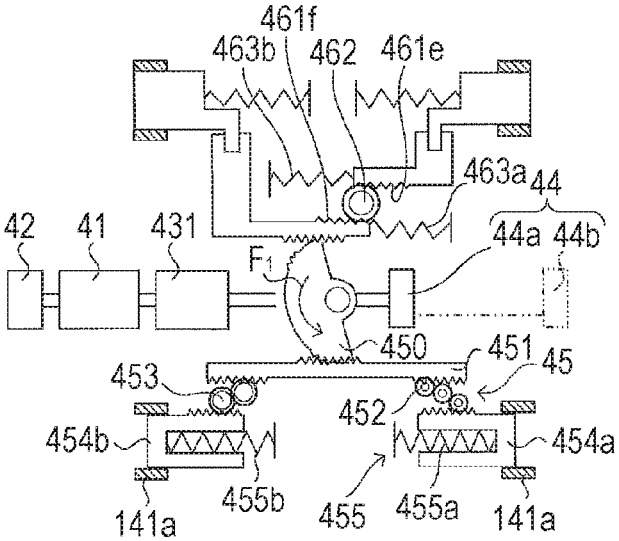
FIG. 17B is a schematic view for describing the operation of the cylinder coupling mechanism.
Figure 17C:
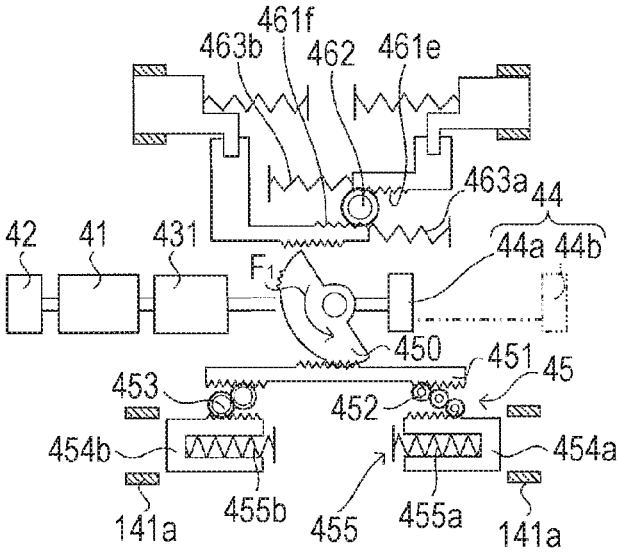
FIG. 17C is a schematic view for describing the operation of the cylinder coupling mechanism.

One example of operation of the cylinder coupling mechanism 45 described above will be simply described with reference to FIGS. 17A to 17C. FIGS. 17A to 17C are schematic views for describing the operation of the cylinder coupling mechanism 45. FIG. 17A is a schematic view illustrating the extended state of the cylinder coupling mechanism 45 and the engaged state between the pair of cylinder coupling pins 454*a* and 454*b* and the pair of cylinder pin receiving portions 141*a* of the distal end boom element 141. FIG. 17B is a schematic view illustrating a state where the cylinder coupling mechanism 45 is in the process of a state transition from the extended state to the contracted state. Furthermore, FIG. 17C is a schematic view illustrating the contracted state of the cylinder coupling mechanism 45 and the disengaged state between the pair of cylinder coupling pins 454*a* and 454*b* and the pair of cylinder pin receiving portions 141*a* of the distal end boom element 141.

The cylinder coupling mechanism 45 as described above makes a state transition between the extended state (refer to FIGS. 8, 12, and 17A) and the contracted state (refer to FIGS. 13 and 17C) by using power (namely, rotary motion) of the electric motor 41. Hereinafter, when the cylinder coupling mechanism 45 makes a state transition from the extended state to the contracted state, the operation of each part will be described with reference to FIGS. 17A to 17C. Incidentally, in FIGS. 17A to 17C, the first tooth-missing gear 450 and the second tooth-missing gear 460 are schematically illustrated as an integral tooth-missing gear. Hereinafter, for convenience of description, this integral tooth-missing gear will be described as the first tooth-missing gear 450. In addition, in FIGS. 17A to 17C, the lock mechanism 47 to be described later is unillustrated.

During a state transition from the extended state to the contracted state, power of the electric motor 41 is transmitted to the pair of cylinder coupling pins 454*a* and 454*b* via a first path and a second path below.

The first path is a path from the first tooth-missing gear 450 to the first rack bar 451, then to the first gear mechanism 452, and then to the one cylinder coupling pin 454*a*.

Meanwhile, the second path is a path from the first tooth-missing gear 450 to the first rack bar 451, then to the second gear mechanism 453, and then to the other cylinder coupling pin 454*b*.

Specifically, first, in the first path and the second path, the first tooth-missing gear 450 rotates to the front side (direction indicated by arrow $F_1$ in FIG. 17A) in the rotational direction by using power of the electric motor 41.

In the first path and the second path, when the first tooth-missing gear 450 rotates to the front side in the rotational direction, the first rack bar 451 is displaced to the Y-direction positive side (right side in FIGS. 17A to 17C) according to the rotation.

Then, in the first path, when the first rack bar 451 is displaced to the Y-direction positive side, the one cylinder coupling pin 454*a* is displaced to the Y-direction negative side (left side in FIGS. 17A to 17C) via the first gear mechanism 452.

Meanwhile, in the second path, when the first rack bar 451 is displaced to the Y-direction positive side, the other cylinder coupling pin 454*b* is displaced to the Y-direction positive side via the second gear mechanism 453. Namely, during a state transition from the extended state to the contracted state, the one cylinder coupling pin 454*a* and the other cylinder coupling pin 454*b* are displaced in a direction toward each other.

The position information detection device 44 detects that the pair of cylinder coupling pins 454*a* and 454*b* disengage from the pair of cylinder pin receiving portions 141*a* of the distal end boom element 141 to be displaced to a predetermined position (for example, position illustrated in FIGS. 2E and 17C). Then, the control unit 44*b* stops the operation of the electric motor 41 based on the detection result.

Incidentally, in the non-energized state of the electric motor 41, when the brake mechanism 42 is released, a state transition from the contracted state to the extended state (namely, state transition from the state in FIG. 17C to the state in FIG. 17A) is automatically performed by a biasing force of the first biasing mechanism 455. At the time, the one cylinder coupling pin 454*a* and the other cylinder coupling pin 454*b* are displaced in a direction away from each other. The position information detection device 44 detects that the pair of cylinder coupling pins 454*a* and 454*b* engage with the pair of cylinder pin receiving portions 141*a* of the distal end boom element 141 to be displaced to a predetermined position (for example, position illustrated in FIGS. 2A and 17A). The detection result is used to control a subsequent operation of the actuator 2.

[Regarding Boom Coupling Mechanism]

The boom coupling mechanism 46 makes a state transition between the extended state (also referred to as the first state and refer to FIGS. 8 and 13) and the contracted state (also referred to as the second state and refer to FIG. 12) according to the rotation of the electric motor 41.

In the extended state, the boom coupling mechanism 46 is in any one state of an engaged state and the disengaged state with respect to boom coupling pins (for example, the pair of boom coupling pins 144*a*).

In a state where the boom coupling mechanism 46 is engaged with boom coupling pins, the boom coupling mechanism 46 makes a state transition from the extended state to the contracted state to cause the boom coupling pins to disengage from a boom element.

In addition, in a state where the boom coupling mechanism 46 is engaged with the boom coupling pins, the boom coupling mechanism 46 makes a state transition from the contracted state to the extended state to cause the boom coupling pins to engage with the boom element.

Hereinafter, a specific configuration of the boom coupling mechanism 46 will be described. The boom coupling mechanism 46 includes the second tooth-missing gear 460 (refer to FIG. 8), the pair of second rack bars 461*a* and 461*b*, a synchronous gear 462 (refer to FIGS. 17A to 17C), and a second biasing mechanism 463.

[Regarding Second Tooth-Missing Gear]

The second tooth-missing gear 460 (also referred to as a switch gear) has a substantially annular disk shape and includes a second tooth portion 460*a* in a part of an outer peripheral surface thereof in a circumferential direction.

The second tooth-missing gear 460 is externally fitted and fixed to a portion closer to the X-direction positive side in the transmission shaft 432 than the first tooth-missing gear 450, to rotate together with the transmission shaft 432. Incidentally, as in schematic views illustrated in FIGS. 14A to 14D, the second tooth-missing gear 460 may be, for example, a tooth-missing gear integral with the first tooth-missing gear 450.

Hereinafter, when the boom coupling mechanism 46 makes a state transition from the extended state (refer to FIGS. 8 and 13) to the contracted state (refer to FIG. 12), the rotational direction (direction indicated by arrow $F_2$ in FIG. 8) of the second tooth-missing gear 460 is toward a "front side" in the rotational direction of the second tooth-missing gear 460.

Meanwhile, during a state transition from the contracted state to the extended state, the rotation direction (direction indicated by arrow $R_2$ in FIG. 8) of the second tooth-missing gear 460 is toward a "rear side" in the rotational direction of the second tooth-missing gear 460.

Among protrusions forming the second tooth portion 460*a*, a protrusion that is provided on a front-most side in the rotational direction of the second tooth-missing gear 460 is a positioning tooth 460*b* (refer to FIG. 8).

Incidentally, FIG. 8 is a view of the pin displacement module 4 as seen from the X-direction positive side. Therefore, in the case of the present embodiment, a forward and rearward direction in the rotational direction of the second tooth-missing gear 460 is reverse to a forward and rearward direction in the rotational direction of the first tooth-missing gear 450.

Namely, the rotational direction of the second tooth-missing gear 460 when the boom coupling mechanism 46 makes a state transition from the extended state to the contracted state is reverse to the rotational direction of the first tooth-missing gear 450 when the cylinder coupling mechanism 45 makes a state transition from the extended state to the contracted state.

[Regarding Second Rack Bar]

As the second tooth-missing gear 460 rotates, each of the pair of second rack bars 461*a* and 461*b* is displaced in the Y-direction (also referred to as the axial direction). One (also referred to as the X-direction positive side) second rack bar 461*a* and the other (also referred to as the X-direction negative side) second rack bar 461*b* are displaced in opposite directions in the Y-direction.

In the extended state, the one second rack bar 461*a* is positioned on a Y-direction negative-most side. In the extended state, the other second rack bar 461*b* is positioned on a Y-direction positive-most side.

In addition, in the contracted state, the one second rack bar 461*a* is positioned on a Y-direction positive-most side. In the contracted state, the other second rack bar 461*b* is positioned on a Y-direction negative-most side.

Incidentally, when the one second rack bar 461*a* and the other second rack bar 461*b* come into contact with, for example a stopper surface 48 (refer to FIG. 14D) provided in the housing 40, the displacement of the one second rack bar 461*a* to the Y-direction positive side and the displacement of the other second rack bar 461*b* to the Y-direction negative side are restricted.

Hereinafter, a specific configuration of the pair of second rack bars 461*a* and 461*b* will be described. The pair of second rack bars 461*a* and 461*b* each are, for example, shaft members that are long in the Y-direction, and are disposed in parallel with each other. Each of the pair of second rack bars 461*a* and 461*b* is disposed closer to the Z-direction positive side than the first rack bar 451. In addition, the synchronous gear 462 to be described later is disposed at the center between the pair of second rack bars 461*a* and 461*b* in the X-direction. The longitudinal direction of each of the pair of second rack bars 461*a* and 461*b* as described above coincides with the Y-direction.

The pair of second rack bars 461*a* and 461*b* include synchronous rack tooth portions 461*e* and 461*f* (refer to FIGS. 17A to 17C) in side surfaces thereof which face each other in the X-direction, respectively. The synchronous rack tooth portions 461*e* and 461*f* mesh with the synchronous gear 462.

In other words, the synchronous rack tooth portions 461*e* and 461*f* mesh with each other via the synchronous gear 462. With this configuration, the one second rack bar 461*a* and the other second rack bar 461*b* are displaced in the opposite directions in the Y-direction.

The pair of second rack bars 461*a* and 461*b* include locking claw portions 461*g* and 461*h* (also referred to as locking portions and refer to FIG. 8) in distal end portions thereof, respectively. When the boom coupling pins 144*a* and 144*b* are displaced, the locking claw portions 461*g* and 461*h* as described above engage with pin side receiving portions 144*c* (refer to FIG. 8) provided in the boom coupling pins 144*a* and 144*b*, respectively.

The one second rack bar 461*a* includes a drive rack tooth portion 461*c* (refer to FIG. 8) in a surface thereof, the surface being on a side (also referred to as the Z-direction positive side) close to the second tooth-missing gear 460. The drive rack tooth portion 461*c* meshes with the second tooth portion 460*a* of the second tooth-missing gear 460.

In the extended state (refer to FIG. 8), a first end surface 461*d* on the Y-direction positive side in the drive rack tooth portion 461*c* is in contact with the positioning tooth 460*b* in the second tooth portion 460*a* of the second tooth-missing gear 460 or faces the positioning tooth 460*b* in the Y-direction with a slight gap therebetween.

When the second tooth-missing gear 460 rotates to the front side in the rotational direction from the extended state, the positioning tooth 460*b* pushes the first end surface 461*d* to the Y-direction positive side. With such pushing, the one second rack bar 461*a* is displaced to the Y-direction positive side.

When the one second rack bar 461*a* is displaced to the Y-direction positive side, the synchronous gear 462 rotates, so that the other second rack bar 461*b* is displaced to the Y-direction negative side (namely, opposite side from the one second rack bar 461*a*).

[Regarding Second Biasing Mechanism]

In the contracted state of the boom coupling mechanism 46, when the electric motor 41 enters a non-energized state, the second biasing mechanism 463 causes the boom coupling mechanism 46 to automatically return to the extended state. Incidentally, when the brake mechanism 42 operates, the boom coupling mechanism 46 does not return automatically.

For this reason, the second biasing mechanism 463 biases the pair of second rack bars 461*a* and 461*b* in a direction away from each other. Specifically, the second biasing mechanism 463 is configured with a pair of coil springs 463*a* and 463*b* (refer to FIGS. 17A to 17C). The pair of coil springs 463*a* and 463*b* bias proximal end portions of the pair of second rack bars 461*a* and 461*b* toward the distal end side, respectively.

[Summary of Operation of Boom Coupling Mechanism]

Figure 18B:
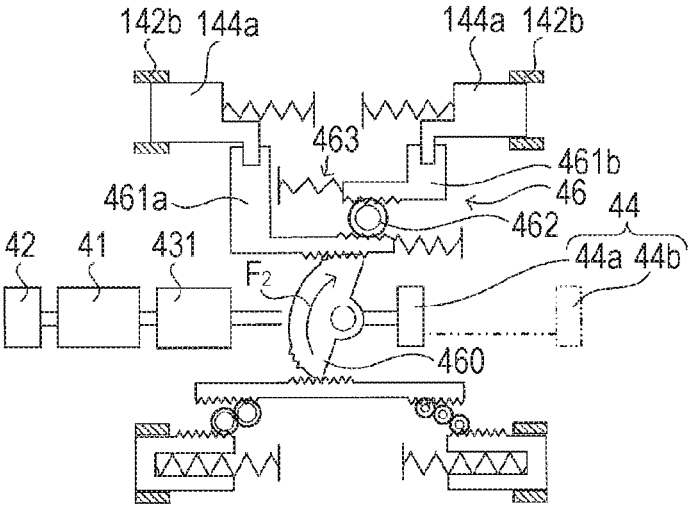
FIG. 18B is a schematic view for describing the operation of the boom coupling mechanism.
Figure 18C:
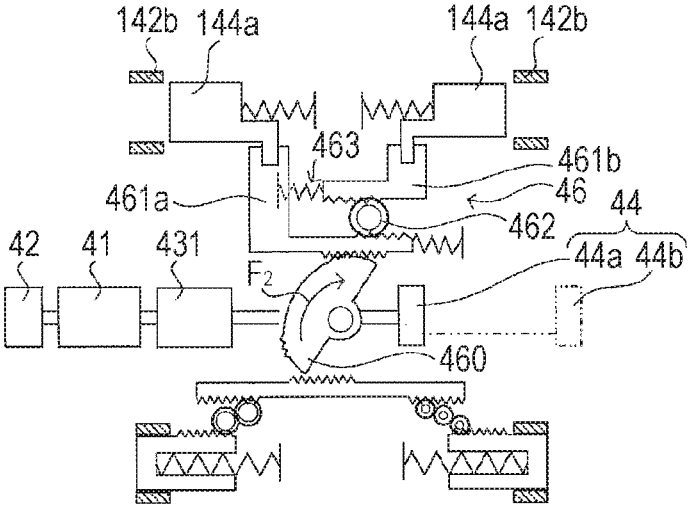
FIG. 18C is a schematic view for describing the operation of the boom coupling mechanism.

One example of operation of the boom coupling mechanism 46 described above will be simply described with reference to FIGS. 18A to 18C. FIGS. 18A to 18C are schematic views for describing the operation of the boom coupling mechanism 46. FIG. 18A is a schematic view illustrating the extended state of the boom coupling mechanism 46 and the engaged state between the pair of boom coupling pins 144*a* and the pair of first boom pin receiving portions 142*b* of the intermediate boom element 142. FIG. 18B is a schematic view illustrating a state where the boom coupling mechanism 46 is in the process of a state transition from the extended state to the contracted state. Furthermore, FIG. 18C is a schematic view illustrating the contracted state of the boom coupling mechanism 46 and the disengaged state between the pair of boom coupling pins 144*a* and the pair of first boom pin receiving portions 142*b* of the intermediate boom element 142.

The boom coupling mechanism 46 as described above makes a state transition between the extended state (refer to FIG. 18A) and the contracted state (refer to FIG. 18C) by using power (namely, rotary motion) of the electric motor 41. Hereinafter, when the boom coupling mechanism 46 makes a state transition from the extended state to the contracted state, the operation of each part will be described with reference to FIGS. 18A to 18C. Incidentally, in FIGS. 18A to 18C, the first tooth-missing gear 450 and the second tooth-missing gear 460 are schematically illustrated as an integral tooth-missing gear. Hereinafter, for convenience of description, this integral tooth-missing gear will be described as the second tooth-missing gear 460. In addition, in FIGS. 18A to 18C, the lock mechanism 47 to be described later is unillustrated.

During a state transition from the extended state to the contracted state, power (namely, rotary motion) of the electric motor 41 is transmitted via a path from the second tooth-missing gear 460 to the one second rack bar 461*a*, then to the synchronous gear 462, and then to the other second rack bar 461*b*.

First, in the above path, the second tooth-missing gear 460 rotates to the front side (direction indicated by arrow $F_2$ in FIG. 8) in the rotational direction by using power of the electric motor 41.

When the second tooth-missing gear 460 rotates to the front side in the rotational direction, the one second rack bar 461*a* is displaced to the Y-direction positive side (right side in FIGS. 18A to 18C) according to the rotation.

Hereupon, the synchronous gear 462 rotates according to the displacement of the one second rack bar 461*a* to the Y-direction positive side. Then, the other second rack bar 461*b* is displaced to the Y-direction negative side (left side in FIGS. 18A to 18C) according to the rotation of the synchronous gear 462.

In a state where the pair of second rack bars 461*a* and 461*b* are engaged with the pair of boom coupling pins 144*a*, during a state transition from the extended state to the contracted state, the pair of boom coupling pins 144*a* disengage from the pair of first boom pin receiving portions 142*b* of the intermediate boom element 142 (refer to FIG. 18C).

The position information detection device 44 detects that the pair of boom coupling pins 144*a* disengage from the pair of first boom pin receiving portions 142*b* of the intermediate boom element 142 to be displaced to a predetermined position (for example, position illustrated in FIGS. 2B and 18C). Then, the control unit 44*b* stops the operation of the electric motor 41 based on the detection result.

Incidentally, in the non-energized state of the electric motor 41, when the brake mechanism 42 is released, a state transition from the contracted state to the extended state (namely, state transition from the state in FIG. 18C to the state in FIG. 18A) is automatically performed by a biasing force of the second biasing mechanism 463. At the time, the pair of boom coupling pins 144*a* are displaced in a direction away from each other. The position information detection device 44 detects that the pair of boom coupling pins 144*a* engage with the pair of first boom pin receiving portions 142*b* of the intermediate boom element 142 to be displaced to a predetermined position (for example, position illustrated in FIGS. 2A and 18A). The detection result is used to control a subsequent operation of the actuator 2.

In addition, in the case of the present embodiment, in one boom element (for example, the distal end boom element 141), a cylinder coupling pin removal state and a boom coupling pin removal state are prevented from being realized at the same time.

For this reason, a state transition of the cylinder coupling mechanism 45 and a state transition of the boom coupling mechanism 46 are prevented from occurring at the same time.

Specifically, when the first tooth portion 450*a* of the first tooth-missing gear 450 in the cylinder coupling mechanism 45 meshes with the first rack tooth portion 451*a* of the first rack bar 451, the second tooth portion 460*a* of the second tooth-missing gear 460 in the boom coupling mechanism 46 is configured to not mesh with the drive rack tooth portion 461*c* of the one second rack bar 461*a*.

In addition, on the contrary, when the second tooth portion 460*a* of the second tooth-missing gear 460 in the boom coupling mechanism 46 meshes with the drive rack tooth portion 461*c* of the one second rack bar 461*a*, the first tooth portion 450*a* of the first tooth-missing gear 450 in the cylinder coupling mechanism 45 is configured to not mesh with the first rack tooth portion 451*a* of the first rack bar 451.

[Regarding Lock Mechanism]

As described above, by means of the configuration of the boom coupling mechanism 46 and the cylinder coupling mechanism 45, the actuator 2 according to the present embodiment prevents the cylinder coupling pin removal state and the boom coupling pin removal state from being realized at the same time in one boom element (for example, the distal end boom element 141). Such a configuration prevents the boom coupling mechanism 46 and the cylinder coupling mechanism 45 from operating at the same time based on power of the electric motor 41.

With such a configuration, the actuator 2 according to the present embodiment includes the lock mechanism 47 that prevents the cylinder coupling mechanism 45 and the boom coupling mechanism 46 from making a state transition at the same time when an external force other than from the electric motor 41 is applied to the cylinder coupling mechanism 45 (for example, the first rack bar 451) or the boom coupling mechanism 46 (for example, the second rack bar 461*a*).

The lock mechanism 47 as described above prevents operation of another coupling mechanism in a state where one coupling mechanism of the boom coupling mechanism 46 and the cylinder coupling mechanism 45 operates. Hereinafter, a specific structure of the lock mechanism 47 will be described with reference to FIGS. 14A to 14D. Incidentally, FIGS. 14A to 14D are schematic views for describing the structure of the lock mechanism 47.

In addition, in FIGS. 14A to 14D, the first tooth-missing gear 450 of the cylinder coupling mechanism 45 and the second tooth-missing gear 460 of the boom coupling mechanism 46 are configured with an integral tooth-missing gear 49 (also referred to as a switch gear) that is integrally formed. The integral tooth-missing gear 49 as described above has a substantially annular disk shape and includes a tooth portion 49*a* in a part of an outer peripheral surface thereof. The structure of the other portion is the same as the above-described structure in the present embodiment.

The lock mechanism 47 includes a first protrusion 470, a second protrusion 471, and a cam member 472 (also referred to as a rock side rotary member).

The first protrusion 470 is integrally provided with the first rack bar 451 of the cylinder coupling mechanism 45. Specifically, the first protrusion 470 is provided in a position adjacent to the first rack tooth portion 451*a* of the first rack bar 451.

The second protrusion 471 is integrally provided with the one second rack bar 461*a* of the boom coupling mechanism 46. Specifically, the second protrusion 471 is provided in a position adjacent to the drive rack tooth portion 461*c* of the one second rack bar 461*a*.

The cam member 472 is a substantially crescent-shaped plate member. The cam member 472 as described above includes a first cam receiving portion 472*a* at one end thereof in the circumferential direction. Meanwhile, the cam member 472 includes a second cam receiving portion 472*b* at the other end thereof in the circumferential direction.

The cam member 472 is externally fitted and fixed to the transmission shaft 432, for example, in a position deviated in the X-direction from a position where the integral tooth-missing gear 49 is externally fitted and fixed. Incidentally, in the case of the present embodiment, the cam member 472 is externally fitted and fixed between the first tooth-missing gear 450 and the second tooth-missing gear 460. Namely, the cam member 472 and the integral tooth-missing gear 49 are coaxially provided. The cam member 472 as described above rotates together with the transmission shaft 432. Therefore, the cam member 472 rotates around the central axis of the transmission shaft 432, together with the integral tooth-missing gear 49.

Incidentally, the cam member 472 may be integral with the integral tooth-missing gear 49. In addition, in the case of the present embodiment, the cam member 472 may be integral with at least one tooth-missing gear of the first tooth-missing gear 450 and the second tooth-missing gear 460.

As illustrated in FIGS. 14B to 14D and 15A, in a state where the tooth portion 49*a* of the integral tooth-missing gear 49 (also the second tooth portion 460*a* of the second tooth-missing gear 460) meshes with the drive rack tooth portion 461*c* of the one second rack bar 461*a*, the first cam receiving portion 472*a* of the cam member 472 is positioned closer to the Y-direction positive side than the first protrusion 470. Incidentally, at the time, the tooth portion 49*a* of the integral tooth-missing gear 49 does not mesh with the first rack tooth portion 451*a* of the first rack bar 451.

Figure 15A:
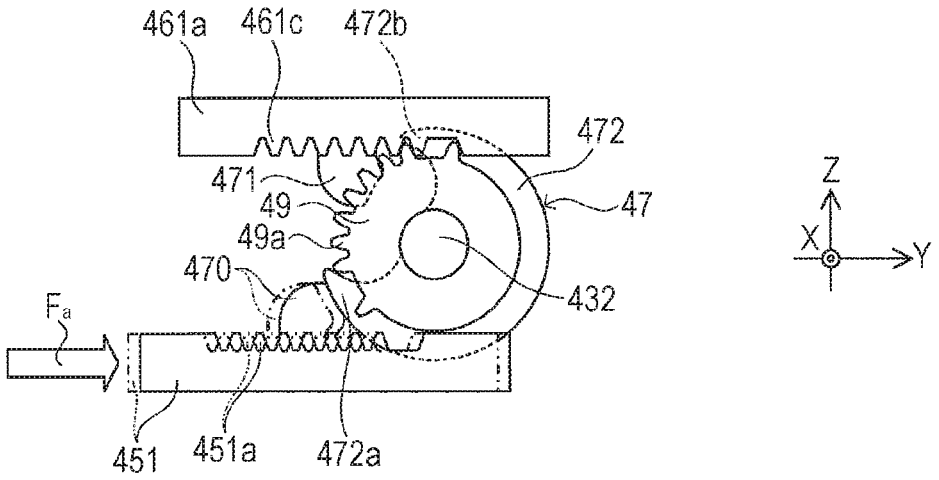
FIG. 15A is a schematic view for describing the action of the lock mechanism.

In this state, the first cam receiving portion 472*a* and the first protrusion 470 face each other with a small gap therebetween in the Y-direction (refer to FIG. 15A). Accordingly, even when an external force toward the Y-direction positive side (force in a direction indicated by arrow $F_a$ in FIG. 15A) is applied to the first rack bar 451, the first rack bar 451 is prevented from being displaced to the Y-direction positive side.

Specifically, when the external force $F_a$ toward the Y-direction positive side is applied to the first rack bar 451, the first rack bar 451 is displaced to the Y-direction positive side from a position indicated by a two-dot chain line to a position indicated by a solid line in FIG. 15A. In this state, the first protrusion 470 comes into contact with the first cam receiving portion 472*a*, so that the first rack bar 451 is prevented from being displaced to the Y-direction positive side.

Figure 14A:
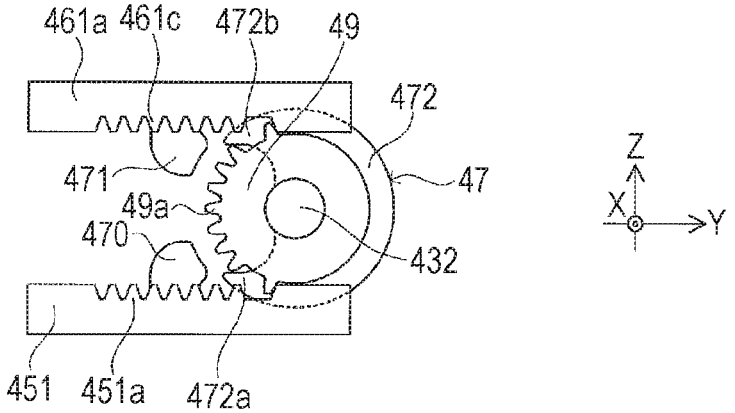
FIG. 14A is a schematic view for describing an operation of a lock mechanism.
Figure 14B:
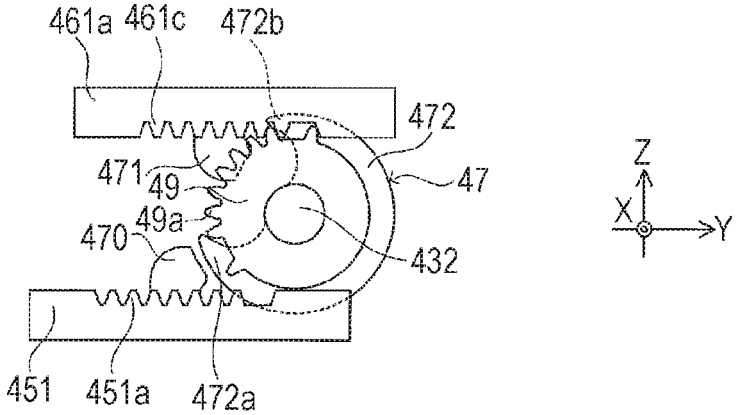
FIG. 14B is a schematic view for describing the operation of the lock mechanism.
Figure 14C:
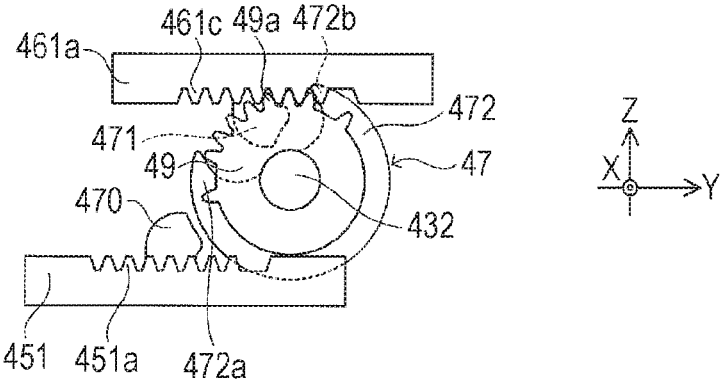
FIG. 14C is a schematic view for describing the operation of the lock mechanism.
Figure 14D:
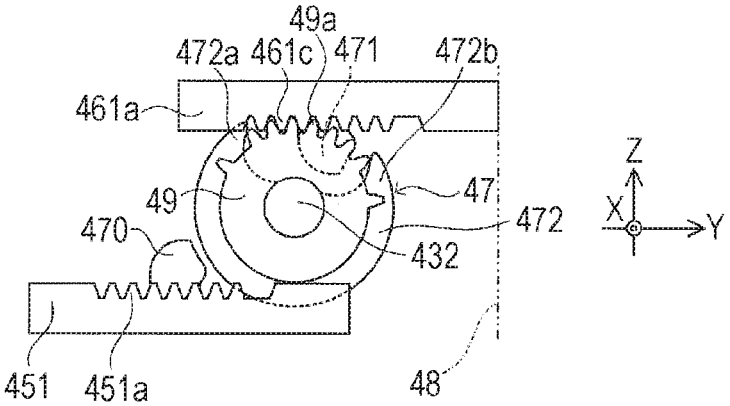
FIG. 14D is a schematic view for describing the operation of the lock mechanism.

Incidentally, in the state illustrated in FIGS. 14B to 14D, an outer peripheral surface of the cam member 472 and the first protrusion 470 face each other with a small gap therebetween in the Y-direction. Accordingly, even when an external force toward the Y-direction positive side is applied to the first rack bar 451, the first rack bar 451 is prevented from being displaced to the Y-direction positive side.

Figure 15B:
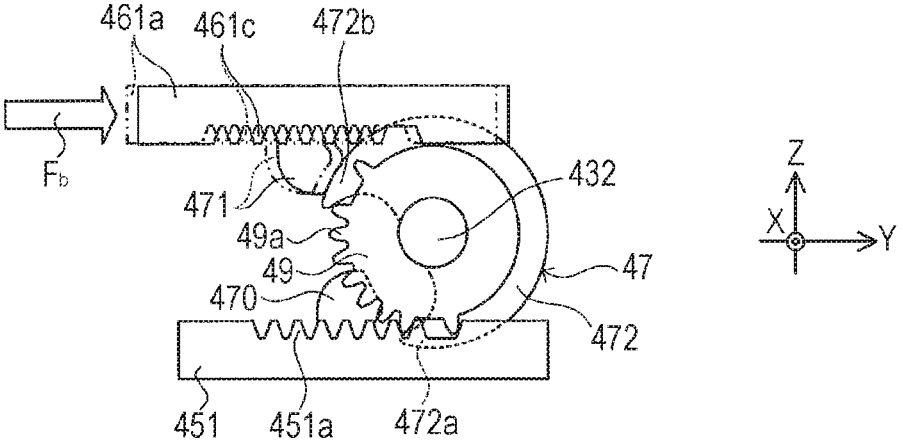
FIG. 15B is a schematic view for describing the action of the lock mechanism.

Meanwhile, as illustrated in FIG. 15B, in a state where the tooth portion 49*a* of the integral tooth-missing gear 49 (also the first tooth portion 450*a* of the first tooth-missing gear 450 in the cylinder coupling mechanism 45) meshes with the first rack tooth portion 451*a* of the first rack bar 451, the second cam receiving portion 472*b* of the cam member 472 is positioned closer to the Y-direction positive side than the second protrusion 471.

In this state (state indicated by a two-dot chain line in FIG. 15B), the second cam receiving portion 472*b* and the second protrusion 471 face each other with a small gap therebetween in the Y-direction. Accordingly, even when an external force (indicated by arrow $F_b$ in FIG. 15B) toward the Y-direction positive side is applied to the one second rack bar 461*a*, the one second rack bar 461*a* is prevented from being displaced to the Y-direction positive side. Specifically, when the external force $F_b$ toward the Y-direction positive side is applied to the one second rack bar 461*a*, the one second rack bar 461*a* is displaced to the Y-direction positive side from a position indicated by a two-dot chain line to a position indicated by a solid line in FIG. 15B. In this state, the second protrusion 471 comes into contact with the second cam receiving portion 472*b*, so that the one second rack bar 461*a* is prevented from being displaced to the Y-direction positive side.

[1.2 Regarding Operation of Actuator]

Figure 16:
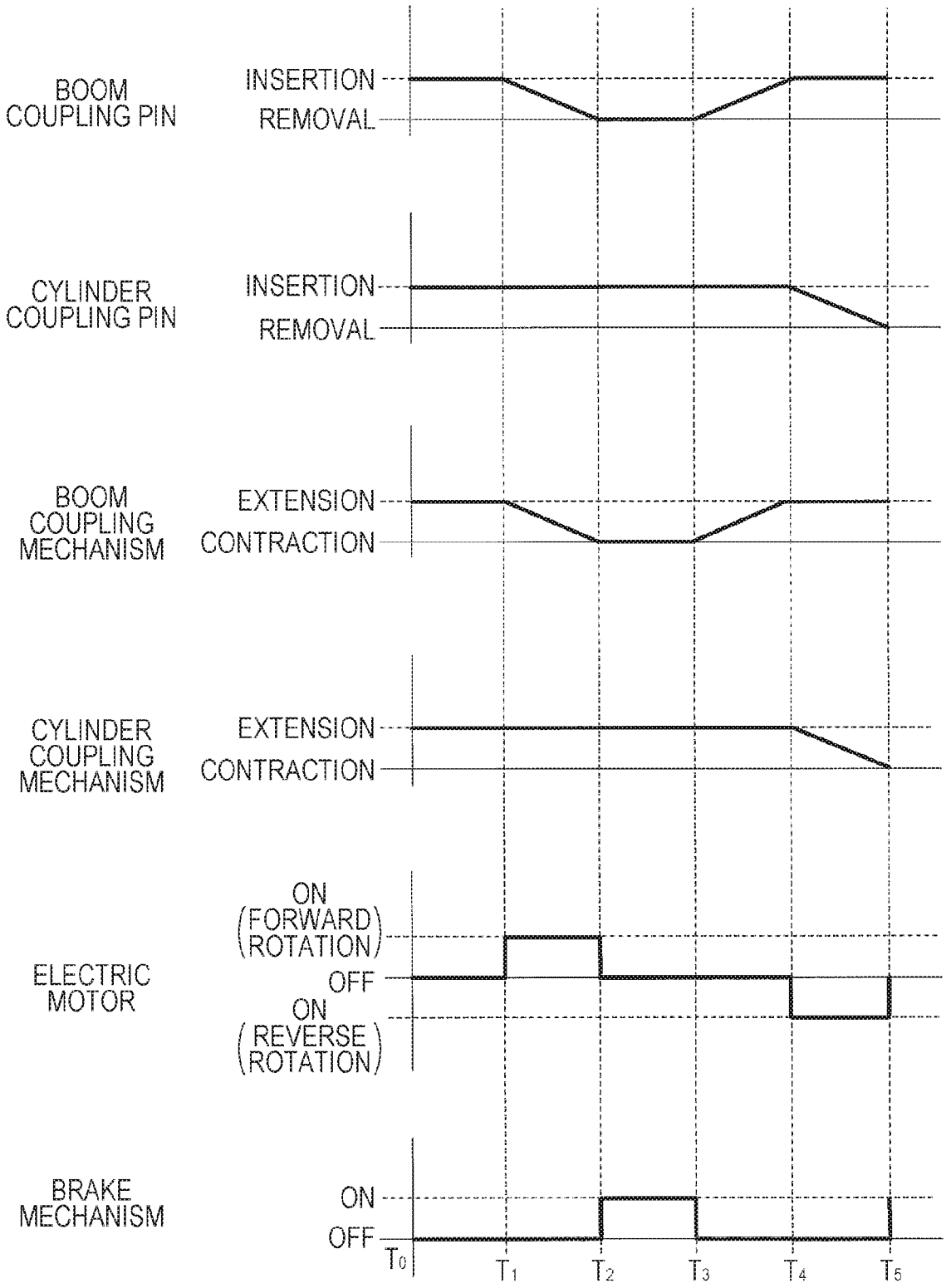
FIG. 16 is a timing chart when the telescopic boom performs an extension operation.

Hereinafter, a telescoping operation of the telescopic boom 14 and an operation of the actuator 2 during the telescoping operation will be described with reference to FIGS. 2A to 2E and 16. FIG. 16 is a timing chart when the distal end boom element 141 in the telescopic boom 14 performs an extension operation.

Hereinafter, only the extension operation of the distal end boom element 141 in the telescopic boom 14 will be described. Incidentally, a contraction operation of the distal end boom element 141 is reverse to the following procedure of the extension operation.

Incidentally, in the following description, a state transition between the extended state and the contracted state of the cylinder coupling mechanism 45 and the boom coupling mechanism 46 is as described above. For this reason, a detailed description on the state transition of the cylinder coupling mechanism 45 and the boom coupling mechanism 46 will be omitted.

In addition, the control unit controls switching of the electric motor 41 to ON or OFF and switching of the brake mechanism 42 to ON or OFF according to the above-described output of the position information detection device 44.

FIG. 2A illustrates the contracted state of the telescopic boom 14. In this state, the distal end boom element 141 is coupled to the intermediate boom element 142 via the boom coupling pins 144*a*. Therefore, the distal end boom element 141 cannot be displaced with respect to the intermediate boom element 142 in the longitudinal direction (rightward and leftward direction in FIGS. 2A to 2E).

In addition, in FIG. 2A, the distal end portions of the cylinder coupling pins 454*a* and 454*b* engage with the pair of cylinder pin receiving portions 141*a* of the distal end boom element 141. Namely, the distal end boom element 141 and the cylinder member 32 are in the coupled state.

In the state illustrated in FIG. 2A, the state of each member is as follows (refer to T0 to T1 in FIG. 16).

Brake mechanism 42: OFF
Electric motor 41: OFF
Cylinder coupling mechanism 45: extended state
Boom coupling mechanism 46: extended state
Cylinder coupling pins 454*a* and 454*b*: insertion state
Boom coupling pins 144*a*: insertion state Subsequently, in the state illustrated in FIG. 2A, the electric motor 41 is rotated forward (rotated in a first direction that is a clockwise direction as seen from a distal end side of the output shaft), so that the pair of boom coupling pins 144*a* are displaced in a direction to disengage from the pair of first boom pin receiving portions 142*b* of the intermediate boom element 142 by the boom coupling mechanism 46 of the actuator 2. At the time, the boom coupling mechanism 46 makes a state transition from the extended state to the contracted state.

During a state transition from the state in FIG. 2A to the state in FIG. 2B, the state of each member is as follows (refer to T1 to T2 in FIG. 16).

Brake mechanism 42: OFF

Electric motor 41: ON

Cylinder coupling mechanism 45: extended state

Boom coupling mechanism 46: transition from extended state to contracted state Cylinder coupling pins 454*a* and 454*b*: insertion state Boom coupling pins 144*a*: transition from insertion state to removal state With the above-mentioned state transition, the engagement between the pair of boom coupling pins 144*a* and the pair of first boom pin receiving portions 142*b* of the intermediate boom element 142 is released (refer to FIG. 2B). Thereafter, the brake mechanism 42 is turned on and the electric motor 41 is turned off.

Incidentally, the timing the electric motor 41 is turned off and the timing the brake mechanism 42 is turned on are appropriately controlled by the control unit. For example, after the brake mechanism 42 is turned on, the electric motor 41 is turned off, but unillustrated.

In the state illustrated in FIG. 2B, the state of each member is as follows (refer to T2 in FIG. 16).

Brake mechanism 42: ON

Electric motor 41: OFF

Cylinder coupling mechanism 45: extended state

Boom coupling mechanism 46: contracted state

Cylinder coupling pins 454*a* and 454*b*: insertion state

Boom coupling pins 144*a*: removal state

Subsequently, in the state illustrated in FIG. 2B, pressure oil is supplied to an extension side hydraulic chamber in the telescoping cylinder 3 of the actuator 2. Hereupon, the cylinder member 32 is displaced in the extending direction (to the left side in FIGS. 2A to 2E).

With the above-described displacement of the cylinder member 32, the distal end boom element 141 is displaced in the extending direction (refer to FIG. 2C). At the time, as for the state of each member, the states at T2 in FIG. 16 are maintained until T3.

Subsequently, in the state illustrated in FIG. 2C, the brake mechanism 42 is released. Hereupon, the boom coupling mechanism 46 displaces the pair of boom coupling pins 144*a* in a direction where the pair of boom coupling pins 144*a* engage with the pair of second boom pin receiving portions 142*c* of the intermediate boom element 142 using the biasing force of the second biasing mechanism 463. At the time, the boom coupling mechanism 46 makes a state transition (namely, automatic return) from the contracted state to the extended state.

During a state transition from the state in FIG. 2C to the state in FIG. 2D, the state of each member is as follows (refer to T3 to T4 in FIG. 16).

Brake mechanism 42: OFF

Electric motor 41: OFF

Cylinder coupling mechanism 45: extended state

Boom coupling mechanism 46: transition from contracted state to extended state Cylinder coupling pins 454*a* and 454*b*: insertion state Boom coupling pins 144*a*: transition from removal state to insertion state Hereupon, as illustrated in FIG. 2D, the pair of boom coupling pins 144*a* engage with the pair of second boom pin receiving portions 142*c* of the intermediate boom element 142.

In the state illustrated in FIG. 2D, the state of each member is as follows (refer to T4 in FIG. 16).

Brake mechanism 42: OFF

Electric motor 41: ON

Cylinder coupling mechanism 45: extended state

Boom coupling mechanism 46: extended state

Cylinder coupling pins 454*a* and 454*b*: insertion state

Boom coupling pins 144*a*: insertion state

Furthermore, in the state illustrated in FIG. 2D, the electric motor 41 is rotated reversely (rotated in a second direction that is a counterclockwise direction as seen from the distal end side of the output shaft), so that the pair of cylinder coupling pins 454*a* and 454*b* are displaced in a direction to disengage from the pair of cylinder pin receiving portions 141*a* of the distal end boom element 141 by the cylinder coupling mechanism 45. At the time, the cylinder coupling mechanism 45 makes a state transition from the extended state to the contracted state.

During a state transition from the state in FIG. 2D to the state in FIG. 2E, the state of each member is as follows (refer to T4 to T5 in FIG. 16).

Brake mechanism 42: OFF

Electric motor 41: ON

Cylinder coupling mechanism 45: transition from extended state to contracted state Boom coupling mechanism 46: extended state Cylinder coupling pins 454*a* and 454*b*: transition from insertion state to removal state Boom coupling pins 144*a*: insertion state Hereupon, as illustrated in FIG. 2E, the engagement between the distal end portions of the pair of cylinder coupling pins 454*a* and 454*b* and the pair of cylinder pin receiving portions 141*a* of the distal end boom element 141 is released. Thereafter, the brake mechanism 42 is turned on and the electric motor 41 is turned off.

In the state illustrated in FIG. 2E, the state of each member is as follows (refer to T5 in FIG. 16).

Brake mechanism 42: ON

Electric motor 41: OFF

Cylinder coupling mechanism 45: contracted state

Boom coupling mechanism 46: extended state

Cylinder coupling pins 454*a* and 454*b*: removal state

Boom coupling pins 144*a*: insertion state

Thereafter, when pressure oil is supplied to a contraction side hydraulic chamber in the telescoping cylinder 3 of the actuator 2, the cylinder member 32 is displaced in the contracting direction (left side in FIGS. 2A to 2E), but unillustrated. At the time, since the distal end boom element 141 and the cylinder member 32 are in the non-coupled state, the cylinder member 32 alone is disposed in the contracting direction. When the intermediate boom element 142 is extended, the operations illustrated in FIGS. 2A to 2E are performed on the intermediate boom element 142.

[1.3 Regarding Effects of Present Embodiment]

In the movable crane 1 of the present embodiment having the above configuration, since the cylinder coupling mechanism 45 and the boom coupling mechanism 46 are electrically driven, it is not required that a hydraulic circuit with a structure in the related art is provided in the internal space of the telescopic boom 14. Therefore, it is possible to improve the degree of freedom in designing the internal space of the telescopic boom 14 by efficiently utilizing the space used by the hydraulic circuit.

In addition, in the case of the present embodiment, the detection of the position of the cylinder coupling pins 454*a* and 454*b* and the boom coupling pins 144*a* and 144*b* is performed by the position information detection device 44 described above. For this reason, in the present embodiment, proximity sensors for detecting the position of the cylinder coupling pins 454*a* and 454*b* and the boom coupling pins 144*a* and 144*b* are not required. For example, such a proximity sensor is provided in a position to be able to detect an insertion state and a removal state of each of the cylinder coupling pins 454*a* and 454*b* and the boom coupling pins 144*a* and 144*b*. In this case, at least the same number of the proximity sensors as the cylinder coupling pins 454*a* and 454*b* and the second rack bars 461*a* and 461*b* are required. Meanwhile, in the case of the present embodiment, the position of each of the cylinder coupling pins 454*a* and 454*b* and the boom coupling pins 144*a* and 144*b* can be detected by the position information detection device 44 (namely, one detector) including one detection unit 44*a* as described above.

2. Second Embodiment

A second embodiment according to the present invention will be described with reference to FIGS. 19A to 20. In the case of the present embodiment, the structure of a position information detection device 500A is different from that of the position information detection device 44 in the first embodiment described above. The structure of the other portion is the same as that in the first embodiment described above. Hereinafter, the structure of the position information detection device 500A will be described.

Figure 19A:
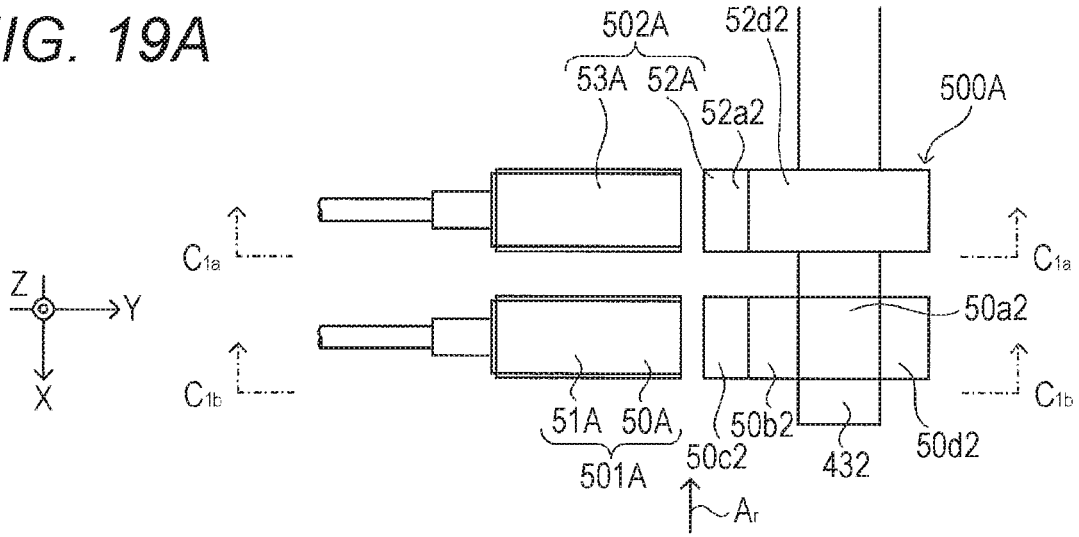
FIG. 19A is a view illustrating a position information detection device of the crane according to a second embodiment of the present invention.
Figure 19B:
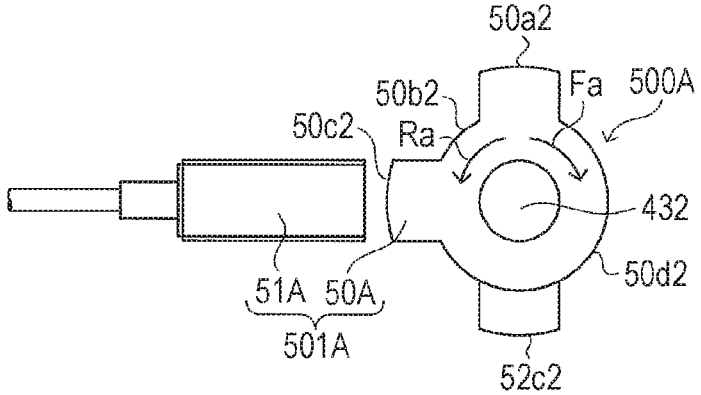
FIG. 19B is a view of the position information detection device illustrated in FIG. 19A as seen from the direction of arrow $A_r$.
Figure 19C:
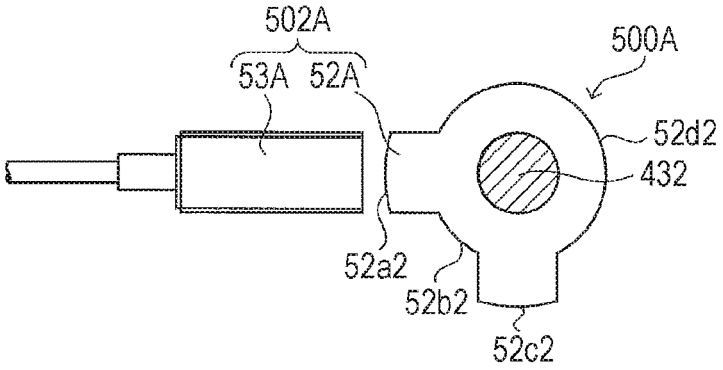
FIG. 19C is a cross-sectional view taken along line $C_{1a}$-$C_{1d}$ in FIG. 19A.
Figure 19D:
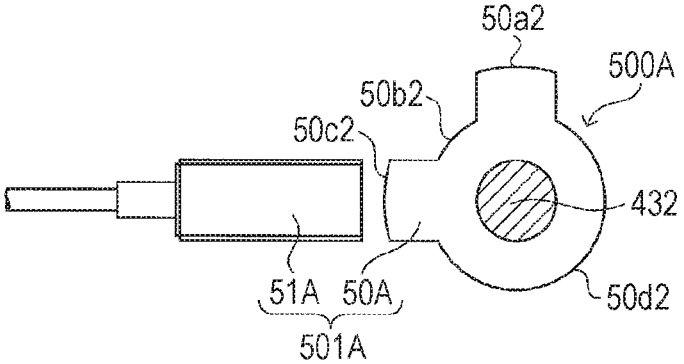
FIG. 19D is a cross-sectional view taken along line $C_{1b}$-$C_{1b}$, in FIG. 19A.

FIG. 19A illustrates the position information detection device 500A that is in a state of being provided in an end portion on the X-direction positive side of the transmission shaft 432. FIG. 19B is a view of the position information detection device 500A illustrated in FIG. 19A as seen from the direction of arrow $A_r$ in FIG. 19A. FIG. 19C is a cross-sectional view taken along line $C_{1a}$-$C_{1a}$ in FIG. 19A. FIG. 19D is a cross-sectional view taken along line $C_{1b}$-$C_{1b}$ in FIG. 19A. Incidentally, in FIG. 19D, a second detection device 502A to be described later is unillustrated.

Figure 20:
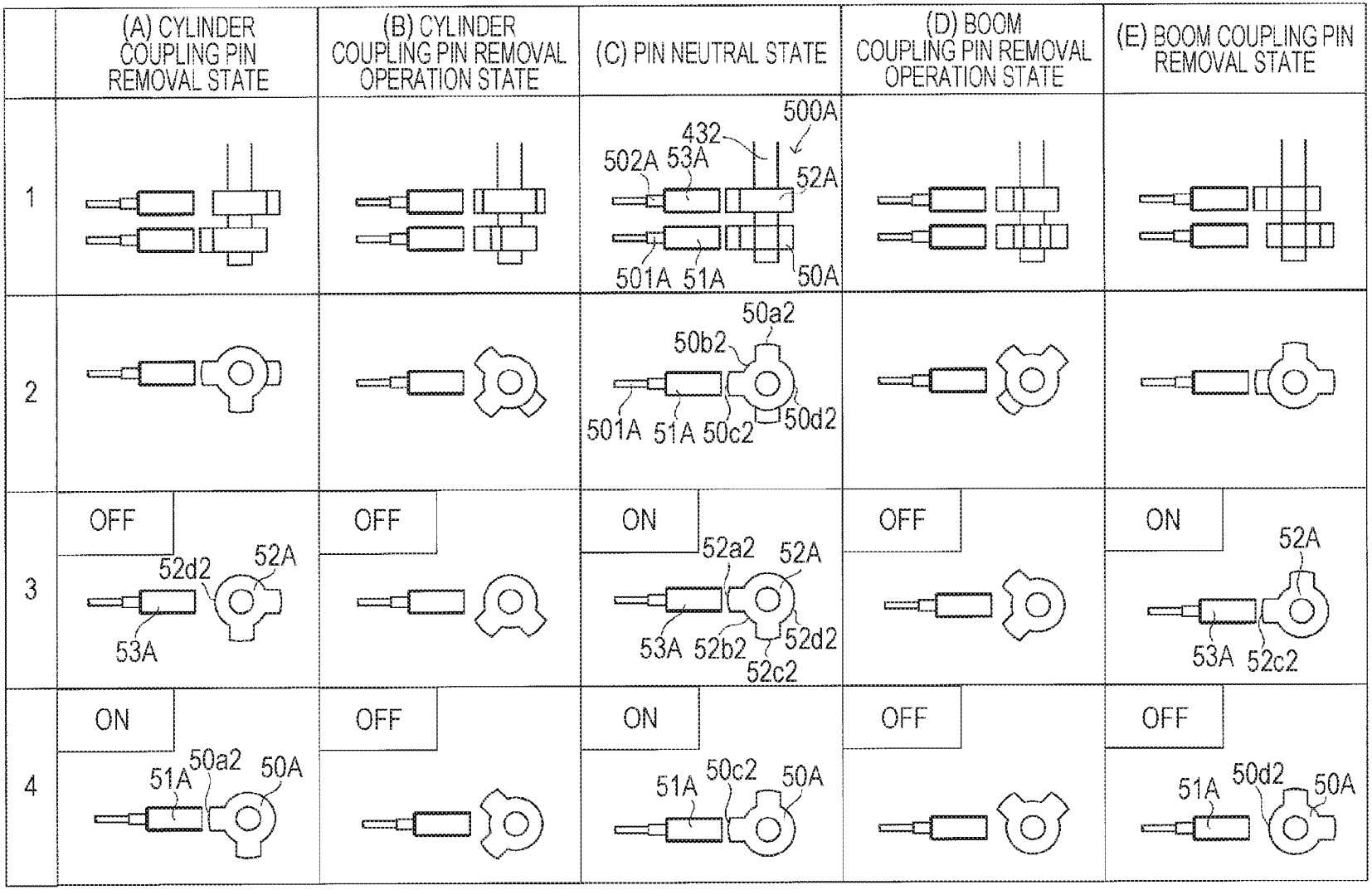
FIG. 20 is a view for describing an operation of the position information detection device of the crane according to the second embodiment.

In addition, FIG. 20 is a view for describing an operation of the position information detection device 500A of the crane according to the present embodiment. Hereinafter, in a description of FIG. 20, column numbers A to E and row numbers 1 to 4 are used when referring to views in FIG. 20. For example, A-1 refers to the view at column A and row 1 in FIG. 20.

Column C in FIG. 20 represents a neutral state of the position information detection device 500A. Specifically, C-1 in FIG. 20 corresponds to FIG. 19A. In addition, C-2 in FIG. 20 corresponds to FIG. 19B. C-3 in FIG. 20 corresponds to FIG. 19C. C-4 in FIG. 20 corresponds to FIG. 19D.

In the neutral state of the position information detection device 500A, the cylinder coupling pins 454*a* and 454*b* and the boom coupling pins 144*a* (refer to FIGS. 2A to 2E) are in an insertion state. In the following description, the boom coupling pins are the boom coupling pins 144*a* illustrated in FIGS. 2A to 2E. However, the boom coupling pins may be the boom coupling pins 144*b* illustrated in FIGS. 2A to 2E.

The position information detection device 500A includes a first detection device 501A and the second detection device 502A.

The first detection device 501A includes a first detected portion 50A and a first sensor unit 51A. The first detected portion 50A is fixed to the transmission shaft 432 in a state where the transmission shaft 432 is inserted through a central hole thereof. The first detected portion 50A rotates together with the transmission shaft 432.

The first detected portion 50A includes a first large-diameter portion 50*a*2 and a second large-diameter portion 50*c*2 from which the distance to the central axis of the first detected portion 50A is large (outer diameter is large), and a first small-diameter portion 50*b*2 and a second small-diameter portion 50*d*2 from which the distance to the central axis thereof is small (outer diameter is small), on an outer peripheral surface of the first detected portion 50A. In the case of the present embodiment, the first large-diameter portion 50*a*2 and the second large-diameter portion 50*c*2 are disposed around the central axis of the first detected portion 50A in positions that are deviated by 90 degrees from each other in the circumferential direction. Incidentally, the positional relationship between the first large-diameter portion 50*a*2 and the second large-diameter portion 50*c*2 is not limited to the relationship in the present embodiment. The positional relationship between the first large-diameter portion 50*a*2 and the second large-diameter portion 50*c*2 is appropriately determined according to the stroke amount of the boom coupling pin and the cylinder coupling pin during a state transition between the contracted state and the extended state.

The first small-diameter portion 50*b*2 is disposed in a portion having a small central angle around the central axis of the first detected portion 50A (having a short length in the circumferential direction) in a portion present between the first large-diameter portion 50*a*2 and the second large-diameter portion 50*c*2 in the outer peripheral surface of the first detected portion 50A. The second small-diameter portion 50*d*2 is disposed in a portion having a large central angle around the central axis of the first detected portion 50A (having a long length in the circumferential direction) in the portion present between the first large-diameter portion 50*a*2 and the second large-diameter portion 50*c*2 in the outer peripheral surface of the first detected portion 50A.

The first sensor unit 51A is a non-contact proximity sensor. The first sensor unit 51A is provided in a state where a distal end thereof faces the outer peripheral surface of the first detected portion 50A. The first sensor unit 51A outputs an electric signal according to the distance from the outer peripheral surface of the first detected portion 50A.

For example, the output of the first sensor unit 51A becomes ON in a state where the first sensor unit 51A faces the first large-diameter portion 50*a*2 or the second large-diameter portion 50*c*2. Meanwhile, the output of the first sensor unit 51A becomes OFF in a state where the first sensor unit 51A faces the first small-diameter portion 50*b*2 or the second small-diameter portion 50*d*2.

The second detection device 502A includes a second detected portion 52A and a second sensor unit 53A. The second detected portion 52A is fixed to the transmission shaft 432 to be closer to the X-direction negative side than the first detected portion 50A, in a state where the transmission shaft 432 is inserted through a central hole of the second detected portion 52A. The second detected portion 52A rotates together with the transmission shaft 432.

The second detected portion 52A includes a first large-diameter portion 52*a*2 and a second large-diameter portion 52*c*2 from which the distance to the central axis of the second detected portion 52A is large (outer diameter is large), and a first small-diameter portion 52*b*2 and a second small-diameter portion 52*d*2 from which the distance to the central axis thereof is small (outer diameter is small), on an outer peripheral surface of the second detected portion 52A. Such a configuration of the second detected portion 52A is the same as that of the first detected portion 50A described above.

The second sensor unit 53A is a non-contact proximity sensor. The second sensor unit 53A is provided in a state where a distal end thereof faces the outer peripheral surface of the second detected portion 52A. The second sensor unit 53A as described above outputs an electric signal according to the distance from the outer peripheral surface of the second detected portion 52A.

For example, the output of the second sensor unit 53A becomes ON in a state where the second sensor unit 53A faces the first large-diameter portion 52*a*2 or the second large-diameter portion 52*c*2. Meanwhile, the output of the second sensor unit 53A becomes OFF in a state where the second sensor unit 53A faces the first small-diameter portion 52*b*2 or the second small-diameter portion 52*d*2.

In the case of the present embodiment, in the neutral state of the position information detection device 500A, the first detected portion 50A and the second detected portion 52A are deviated by 90 degrees in phase from each other. Specifically, in the neutral state of the position information detection device 500A, the first sensor unit 51A faces the second large-diameter portion 50*c*2 of the first detected portion 50A. Meanwhile, in the neutral state of the position information detection device 500A, the second sensor unit 53A faces the first large-diameter portion 52*a*2 of the second detected portion 52A. Incidentally, the positional (phase) relationship between the first detected portion 50A and the second detected portion 52A is not limited to the relationship in the present embodiment. The positional relationship between the first detected portion 50A and the second detected portion 52A is appropriately determined according to the stroke amount of the boom coupling pin and the cylinder coupling pin during a state transition between the contracted state and the extended state.

The position information detection device 500A as described above detects information relating the position of the cylinder coupling pins 454*a* and 454*b* and the boom coupling pins 144*a* based on a combination of the output of the first sensor unit 51A and the output of the second sensor unit 53A. Hereinafter, this point will be described with reference to FIG. 20.

Column A in FIG. 20 represents a state of the position information detection device 500A, the state corresponding to a removal state of the cylinder coupling pins 454*a* and 454*b* (state illustrated in FIG. 2E and hereinafter, referred to as a "cylinder coupling pin removal state"). Column B in FIG. 20 represents a state of the position information detection device 500A, the state corresponding to a removal operation state of the cylinder coupling pins 454*a* and 454*b* (hereinafter, referred to as a "cylinder coupling pin removal operation state"). Column C in FIG. 20 represents a state (neutral state) of the position information detection device 500A, the state corresponding to an insertion state of the boom coupling pins 144*a* and an insertion state of the cylinder coupling pins 454*a* and 454*b* (state illustrated in FIG. 2A and hereinafter, referred to as a "pin neutral state").

Column D in FIG. 20 represents a state of the position information detection device 500A, the state corresponding to a removal operation state of the boom coupling pins 144*a* (hereinafter, referred to as a "boom coupling pin removal operation state"). In addition, column E in FIG. 20 represents a state of the position information detection device 500A, the state corresponding to a removal state of the boom coupling pins 144*a* (state illustrated in FIGS. 2B and 2C and hereinafter, referred to as a "boom coupling pin removal state").

Incidentally, when the boom coupling pins 144*a* are in a removal state, the cylinder coupling pins 454*a* and 454*b* are in an insertion state. In addition, when the boom coupling pins 144*a* are in an insertion state, the cylinder coupling pins 454*a* and 454*b* are in a removal state.

In the case of the present embodiment, the position information detection device 500A detects which one of the pin neutral state, the boom coupling pin removal state, and the cylinder coupling pin removal state corresponds to the states of the boom coupling pins 144*a* and the cylinder coupling pins 454*a* and 454*b*.

Incidentally, the position information detection device 500A cannot distinguish between the boom coupling pin removal operation state and the cylinder coupling pin removal operation state. The reason is that a combination of the output of the first sensor unit 51A and the output of the second sensor unit 53A is the same between in the boom coupling pin removal operation state and in the cylinder coupling pin removal operation state (refer to column B and column D in FIG. 20). However, since means that detects the rotational direction of the transmission shaft 432 is provided, the position information detection device 500A can detect the boom coupling pin removal operation state and the cylinder coupling pin removal operation state.

When the electric motor 41 (refer to FIG. 7) rotates forward (rotation in the clockwise direction as seen from the distal end side of the output shaft and rotation in the direction of arrow Fa in FIG. 19B) from the state of the position information detection device 500A, the state corresponding to the pin neutral state (state illustrated in column C in FIG. 20), the position information detection device 500A enters the state corresponding to the boom coupling pin removal operation state (state illustrated in column D in FIG. 20) and then the state corresponding to the boom coupling pin removal state (state illustrated in column E in FIG. 20).

In the state corresponding to the boom coupling pin removal state, the first sensor unit 51A faces the second small-diameter portion 50*d*2 of the first detected portion 50A. The output of the first sensor unit 51A in this state is OFF (refer to E-4 in FIG. 20).

In addition, in the state corresponding to the boom coupling pin removal state, the second sensor unit 53A faces the second large-diameter portion 52*c*2 of the second detected portion 52A. The output of the second sensor unit 53A in this state is ON (refer to E-3 in FIG. 20).

The position information detection device 500A detects that the boom coupling pins 144*a* and the cylinder coupling pins 454*a* and 454*b* are in the boom coupling pin removal state, based on a combination of the output (OFF) of the first sensor unit 51A and the output (ON) of the second sensor unit 53A as described above. Then, the control unit (unillustrated) stops the operation of the electric motor 41 based on the detection result of the position information detection device 500A.

Meanwhile, when the electric motor 41 (refer to FIG. 7) rotates reversely (rotation in the counterclockwise direction as seen from the distal end side of the output shaft and rotation in the direction of arrow Ra in FIG. 19B) from the state of the position information detection device 500A, the state corresponding to the pin neutral state (state illustrated in column C in FIG. 20), the position information detection device 500A enters the state corresponding to the cylinder coupling pin removal operation state (state illustrated in column B in FIG. 20) and then the state corresponding to the cylinder coupling pin removal state (state illustrated in column A in FIG. 20).

In the state corresponding to the cylinder coupling pin removal state, the first sensor unit 51A faces the first large-diameter portion 50*a*2 of the first detected portion 50A. The output of the first sensor unit 51A in this state is ON (refer to A-4 in FIG. 20).

In addition, in the state corresponding to the cylinder coupling pin removal state, the second sensor unit 53A faces the second small-diameter portion 52*d*2 of the second detected portion 52A. The output of the second sensor unit 53A in this state is OFF (refer to A-3 in FIG. 20).

The position information detection device 500A detects that the boom coupling pins 144*a* and the cylinder coupling pins 454*a* and 454*b* are in the cylinder coupling pin removal state, based on a combination of the output (ON) of the first sensor unit 51A and the output (OFF) of the second sensor unit 53A as described above. Then, the control unit (unillustrated) stops the operation of the electric motor 41 based on the detection result of the position information detection device 500A.

Incidentally, when the electric motor 41 rotates reversely from the state corresponding to the boom coupling pin removal state, the position information detection device 500A enters the state corresponding to the pin neutral state.

Meanwhile, when the electric motor 41 rotates forward from the state corresponding to the cylinder coupling pin removal state, the position information detection device 500A enters the state corresponding to the pin neutral state.

Specifically, in the pin neutral state of the position information detection device 500A, the first sensor unit 51A faces the second large-diameter portion 50*c*2 of the first detected portion 50A. The output of the first sensor unit 51A in this state is ON (refer to C-4 in FIG. 20).

In addition, in the pin neutral state, the second sensor unit 53A faces the first large-diameter portion 52*a*2 of the second detected portion 52A. The output of the second sensor unit 53A in this state is ON (refer to C-3 in FIG. 20).

The position information detection device 500A detects that the boom coupling pins 144*a* and the cylinder coupling pins 454*a* and 454*b* are in the pin neutral state, based on a combination of the output (ON) of the first sensor unit 51A and the output (ON) of the second sensor unit 53A as described above. Then, the control unit (unillustrated) stops the operation of the electric motor 41 based on the detection result of the position information detection device 500A.

3. Third Embodiment

A third embodiment according to the present invention will be described with reference to FIGS. 21A to 22. In the case of the present embodiment, the structure of a position information detection device 500B is different from that of the position information detection device 500A in the second embodiment described above. The structure of the other portion is the same as that in the second embodiment. Hereinafter, the structure of the position information detection device 500B will be described.

Figure 21A:
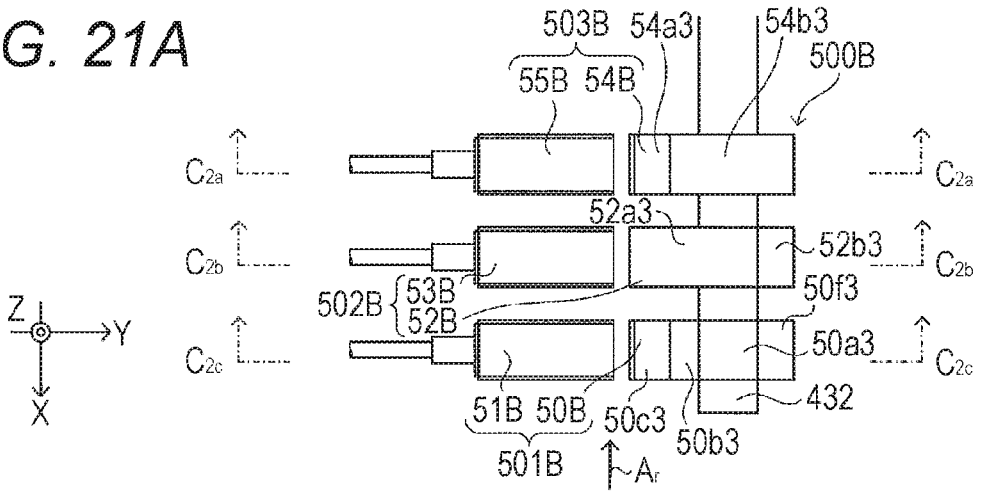
FIG. 21A is a view illustrating a position information detection device of the crane according to a third embodiment of the present invention.
Figure 21B:
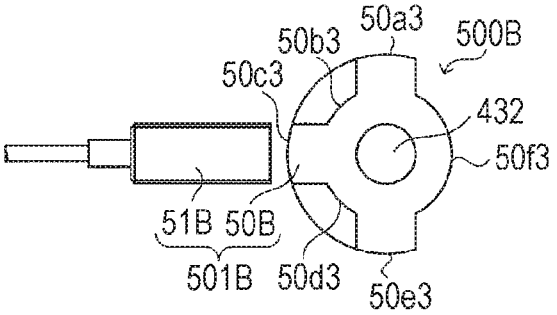
FIG. 21B is a view of the position information detection device illustrated in FIG. 21A as seen from the direction of arrow $A_r$.
Figure 21C:
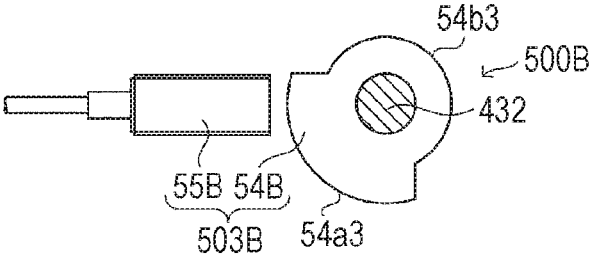
FIG. 21C is a cross-sectional view taken along line $C_{2a}$-$C_{2a}$ in FIG. 21A.
Figure 21D:
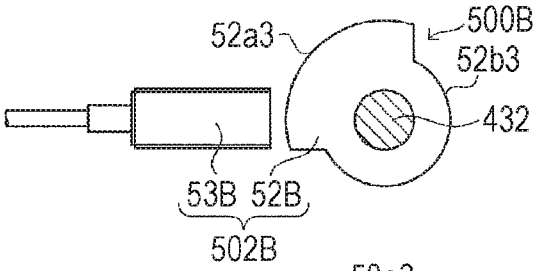
FIG. 21D is a cross-sectional view taken along line $C_{2b}$-$C_{2b}$ in FIG. 21A.
Figure 21E:
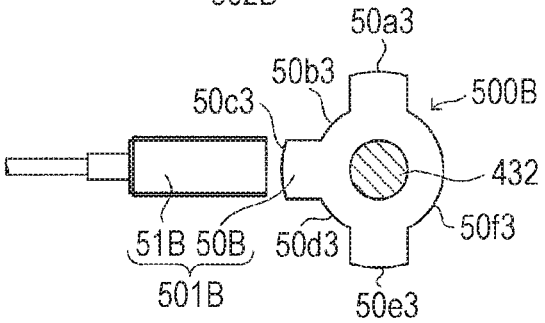
FIG. 21E is a cross-sectional view taken along line $C_{2c}$-$C_{2c}$ in FIG. 21A.

FIG. 21A illustrates the position information detection device 500B that is in a state of being provided in an end portion on the X-direction positive side of the transmission shaft 432. FIG. 21B is a view of the position information detection device 500B illustrated in FIG. 21A as seen from the direction of arrow $A_r$ in FIG. 21A. FIG. 21C is a cross-sectional view taken along line $C_{2a}$-$C_{2a}$ in FIG. 21A. FIG. 21D is a cross-sectional view taken along line $C_{2b}$-$C_{2b}$ in FIG. 21A. FIG. 21E is a cross-sectional view taken along line $C_{2c}$-$C_{2c}$ in FIG. 21A. Incidentally, in FIG. 21D, a third detection device 503B to be described later is unillustrated. In addition, in FIG. 21E, a second detection device 502B to be described later and the third detection device 503B are unillustrated.

Figure 22:
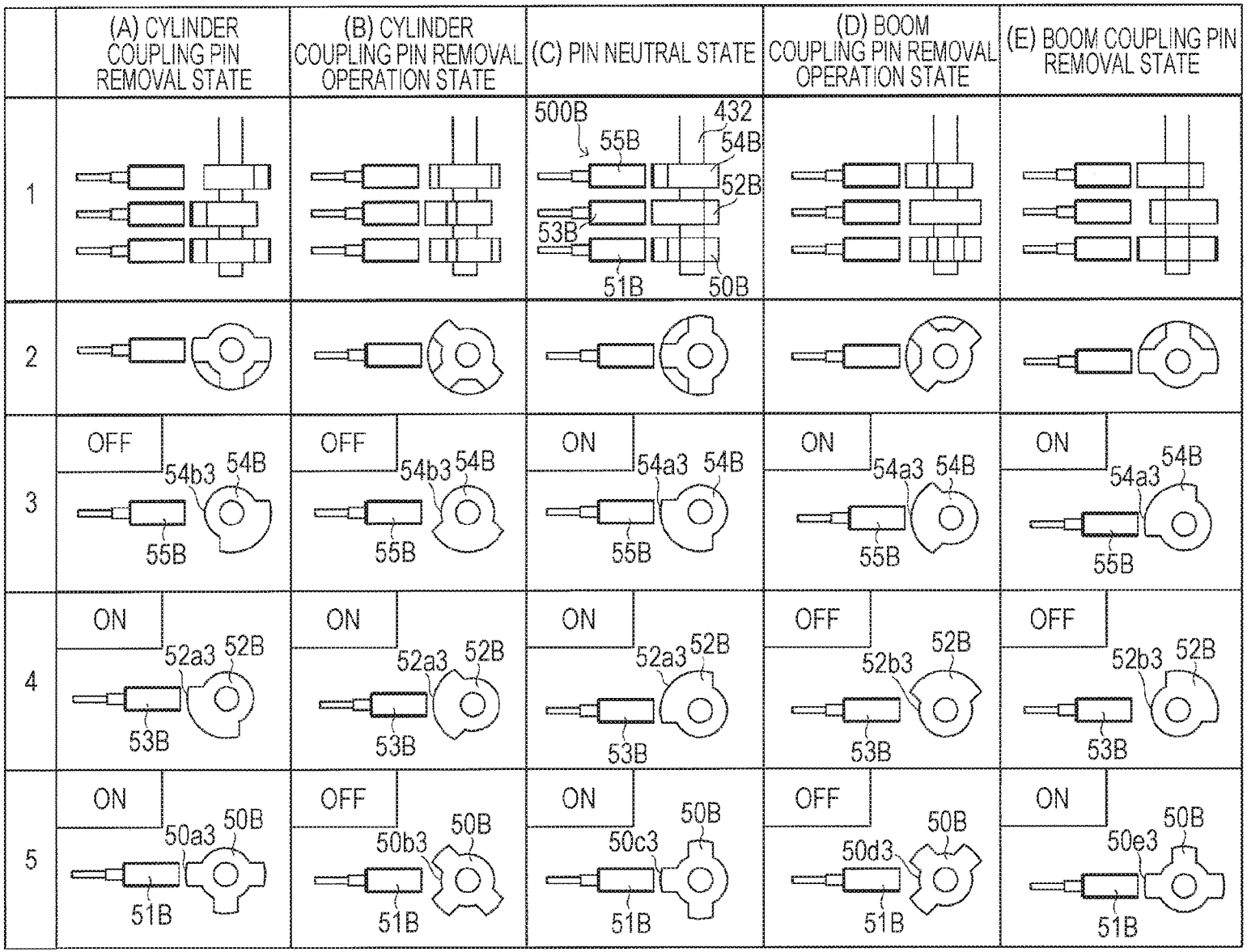
FIG. 22 is a view for describing an operation of the position information detection device of the crane according to the third embodiment.

In addition, FIG. 22 is a view for describing an operation of the position information detection device 500B of the crane according to the present embodiment. FIG. 22 is a view corresponding to FIG. 20 referred to in the above description of the first embodiment.

The position information detection device 500B includes a first detection device 501B, the second detection device 502B, and the third detection device 503B.

The first detection device 501B includes a first detected portion 50B and a first sensor unit 51B. The first detected portion 50B is fixed to the transmission shaft 432 in a state where the transmission shaft 432 is inserted through a central hole thereof. The first detected portion 50B rotates together with the transmission shaft 432.

The first detected portion 50B includes a first large-diameter portion 50*a*3, a second large-diameter portion 50*c*3, and a third large-diameter portion 50*e*3 from which the distance to the central axis of the first detected portion 50B is large (outer diameter is large), and a first small-diameter portion 50*b*3, a second small-diameter portion 50*d*3, and a third small-diameter portion 50*f*3 from which the distance to the central axis thereof is small (outer diameter is small), on an outer peripheral surface of the first detected portion 50B.

In the case of the present embodiment, the first large-diameter portion 50*a*3, the second large-diameter portion 50*c*3, and the third large-diameter portion 50*e*3 are disposed at an interval of 90 degrees in the outer peripheral surface of the first detected portion 50B The first large-diameter portion 50*a*3 and the third large-diameter portion 50*e*3 are disposed around the central axis of the first detected portion 50B to be deviated by 180° from each other. Incidentally, the positional relationship between the first large-diameter portion 50*a*3, the second large-diameter portion 50*c*3, and the third large-diameter portion 50*e*3 is not limited to the relationship in the present embodiment. The positional relationship between the first large-diameter portion 50*a*3, the second large-diameter portion 50*c*3, and the third large-diameter portion 50*e*3 is appropriately determined according to the stroke amount of the boom coupling pin and the cylinder coupling pin during a state transition between the contracted state and the extended state.

The first small-diameter portion 50*b*3 is disposed between the first large-diameter portion 50*a*3 and the second large-diameter portion 50*c*3 in the outer peripheral surface of the first detected portion 50B. The second small-diameter portion 50*d*3 is disposed between the second large-diameter portion 50*c*3 and the third large-diameter portion 50*e*3 in the outer peripheral surface of the first detected portion 50B. The third small-diameter portion 50*f*3 is disposed between the first large-diameter portion 50*a*3 and the third large-diameter portion 50*e*3 in the outer peripheral surface of the first detected portion 50B.

The first sensor unit 51B is a non-contact proximity sensor. The first sensor unit 51B is provided in a state where a distal end thereof faces the outer peripheral surface of the first detected portion 50B. The first sensor unit 51B outputs an electric signal according to the distance from the outer peripheral surface of the first detected portion 50B.

For example, the output of the first sensor unit 51B becomes ON in a state where the first sensor unit 51B faces the first large-diameter portion 50*a*3, the second large-diameter portion 50*c*3, or the third large-diameter portion 50*e*3. Meanwhile, the output of the first sensor unit 51B becomes OFF in a state where the first sensor unit 51B faces the first small-diameter portion 50*b*3, the second small-diameter portion 50*d*3, or the third small-diameter portion 50*f*3.

The second detection device 502B includes a second detected portion 52B and a second sensor unit 53B. The second detected portion 52B is fixed to the transmission shaft 432 to be closer to the X-direction negative side than the first detected portion 50B, in a state where the transmission shaft 432 is inserted through a central hole of the second detected portion 52B. The second detected portion 52B rotates together with the transmission shaft 432.

The second detected portion 52B includes a first large-diameter portion 52*a*3 from which the distance to the central axis of the second detected portion 52B is large (outer diameter is large), and a first small-diameter portion 52*b*3 from which the distance to the central axis thereof is small (outer diameter is small), on an outer peripheral surface of the second detected portion 52B. In the case of the present embodiment, the first large-diameter portion 52*a*3 is disposed in a central angle range of 120° around the central axis of the second detected portion 52B in the outer peripheral surface of the second detected portion 52B. The first small-diameter portion 52*b*3 is disposed in a portion other than the first large-diameter portion 52*a*3 in the outer peripheral surface of the second detected portion 52B. Incidentally, the positional relationship between the first large-diameter portion 52*a*3 and the first small-diameter portion 52*b*3 is not limited to the relationship in the present embodiment. The positional relationship between the first large-diameter portion 52*a*3 and the first small-diameter portion 52*b*3 is appropriately determined according to the stroke amount of the boom coupling pin and the cylinder coupling pin during a state transition between the contracted state and the extended state.

The second sensor unit 53B is a non-contact proximity sensor. The second sensor unit 53B is provided in a state where a distal end thereof faces the outer peripheral surface of the second detected portion 52B. The second sensor unit 53B outputs an electric signal according to the distance from the outer peripheral surface of the second detected portion 52B.

For example, the output of the second sensor unit 53B becomes ON in a state where the second sensor unit 53B faces the first large-diameter portion 52*a*3. Meanwhile, the output of the second sensor unit 53B becomes OFF in a state where the second sensor unit 53B faces the first small-diameter portion 52*b*3.

The third detection device 503B includes a third detected portion 54B and a third sensor unit 55B. The third detected portion 54B is fixed to the transmission shaft 432 to be closer to the X-direction negative side than the second detected portion 52B, in a state where the transmission shaft 432 is inserted through a central hole of the third detected portion 54B. The third detected portion 54B rotates together with the transmission shaft 432.

The third detected portion 54B includes a first large-diameter portion 54*a*3 from which the distance to the central axis of the third detected portion 54B is large (outer diameter is large), and a first small-diameter portion 54*b*3 from which the distance to the central axis thereof is small (outer diameter is small), on an outer peripheral surface of the third detected portion 54B. In the case of the present embodiment, the first large-diameter portion 54*a*3 is disposed in a central angle range of approximately 120° around the central axis of the third detected portion 54B in the outer peripheral surface of the third detected portion 54B. The first small-diameter portion 54*b*3 is disposed in a portion other than the first large-diameter portion 54*a*3 in the outer peripheral surface of the third detected portion 54B. Incidentally, the positional relationship between the first large-diameter portion 54*a*3 and the first small-diameter portion 54*b*3 is not limited to the relationship in the present embodiment. The positional relationship between the first large-diameter portion 54*a*3 and the first small-diameter portion 54*b*3 is appropriately determined according to the stroke amount of the boom coupling pin and the cylinder coupling pin during a state transition between the contracted state and the extended state.

The third sensor unit 55B is a non-contact proximity sensor. The third sensor unit 55B is provided in a state where a distal end thereof faces the outer peripheral surface of the third detected portion 54B. The third sensor unit 55B outputs an electric signal according to the distance from the outer peripheral surface of the third detected portion 54B.

For example, the output of the third sensor unit 55B becomes ON in a state where the third sensor unit 55B faces the first large-diameter portion 54*a*3. Meanwhile, the output of the third sensor unit 55B becomes OFF in a state where the third sensor unit 55B faces the first small-diameter portion 54*b*3.

In the case of the present embodiment, in the neutral state of the position information detection device 500B, the first sensor unit 51B faces the second large-diameter portion 50*c*3 of the first detected portion 50B. In addition, in the neutral state of the position information detection device 500B, the second sensor unit 53B faces the first large-diameter portion 52*a*3 of the second detected portion 52B. Furthermore, in the neutral state of the position information detection device 500B, the third sensor unit 55B faces the first large-diameter portion 54*a*3 of the third detected portion 54B.

The position information detection device 500B as described above detects information relating the position of the cylinder coupling pins 454*a* and 454*b* and the boom coupling pins 144*a* based on a combination of the output of the first sensor unit 51B, the output of the second sensor unit 53B, and the output of the third sensor unit 55B. Hereinafter, this point will be described with reference to FIG. 22.

In the case of the present embodiment, the position information detection device 500B detects which one of the pin neutral state, the boom coupling pin removal operation state (also boom coupling pin insertion operation state), the boom coupling pin removal state, the cylinder coupling pin removal operation state (also cylinder coupling pin insertion operation state), and the cylinder coupling pin removal state corresponds to the states of the boom coupling pins 144*a* and the cylinder coupling pins 454*a* and 454*b*. Namely, the position information detection device 500B according to the present embodiment can detect the boom coupling pin removal operation state and the cylinder coupling pin removal operation state that cannot be detected by the above-described structure in the second embodiment.

When the electric motor 41 (refer to FIG. 7) rotates forward from a state of the position information detection device 500B, the state corresponding to the pin neutral state (state illustrated in column C in FIG. 22), the position information detection device 500B enters a state corresponding to the boom coupling pin removal operation state (state illustrated in column D in FIG. 22).

In the state corresponding to the boom coupling pin removal operation state, the first sensor unit 51B faces the second small-diameter portion 50*d*3 of the first detected portion 50B. The output of the first sensor unit 51B in this state is OFF (refer to D-5 in FIG. 22).

In addition, in the state corresponding to the boom coupling pin removal operation state, the second sensor unit 53B faces the first small-diameter portion 52*b*3 of the second detected portion 52B. The output of the second sensor unit 53B in this state is OFF (refer to D-4 in FIG. 22).

In addition, in the state corresponding to the boom coupling pin removal operation state, the third sensor unit 55B faces the first large-diameter portion 54*a*3 of the third detected portion 54B. The output of the third sensor unit 55B in this state is ON (refer to D-3 in FIG. 22).

The position information detection device 500B detects that the boom coupling pins 144*a* and the cylinder coupling pins 454*a* and 454*b* are in the boom coupling pin removal operation state, based on a combination of the output (OFF) of the first sensor unit 51B, the output (OFF) of the second sensor unit 53B, and the output (ON) of the third sensor unit 55B as described above. Then, the control unit (unillustrated) causes the electric motor 41 to continue to operate, based on the detection result of the position information detection device 500B.

When the electric motor 41 rotates further forward from the state of the position information detection device 500B, the state corresponding to the boom coupling pin removal operation state (state illustrated in column D in FIG. 22), the position information detection device 500B enters a state corresponding to the boom coupling pin removal state (state illustrated in column E in FIG. 22).

In the state corresponding to the boom coupling pin removal state, the first sensor unit 51B faces the third large-diameter portion 50*e*3 of the first detected portion 50B. The output of the first sensor unit 51B in this state is ON (refer to E-5 in FIG. 22).

In addition, in the state corresponding to the boom coupling pin removal state, the second sensor unit 53B faces the first small-diameter portion 52*b*3 of the second detected portion 52B. The output of the second sensor unit 53B in this state is OFF (refer to E-4 in FIG. 22).

In addition, in the state corresponding to the boom coupling pin removal state, the third sensor unit 55B faces the first large-diameter portion 54*a*3 of the third detected portion 54B. The output of the third sensor unit 55B in this state is ON (refer to E-3 in FIG. 22).

The position information detection device 500B detects that the boom coupling pins 144*a* and the cylinder coupling pins 454*a* and 454*b* are in the boom coupling pin removal state, based on a combination of the output (ON) of the first sensor unit 51B, the output (OFF) of the second sensor unit 53B, and the output (ON) of the third sensor unit 55B as described above. Then, the control unit (unillustrated) stops the operation of the electric motor 41 based on the detection result of the position information detection device 500B.

When the electric motor 41 (refer to FIG. 7) rotates reversely from the state of the position information detection device 500B, the state corresponding to the pin neutral state (state illustrated in column C in FIG. 22), the position information detection device 500B enters a state corresponding to the cylinder coupling pin removal operation state (state illustrated in column B in FIG. 22).

In the state corresponding to the cylinder coupling pin removal operation state, the first sensor unit 51B faces the first small-diameter portion 50*b*3 of the first detected portion 50B. The output of the first detection device 501B in this state is OFF (refer to B-5 in FIG. 22).

In addition, in the state corresponding to the cylinder coupling pin removal operation state, the second sensor unit 53B faces the first large-diameter portion 52*a*3 of the second detected portion 52B. The output of the second sensor unit 53B in this state is ON (refer to B-4 in FIG. 22).

In addition, in the state corresponding to the cylinder coupling pin removal operation state, the third sensor unit 55B faces the first small-diameter portion 54*b*3 of the third detected portion 54B. The output of the third sensor unit 55B in this state is OFF (refer to B-3 in FIG. 22).

The position information detection device 500B detects that the boom coupling pins 144*a* and the cylinder coupling pins 454*a* and 454*b* are in the cylinder coupling pin removal operation state, based on a combination of the output (OFF) of the first sensor unit 51B, the output (ON) of the second sensor unit 53B, and the output (OFF) of the third sensor unit 55B as described above. Then, the control unit (unillustrated) causes the electric motor 41 to continue to operate, based on the detection result of the position information detection device 500B.

When the electric motor 41 rotates further reversely from the state of the position information detection device 500B, the state corresponding to the cylinder coupling pin removal operation state (state illustrated in column B in FIG. 22), the position information detection device 500B enters a state corresponding to the cylinder coupling pin removal state (state illustrated in column A in FIG. 22).

In the state corresponding to the cylinder coupling pin removal state, the first sensor unit 51B faces the first large-diameter portion 50*a*3 of the first detected portion 50B. The output of the first sensor unit 51B in this state is ON (refer to A-5 in FIG. 22).

In addition, in the state corresponding to the cylinder coupling pin removal state, the second sensor unit 53B faces the first large-diameter portion 52*a*3 of the second detected portion 52B. The output of the second sensor unit 53B in this state is ON (refer to A-4 in FIG. 22).

In addition, in the state corresponding to the cylinder coupling pin removal state, the third sensor unit 55B faces the first small-diameter portion 54*b*3 of the third detected portion 54B. The output of the third sensor unit 55B in this state is OFF (refer to A-3 in FIG. 22).

The position information detection device 500B detects that the boom coupling pins 144*a* and the cylinder coupling pins 454*a* and 454*b* are in the cylinder coupling pin removal state, based on a combination of the output (ON) of the first sensor unit 51B, the output (ON) of the second sensor unit 53B, and the output (OFF) of the third sensor unit 55B as described above. Then, the control unit (unillustrated) stops the operation of the electric motor 41 based on the detection result of the position information detection device 500B. Other configurations and effects are the same as those in the second embodiment described above.

4. Fourth Embodiment

Figure 23A:
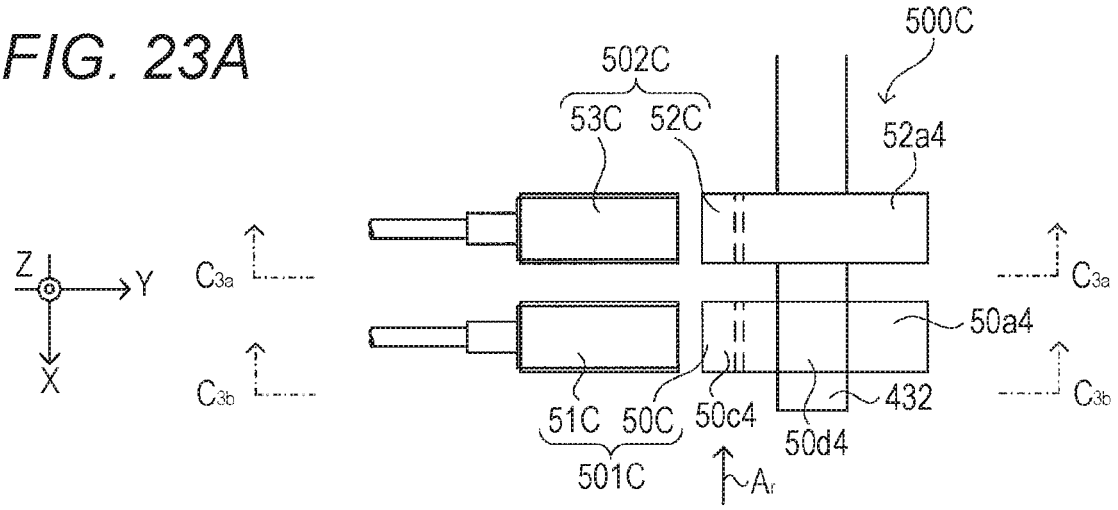
FIG. 23A is a view illustrating a position information detection device of the crane according to a fourth embodiment of the present invention.
Figure 23B:
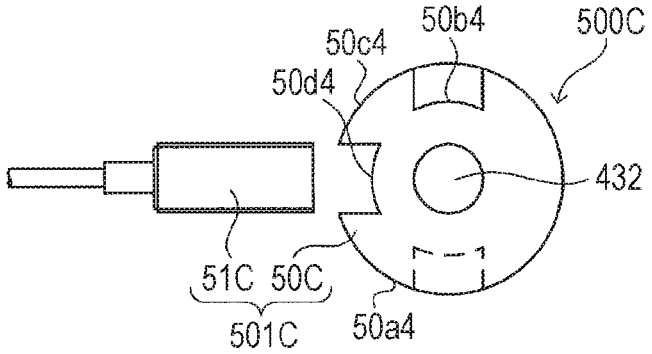
FIG. 23B is a view of the position information detection device illustrated in FIG. 23A as seen from the direction of arrow $A_r$.
Figure 23C:
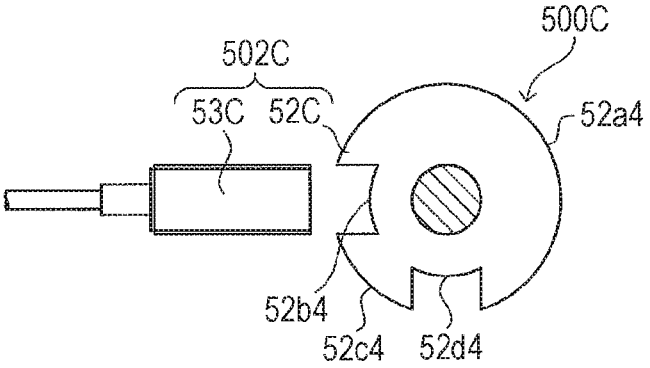
FIG. 23C is a cross-sectional view taken along line $C_{3a}$-$C_{3a}$ in FIG. 23A.
Figure 23D:
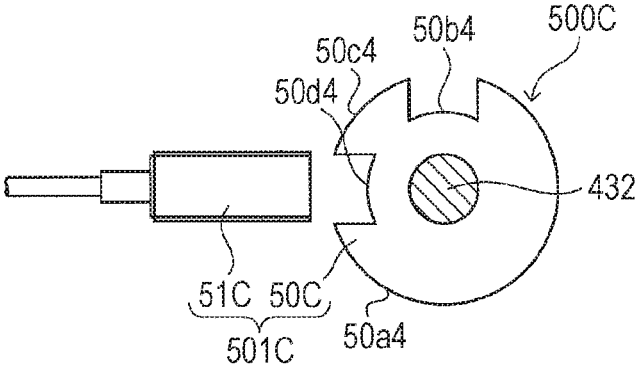
FIG. 23D is a cross-sectional view taken along line $C_{3b}$-$C_{3b}$ in FIG. 23A.
Figure 24:
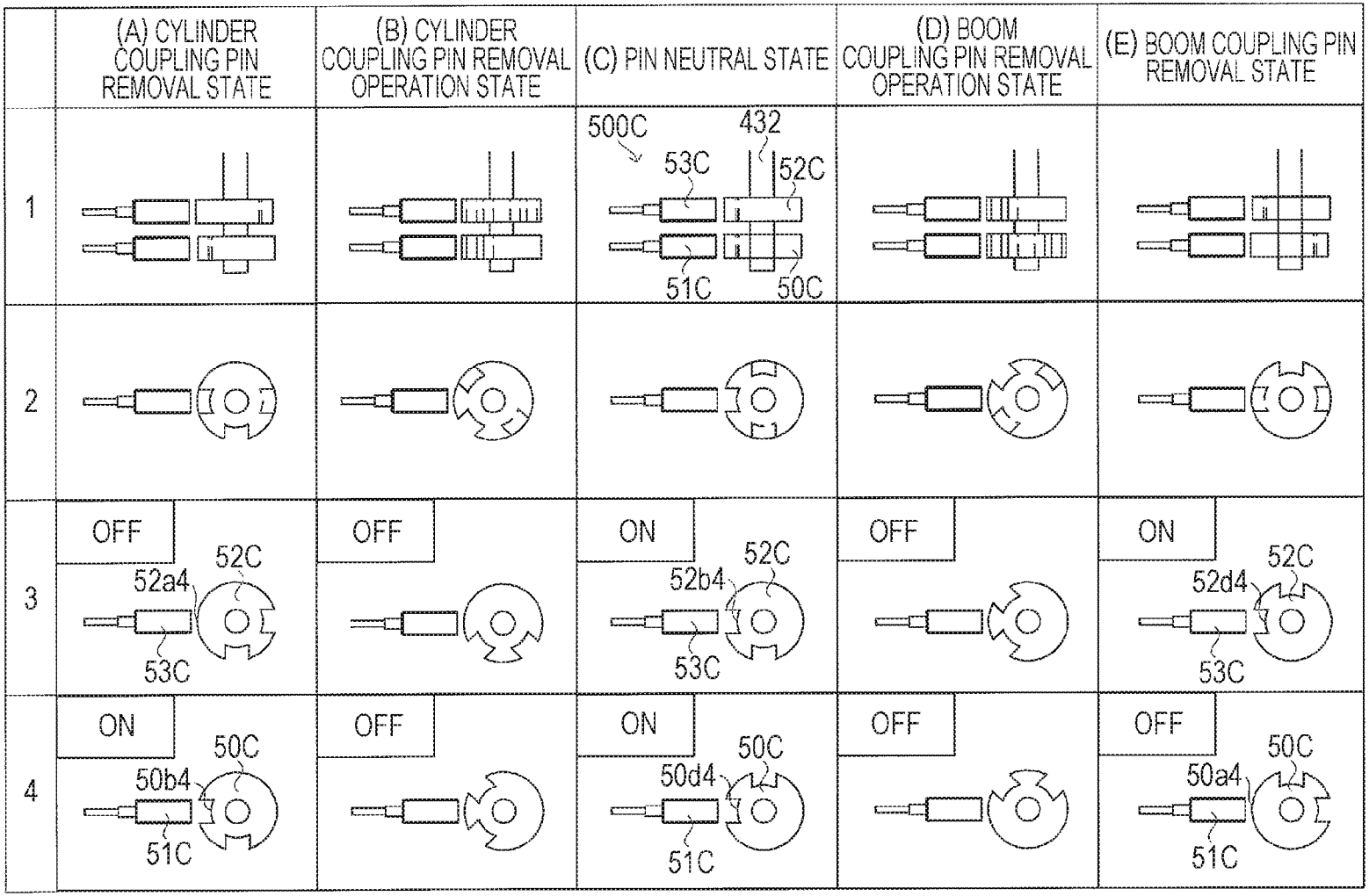
FIG. 24 is a view for describing an operation of the position information detection device of the crane according to the fourth embodiment.

A fourth embodiment according to the present invention will be described with reference to FIGS. 23A to 24. In the case of the present embodiment, the structure of a position information detection device 500C is different from that of the position information detection device 500A in the second embodiment described above. The structure of the other portion is the same as that in the second embodiment. Hereinafter, the structure of the position information detection device 500C will be described. Incidentally, FIGS. 23A to 23D are views corresponding to FIGS. 19A to 19D referred to in the above description of the second embodiment. In addition, FIG. 24 is a view corresponding to FIG. 20 referred to in the above description of the second embodiment.

The position information detection device 500C includes a first detection device 501C and a second detection device 502C.

The first detection device 501C includes a first detected portion 50C and a first sensor unit 51C. The first detected portion 50C is fixed to the transmission shaft 432 in a state where the transmission shaft 432 is inserted through a central hole thereof. The first detected portion 50C rotates together with the transmission shaft 432.

The first detected portion 50C includes a first large-diameter portion 50*a*4 and a second large-diameter portion 50*c*4 from which the distance to the central axis of the first detected portion 50C is large (outer diameter is large), and a first small-diameter portion 50*b*4 and a second small-diameter portion 50*d*4 from which the distance to the central axis thereof is small (outer diameter is small), on an outer peripheral surface of the first detected portion 50C.

The first large-diameter portion 50*a*4 is disposed in a central angle range of approximately 240° around the central axis of the first detected portion 50C in the outer peripheral surface of the first detected portion 50C. The second large-diameter portion 50*c*4 is disposed in a portion other than the first large-diameter portion 50*a*4 in the outer peripheral surface of the first detected portion 50C. Incidentally, the positional relationship between the first large-diameter portion 50*a*4 and the second large-diameter portion 50*c*4 is not limited to the relationship in the present embodiment. The positional relationship between the first large-diameter portion 50*a*4 and the second large-diameter portion 50*c*4 is appropriately determined according to the stroke amount of the boom coupling pin and the cylinder coupling pin during a state transition between the contracted state and the extended state.

The first small-diameter portion 50*b*4 and the second small-diameter portion 50*d*4 are disposed in the outer peripheral surface of the first detected portion 50C in positions to interpose the second large-diameter portion 50*c*4 therebetween in the circumferential direction. The first small-diameter portion 50*b*4 and the second small-diameter portion 50*d*4 are deviated by 90 degrees from each other around the central axis of the first detected portion 50C. Incidentally, the positional relationship between the first small-diameter portion 50*b*4 and the second small-diameter portion 50*d*4 is not limited to the relationship in the present embodiment. The positional relationship between the first small-diameter portion 50*b*4 and the second small-diameter portion 50*d*4 is appropriately determined according to the stroke amount of the boom coupling pin and the cylinder coupling pin during a state transition between the contracted state and the extended state.

The first sensor unit 51C is a non-contact proximity sensor. The first sensor unit 51C is provided in a state where a distal end thereof faces the outer peripheral surface of the first detected portion 50C. The first sensor unit 51C outputs an electric signal according to the distance from the outer peripheral surface of the first detected portion 50C.

For example, the output of the first sensor unit 51C becomes OFF in a state where the first sensor unit 51C faces the first large-diameter portion 50*a*4 or the second large-diameter portion 50*c*4. Meanwhile, the output of the first sensor unit 51C becomes ON in a state where the first sensor unit 51C faces the first small-diameter portion 50*b*4 or the second small-diameter portion 50*d*4. Namely, in the case of the present embodiment, the condition where the output of the first sensor unit 51C becomes ON is reverse to the above-described cases of the second embodiment and the third embodiment.

The second detection device 502C includes a second detected portion 52C and a second sensor unit 53C. The second detected portion 52C is fixed to the transmission shaft 432 to be closer to the X-direction negative side than the first detected portion 50C, in a state where the transmission shaft 432 is inserted through a central hole of the second detected portion 52C. The second detected portion 52C rotates together with the transmission shaft 432.

The second detected portion 52C includes a first large-diameter portion 52*a*4 and a second large-diameter portion 52*c*4 from which the distance to the central axis of the second detected portion 52C is large (outer diameter is large), and a first small-diameter portion 52*b*4 and a second small-diameter portion 52*d*4 from which the distance to the central axis thereof is small (outer diameter is small), on an outer peripheral surface of the second detected portion 52C. Such a configuration of the second detected portion 52C is the same as that of the first detected portion 50C described above.

The second sensor unit 53C is a non-contact proximity sensor. The second sensor unit 53C is provided in a state where a distal end thereof faces the outer peripheral surface of the second detected portion 52C. The second sensor unit 53C outputs an electric signal according to the distance from the outer peripheral surface of the second detected portion 52C.

For example, the output of the second sensor unit 53C becomes OFF in a state where the second sensor unit 53C faces the first large-diameter portion 52*a*4 or the second large-diameter portion 52*c*4. Meanwhile, the output of the second sensor unit 53C becomes ON in a state where the second sensor unit 53C faces the first small-diameter portion 52*b*4 or the second small-diameter portion 52*d*4. Namely, in the case of the present embodiment, the condition where the output of the second sensor unit 53C becomes ON is reverse to the above-described cases of the second embodiment and the third embodiment.

In the case of the present embodiment, in the neutral state of the position information detection device 500C, the first sensor unit 51C faces the second small-diameter portion 50*d*4 of the first detected portion 50C. Meanwhile, in the neutral state of the position information detection device 500C, the second sensor unit 53C faces the first small-diameter portion 52*b*4 of the second detected portion 52C.

The position information detection device 500C as described above detects which one of the pin neutral state, the boom coupling pin removal state, and the cylinder coupling pin removal state corresponds to the states of the boom coupling pins 144*a* and the cylinder coupling pins 454*a* and 454*b*, based on a combination of the output of the first sensor unit 51C and the output of the second sensor unit 53C. Hereinafter, this point will be described with reference to FIG. 24.

When the electric motor 41 (refer to FIG. 7) rotates forward from a state of the position information detection device 500C, the state corresponding to the pin neutral state (state illustrated in column C in FIG. 24), the position information detection device 500C enters a state corresponding to the boom coupling pin removal operation state (state illustrated in column D in FIG. 24) and then a state corresponding to the boom coupling pin removal state (state illustrated in column E in FIG. 24).

In the state corresponding to the boom coupling pin removal state, the first sensor unit 51C faces the first large-diameter portion 50*a*4 of the first detected portion 50C. The output of the first sensor unit 51C in this state is OFF (refer to E-4 in FIG. 24).

In addition, in the state corresponding to the boom coupling pin removal state, the second sensor unit 53C faces the second small-diameter portion 52*d*4 of the second detected portion 52C. The output of the second sensor unit 53C in this state is ON (refer to E-3 in FIG. 24).

The position information detection device 500C detects that the boom coupling pins 144*a* and the cylinder coupling pins 454*a* and 454*b* are in the boom coupling pin removal state, based on a combination of the output (OFF) of the first sensor unit 51C and the output (ON) of the second sensor unit 53C as described above. Then, the control unit (unillustrated) stops the operation of the electric motor 41 based on the detection result of the position information detection device 500C.

Meanwhile, when the electric motor 41 (refer to FIG. 7) rotates reversely from the state of the position information detection device 500C, the state corresponding to the pin neutral state (state illustrated in column C in FIG. 24), the position information detection device 500C enters a state corresponding to the cylinder coupling pin removal operation state (state illustrated in column B in FIG. 24) and then a state corresponding to the cylinder coupling pin removal state (state illustrated in column A in FIG. 24).

In the state corresponding to the cylinder coupling pin removal state, the first sensor unit 51C faces the first small-diameter portion 50*b*4 of the first detected portion 50C. The output of the first sensor unit 51C in this state is ON (refer to A-4 in FIG. 24).

In addition, in the state corresponding to the cylinder coupling pin removal state, the second sensor unit 53C faces the first large-diameter portion 52*a*4 of the second detected portion 52C. The output of the second sensor unit 53C in this state is OFF (refer to A-3 in FIG. 24).

The position information detection device 500C detects that the boom coupling pins 144*a* and the cylinder coupling pins 454*a* and 454*b* are in the cylinder coupling pin removal state, based on a combination of the output (ON) of the first sensor unit 51C and the output (OFF) of the second sensor unit 53C as described above. Then, the control unit (unillustrated) stops the operation of the electric motor 41 based on the detection result of the position information detection device 500C. Other configurations and effects are the same as those in the second embodiment described above.

5. Fifth Embodiment

Figure 25A:
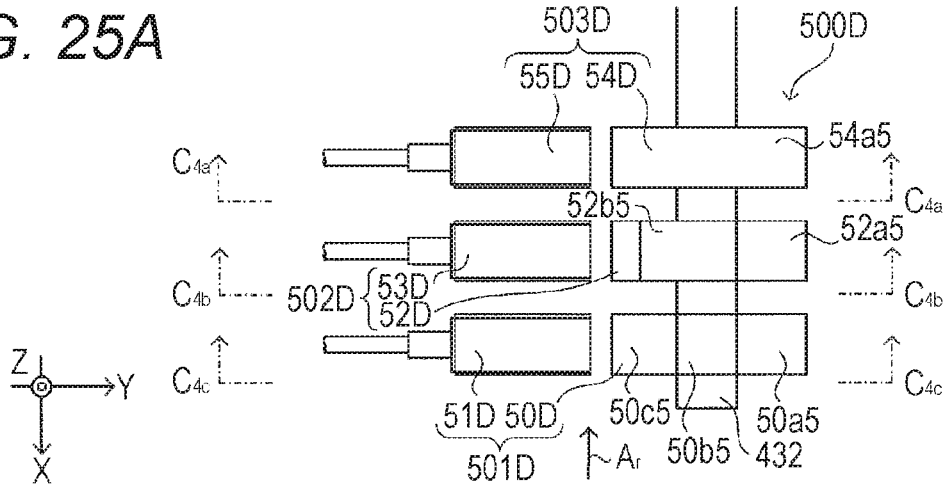
FIG. 25A is a view illustrating a position information detection device of the crane according to a fifth embodiment of the present invention.
Figure 25B:
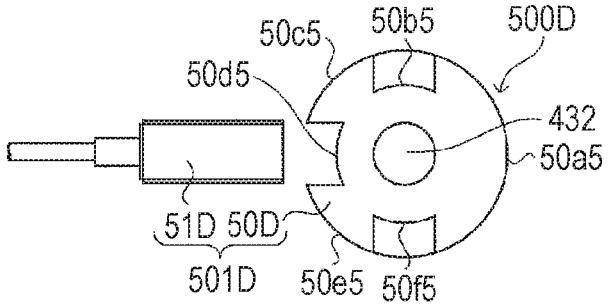
FIG. 25B is a view of the position information detection device illustrated in FIG. 25A as seen from the direction of arrow $A_r$.
Figure 25C:
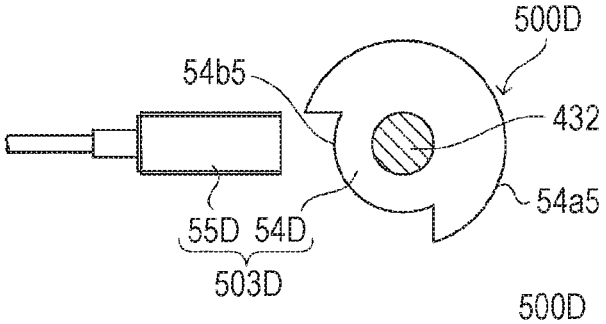
FIG. 25C is a cross-sectional view taken along line $C_{4a}$-$C_{4a}$ in FIG. 25A.
Figure 25D:
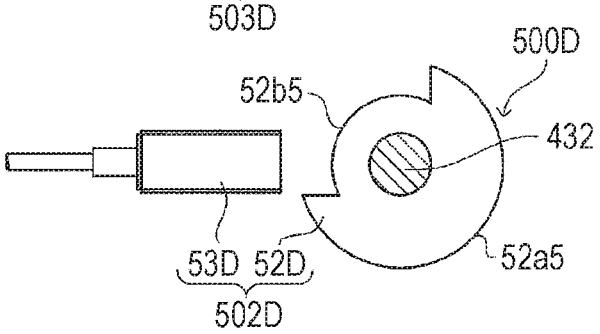
FIG. 25D is a cross-sectional view taken along line $C_{4b}$-$C_{4b}$ in FIG. 25A.
Figure 25E:
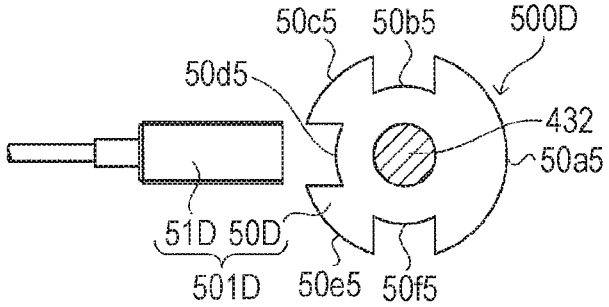
FIG. 25E is a cross-sectional view taken along line $C_{4c}$-$C_{4c}$ in FIG. 25A.
Figure 26:
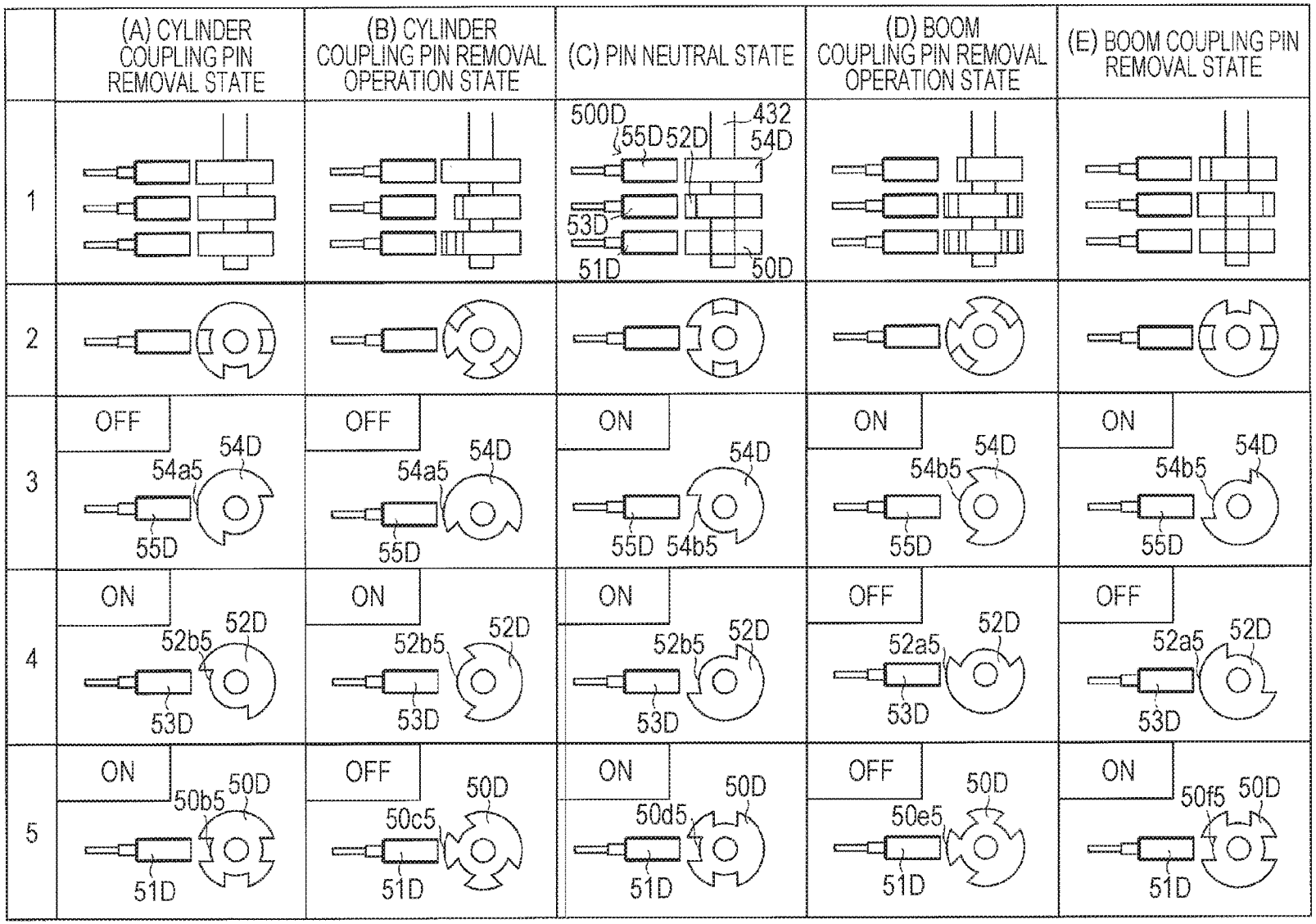
FIG. 26 is a view for describing an operation of the position information detection device of the crane according to the fifth embodiment.

A fifth embodiment according to the present invention will be described with reference to FIGS. 25A to 26. In the case of the present embodiment, the structure of a position information detection device 500D is different from that of the position information detection device 500A in the second embodiment described above. The structure of the other portion is the same as that in the second embodiment. Hereinafter, the structure of the position information detection device 500D will be described. Incidentally, FIGS. 25A to 25E are views corresponding to FIGS. 21A to 21E referred to in the above description of the third embodiment. In addition, FIG. 26 is a view corresponding to FIG. 22 referred to in the above description of the third embodiment.

The position information detection device 500D includes a first detection device 501D, a second detection device 502D, and a third detection device 503D.

The first detection device 501D includes a first detected portion 50D and a first sensor unit 51D. The first detected portion 50D is fixed to the transmission shaft 432 in a state where the transmission shaft 432 is inserted through a central hole thereof. The first detected portion 50D rotates together with the transmission shaft 432.

The first detected portion 50D includes a first large-diameter portion 50*a*5, a second large-diameter portion 50*c*5, and a third large-diameter portion 50*e*5 from which the distance to the central axis of the first detected portion 50D is large (outer diameter is large), and a first small-diameter portion 50*b*5, a second small-diameter portion 50*d*5, and a third small-diameter portion 50*f*5 from which the distance to the central axis thereof is small (outer diameter is small), on an outer peripheral surface of the first detected portion 50D.

In the case of the present embodiment, the first small-diameter portion 50*b*5, the second small-diameter portion 50*d*5, and the third small-diameter portion 50*f*5 are disposed at an interval of 90° around the central axis of the first detected portion 50D in the outer peripheral surface of the first detected portion 50D. The first small-diameter portion 50*b*5 and the third small-diameter portion 50*f*5 are disposed around the central axis of the first detected portion 50D to be deviated by 180° from each other. Incidentally, the positional relationship between the first small-diameter portion 50*b*5, the second small-diameter portion 50*d*5, and the third small-diameter portion 50*f*5 is not limited to the relationship in the present embodiment. The positional relationship between the first small-diameter portion 50*b*5, the second small-diameter portion 50*d*5, and the third small-diameter portion 50*f*5 is appropriately determined according to the stroke amount of the boom coupling pin and the cylinder coupling pin during a state transition between the contracted state and the extended state.

The first large-diameter portion 50*a*5 is disposed between the first small-diameter portion 50*b*5 and the third small-diameter portion 50*f*5. The second large-diameter portion 50*c*5 is disposed between the first small-diameter portion 50*b*5 and the second small-diameter portion 50*d*5. The third large-diameter portion 50*e*5 is disposed between the second small-diameter portion 50*d*5 and the third small-diameter portion 50*f*5.

The first sensor unit 51D is a non-contact proximity sensor. The first sensor unit 51D is provided in a state where a distal end thereof faces the outer peripheral surface of the first detected portion 50D. The first sensor unit 51D outputs an electric signal according to the distance from the outer peripheral surface of the first detected portion 50D.

For example, the output of the first sensor unit 51D becomes OFF in a state where the first sensor unit 51D faces the first large-diameter portion 50*a*5, the second large-diameter portion 50*c*5, and the third large-diameter portion 50*e*5. Meanwhile, the output of the first sensor unit 51D becomes ON in a state where the first sensor unit 51D faces the first small-diameter portion 50*b*5, the second small-diameter portion 50*d*5, and the third small-diameter portion 50*f*5. Namely, in the case of the present embodiment, the condition where the output of the first sensor unit 51D becomes ON is reverse to the above-described cases of the second embodiment and the third embodiment.

The second detection device 502D includes a second detected portion 52D and a second sensor unit 53D. The second detected portion 52D is fixed to the transmission shaft 432 to be closer to the X-direction negative side than the first detected portion 50D, in a state where the transmission shaft 432 is inserted through a central hole of the second detected portion 52D. The second detected portion 52D rotates together with the transmission shaft 432.

The second detected portion 52D includes a first large-diameter portion 52*a*5 from which the distance to the central axis of the second detected portion 52D is large (outer diameter is large), and a first small-diameter portion 52*b*5 from which the distance to the central axis thereof is small (outer diameter is small), on an outer peripheral surface of the second detected portion 52D.

In the case of the present embodiment, the first large-diameter portion 52*a*5 is disposed in a central angle range of approximately 240° around the central axis of the second detected portion 52D in the outer peripheral surface of the second detected portion 52D. The first small-diameter portion 52*b*5 is disposed in a portion other than the first large-diameter portion 52*a*5 in the outer peripheral surface of the second detected portion 52D. Incidentally, the positional relationship between the first large-diameter portion 52*a*5 and the first small-diameter portion 52*b*5 is not limited to the relationship in the present embodiment. The positional relationship between the first large-diameter portion 52*a*5 and the first small-diameter portion 52*b*5 is appropriately determined according to the stroke amount of the boom coupling pin and the cylinder coupling pin during a state transition between the contracted state and the extended state.

The second sensor unit 53D is a non-contact proximity sensor. The second sensor unit 53D is provided in a state where a distal end thereof faces the outer peripheral surface of the second detected portion 52D. The second sensor unit 53D outputs an electric signal according to the distance from the outer peripheral surface of the second detected portion 52D.

For example, the output of the second sensor unit 53D becomes OFF in a state where the second sensor unit 53D faces the first large-diameter portion 52*a*5. Meanwhile, the output of the second sensor unit 53D becomes ON in a state where the second sensor unit 53D faces the first small-diameter portion 52*b*5. Namely, in the case of the present embodiment, the condition where the output of the second sensor unit 53D becomes ON is reverse to the above-described cases of the second embodiment and the third embodiment.

The third detection device 503D includes a third detected portion 54D and a third sensor unit 55D. The third detected portion 54D is fixed to the transmission shaft 432 to be closer to the X-direction negative side than the second detected portion 52D, in a state where the transmission shaft 432 is inserted through a central hole of the third detected portion 54D. The third detected portion 54D rotates together with the transmission shaft 432.

The third detected portion 54D includes a first large-diameter portion 54*a*5 from which the distance to the central axis of the third detected portion 54D is large (outer diameter is large), and a first small-diameter portion 54*b*5 from which the distance to the central axis thereof is small (outer diameter is small), on an outer peripheral surface of the third detected portion 54D. Such a configuration of the third detected portion 54D is the same as that of the second detected portion 52D described above.

The third sensor unit 55D is a non-contact proximity sensor. The third sensor unit 55D is provided in a state where a distal end thereof faces the outer peripheral surface of the third detected portion 54D. The third sensor unit 55D outputs an electric signal according to the distance from the outer peripheral surface of the third detected portion 54D. The condition where the output of the third sensor unit 55D becomes ON is the same as that in the second sensor unit 53D described above.

In the case of the present embodiment, in the neutral state of the position information detection device 500D, the first sensor unit 51D faces the second small-diameter portion 50*d*5 of the first detected portion 50D. In addition, in the neutral state of the position information detection device 500D, the second sensor unit 53D faces the first small-diameter portion 52*b*5 of the second detected portion 52D. Furthermore, in the neutral state of the position information detection device 500D, the third sensor unit 55D faces the first small-diameter portion 54*b*5 of the third detected portion 54D.

The position information detection device 500D as described above detects which one of the pin neutral state, the boom coupling pin removal operation state, the boom coupling pin removal state, the cylinder coupling pin removal operation state, and the cylinder coupling pin removal state corresponds to the states of the boom coupling pins 144*a* and the cylinder coupling pins 454*a* and 454*b*, based on a combination of the output of the first sensor unit 51D, the output of the second sensor unit 53D, and the output of the third sensor unit 55D. Hereinafter, this point will be described with reference to FIG. 26.

When the electric motor 41 (refer to FIG. 7) rotates forward from a state of the position information detection device 500D, the state corresponding to the pin neutral state (state illustrated in column C in FIG. 26), the position information detection device 500D enters a state corresponding to the boom coupling pin removal operation state (state illustrated in column D in FIG. 26).

In the state corresponding to the boom coupling pin removal operation state, the first sensor unit 51D faces the third large-diameter portion 50*e*5 of the first detected portion 50D. The output of the first sensor unit 51D in this state is OFF (refer to D-5 in FIG. 26).

In addition, in the state corresponding to the boom coupling pin removal operation state, the second sensor unit 53D faces the first large-diameter portion 52*a*5 of the second detected portion 52D. The output of the second sensor unit 53D in this state is OFF (refer to D-4 in FIG. 26).

In addition, in the state corresponding to the boom coupling pin removal operation state, the third sensor unit 55D faces the first small-diameter portion 54*b*5 of the third detected portion 54D. The output of the third sensor unit 55D in this state is ON (refer to D-3 in FIG. 26).

The position information detection device 500D detects that the boom coupling pins 144*a* and the cylinder coupling pins 454*a* and 454*b* are in the boom coupling pin removal operation state, based on a combination of the output (OFF) of the first sensor unit 51D, the output (OFF) of the second sensor unit 53D, and the output (ON) of the third sensor unit 55D as described above. Then, the control unit (unillustrated) causes the electric motor 41 to continue to operate, based on the detection result of the position information detection device 500D.

When the electric motor 41 rotates further forward from the state of the position information detection device 500D, the state corresponding to the boom coupling pin removal operation state (state illustrated in column D in FIG. 26), the position information detection device 500D enters a state corresponding to the boom coupling pin removal state (state illustrated in column E in FIG. 26).

In the state corresponding to the boom coupling pin removal state, the first sensor unit 51D faces the third small-diameter portion 50*f*5 of the first detected portion 50D. The output of the first sensor unit 51D in this state is ON (refer to E-5 in FIG. 26).

In addition, in the state corresponding to the boom coupling pin removal state, the second sensor unit 53D faces the first large-diameter portion 52*a*5 of the second detected portion 52D. The output of the second sensor unit 53D in this state is OFF (refer to E-4 in FIG. 26).

In addition, in the state corresponding to the boom coupling pin removal state, the third sensor unit 55D faces the first small-diameter portion 54*b*5 of the third detected portion 54D. The output of the third sensor unit 55D in this state is ON (refer to E-3 in FIG. 26).

The position information detection device 500D detects that the boom coupling pins 144*a* and the cylinder coupling pins 454*a* and 454*b* are in the boom coupling pin removal state, based on a combination of the output (ON) of the first sensor unit 51D, the output (OFF) of the second sensor unit 53D, and the output (ON) of the third sensor unit 55D as described above. Then, the control unit (unillustrated) stops the operation of the electric motor 41 based on the detection result of the position information detection device 500D.

When the electric motor 41 (refer to FIG. 7) rotates reversely from the state of the position information detection device 500D, the state corresponding to the pin neutral state (state illustrated in column C in FIG. 26), the position information detection device 500D enters a state corresponding to the cylinder coupling pin removal operation state (state illustrated in column B in FIG. 26).

In the state corresponding to the cylinder coupling pin removal operation state, the first sensor unit 51D faces the second large-diameter portion 50*c*5 of the first detected portion 50D. The output of the first sensor unit 51D in this state is OFF (refer to B-5 in FIG. 26).

In addition, in the state corresponding to the cylinder coupling pin removal operation state, the second sensor unit 53D faces the first small-diameter portion 52*b*5 of the second detected portion 52D. The output of the second sensor unit 53D in this state is ON (refer to B-4 in FIG. 26).

In addition, in the state corresponding to the cylinder coupling pin removal operation state, the third sensor unit 55D faces the first large-diameter portion 54*a*5 of the third detected portion 54D. The output of the third sensor unit 55D in this state is OFF (refer to B-3 in FIG. 26).

The position information detection device 500D detects that the boom coupling pins 144*a* and the cylinder coupling pins 454*a* and 454*b* are in the cylinder coupling pin removal operation state, based on a combination of the output (OFF) of the first sensor unit 51D, the output (ON) of the second sensor unit 53D, and the output (OFF) of the third sensor unit 55D as described above. Then, the control unit (unillustrated) causes the electric motor 41 to continue to operate, based on the detection result of the position information detection device 500D.

When the electric motor 41 rotates further reversely from the state of the position information detection device 500D, the state corresponding to the cylinder coupling pin removal operation state (state illustrated in column B in FIG. 26), the position information detection device 500D enters a state corresponding to the cylinder coupling pin removal state (state illustrated in column A in FIG. 26).

In the state corresponding to the cylinder coupling pin removal state, the first sensor unit 51D faces the first small-diameter portion 50*b*5 of the first detected portion 50D. The output of the first sensor unit 51D in this state is ON (refer to A-5 in FIG. 26).

In addition, in the state corresponding to the cylinder coupling pin removal state, the second sensor unit 53D faces the first small-diameter portion 52*b*5 of the second detected portion 52D. The output of the second sensor unit 53D in this state is ON (refer to A-4 in FIG. 26).

In addition, in the state corresponding to the cylinder coupling pin removal state, the third sensor unit 55D faces the first large-diameter portion 54*a*5 of the third detected portion 54D. The output of the third sensor unit 55D in this state is OFF (refer to A-3 in FIG. 26).

The position information detection device 500D detects that the boom coupling pins 144*a* and the cylinder coupling pins 454*a* and 454*b* are in the cylinder coupling pin removal state, based on a combination of the output (ON) of the first sensor unit 51D, the output (ON) of the second sensor unit 53D, and the output (OFF) of the third sensor unit 55D as described above. Then, the control unit (unillustrated) stops the operation of the electric motor 41 based on the detection result of the position information detection device 500D. Other configurations and effects are the same as those in the second embodiment described above.

6. Sixth Embodiment

Figure 27A:
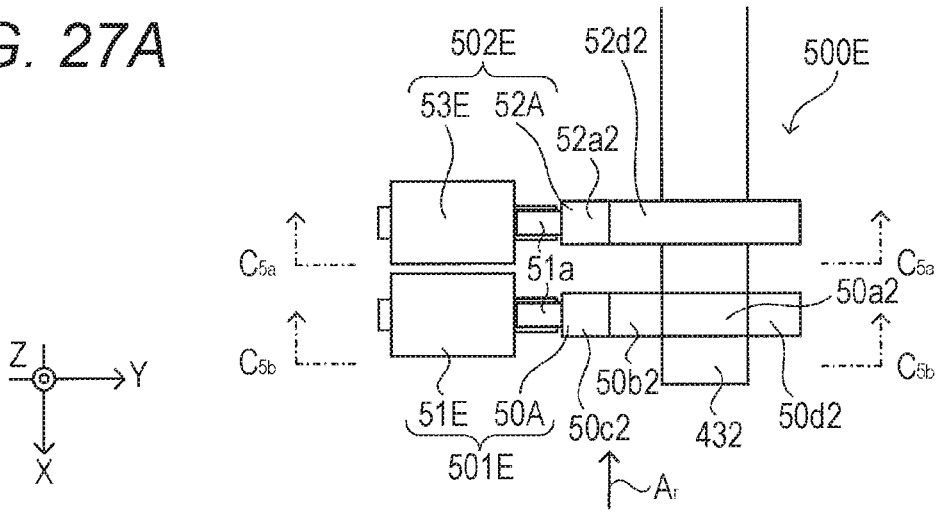
FIG. 27A is a view illustrating a position information detection device of the crane according to a sixth embodiment of the present invention.
Figure 27B:
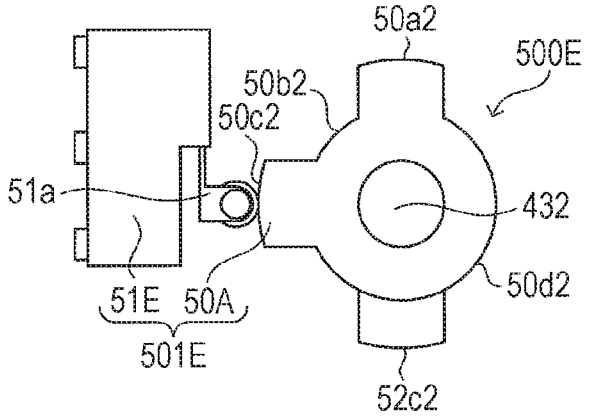
FIG. 27B is a view of the position information detection device illustrated in FIG. 27A as seen from the direction of arrow $A_r$.
Figure 27C:
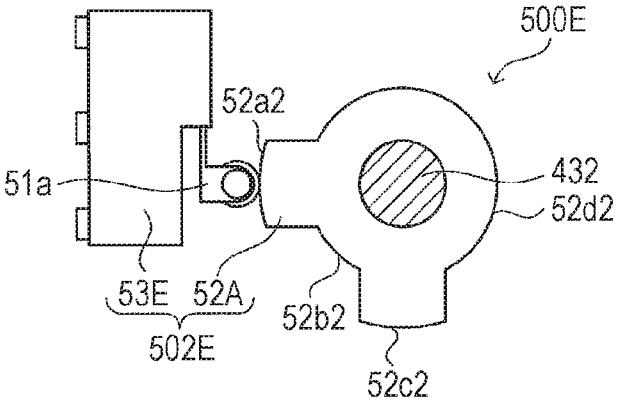
FIG. 27C is a cross-sectional view taken along line $C_{5a}$-$C_{5a}$ in FIG. 27A.
Figure 27D:
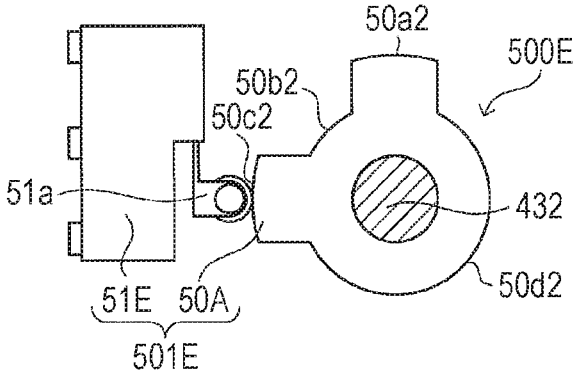
FIG. 27D is a cross-sectional view taken along line $C_{5b}$-$C_{5b}$ in FIG. 27A.
Figure 28:
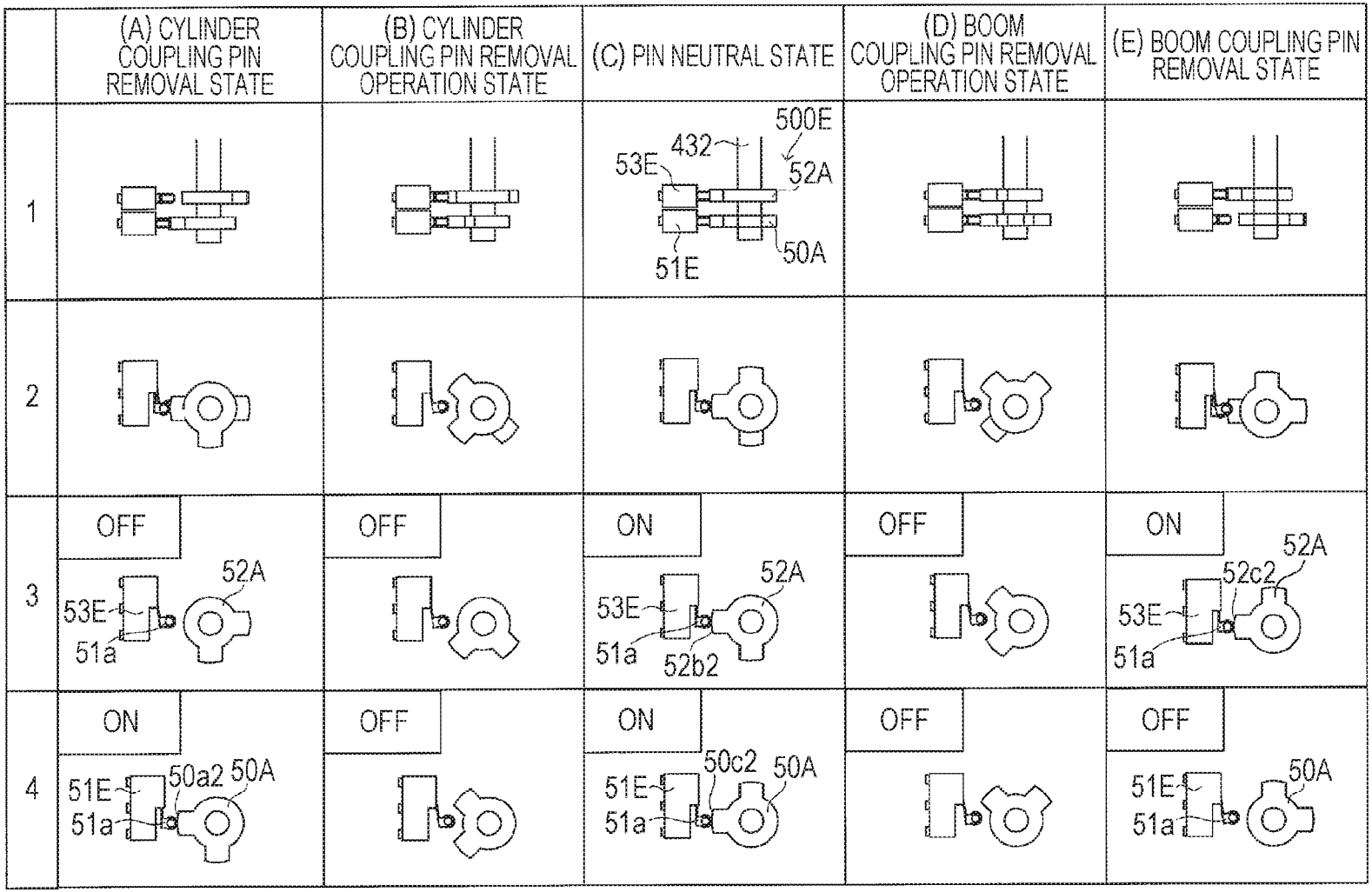
FIG. 28 is a view for describing an operation of the position information detection device of the crane according to the sixth embodiment.

A sixth embodiment according to the present invention will be described with reference to FIGS. 27A to 28. In the case of the present embodiment, the structure of a position information detection device 500E is different from that of the position information detection device 500A in the second embodiment described above. The structure of the other portion is the same as that in the second embodiment. Hereinafter, the structure of the position information detection device 500E will be described. Incidentally, FIGS. 27A to 27D are views corresponding to FIGS. 19A to 19D referred to in the above description of the second embodiment. In addition, FIG. 28 is a view corresponding to FIG. 20 referred to in the above description of the second embodiment.

The position information detection device 500E includes a first detection device 501E and a second detection device 502E.

The first detection device 501E includes the first detected portion 50A and a first sensor unit 51E. The configuration of the first detected portion 50A is the same as that in the second embodiment described above.

The first sensor unit 51E is a contact limit switch. The first sensor unit 51E includes a lever 51*a*. The first sensor unit 51E is provided in a state where the lever 51*a* faces the outer peripheral surface of the first detected portion 50A. The first sensor unit 51E as described above outputs an electric signal according to a contact relationship between the lever 51*a* and the first detected portion 50A.

In the case of the present embodiment, when the lever 51*a* comes into contact with the first detected portion 50A, the output of the first sensor unit 51E becomes ON, and when there is no contact therebetween, the output becomes OFF. However, when the lever 51*a* comes into contact with the first detected portion 50A, the output of the first sensor unit 51E may become OFF, and when there is no contact therebetween, the output may become ON.

Specifically, in the case of the present embodiment, the output of the first sensor unit 51E becomes ON in a state where the first sensor unit 51E comes into contact with the first large-diameter portion 50*a*2 or the second large-diameter portion 50*c*2.

The second detection device 502E includes the second detected portion 52A and a second sensor unit 53E. The configuration of the second detected portion 52A is the same as that in the second embodiment described above. In addition, the configuration of the second sensor unit 53E is the same as that of the first sensor unit 51E.

In the case of the present embodiment, the position information detection device 500E detects which one of the pin neutral state, the boom coupling pin removal state, and the cylinder coupling pin removal state corresponds to the states of the boom coupling pins 144*a* and the cylinder coupling pins 454*a* and 454*b*. Hereinafter, this point will be described with reference to FIG. 28.

When the electric motor 41 (refer to FIG. 7) rotates forward from a state of the position information detection device 500E, the state corresponding to the pin neutral state (state illustrated in column C in FIG. 28), the position information detection device 500E enters a state corresponding to the boom coupling pin removal operation state (state illustrated in column D in FIG. 28) and then a state corresponding to the boom coupling pin removal state (state illustrated in column E in FIG. 28).

In the state corresponding to the boom coupling pin removal state, the lever 51*a* of the first sensor unit 51E does not come into contact with the first detected portion 50A. The output of the first sensor unit 51E in this state is OFF (refer to E-4 in FIG. 28).

In addition, in the state corresponding to the boom coupling pin removal state, the lever 51*a* of the second sensor unit 53E comes into contact with the second large-diameter portion 52*c*2 of the second detected portion 52A. The output of the second sensor unit 53E in this state is ON (refer to E-3 in FIG. 28).

The position information detection device 500E detects that the boom coupling pins 144*a* and the cylinder coupling pins 454*a* and 454*b* are in the boom coupling pin removal state, based on a combination of the output (OFF) of the first sensor unit 51E and the output (ON) of the second sensor unit 53E as described above. Then, the control unit (unillustrated) stops the operation of the electric motor 41 based on the detection result of the position information detection device 500E.

Meanwhile, when the electric motor 41 (refer to FIG. 7) rotates reversely from the state of the position information detection device 500E, the state corresponding to the pin neutral state (state illustrated in column C in FIG. 28), the position information detection device 500E enters a state corresponding to the cylinder coupling pin removal operation state (state illustrated in column B in FIG. 28) and then a state corresponding to the cylinder coupling pin removal state (state illustrated in column A in FIG. 28).

In the state corresponding to the cylinder coupling pin removal state, the lever 51*a* of the first sensor unit 51E comes into contact with the first large-diameter portion 50*a*2 of the first detected portion 50A. The output of the first sensor unit 51E in this state is ON (refer to A-4 in FIG. 28).

In addition, in the state corresponding to the cylinder coupling pin removal state, the lever 51*a* of the second sensor unit 53E does not come into contact with the second detected portion 52A. The output of the second sensor unit 53E in this state is OFF (refer to A-3 in FIG. 28).

The position information detection device 500E detects that the boom coupling pins 144*a* and the cylinder coupling pins 454*a* and 454*b* are in the cylinder coupling pin removal state, based on a combination of the output (ON) of the first sensor unit 51E and the output (OFF) of the second sensor unit 53E as described above. Then, the control unit (unillustrated) stops the operation of the electric motor 41 based on the detection result of the position information detection device 500E. Other configurations and effects are the same as those in the second embodiment described above.

7. Seventh Embodiment

Figure 29A:
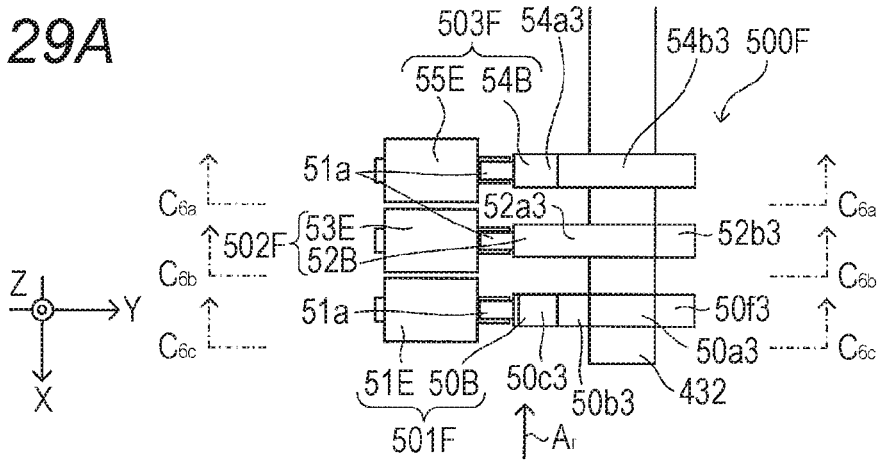
FIG. 29A is a view illustrating a position information detection device of the crane according to a seventh embodiment of the present invention.
Figure 29B:
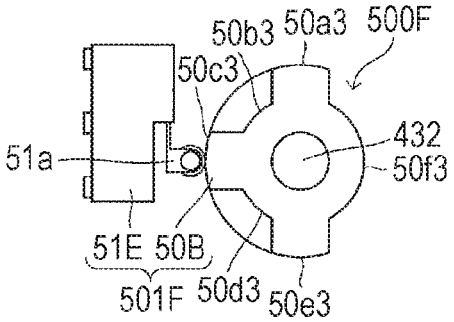
FIG. 29B is a view of the position information detection device illustrated in FIG. 29A as seen from the direction of arrow $A_r$.
Figure 29C:
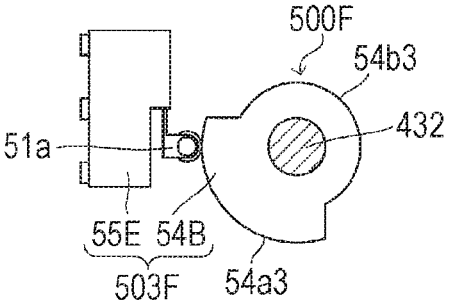
FIG. 29C is a cross-sectional view taken along line $C_{6a}$-$C_{6a}$ in FIG. 29A.
Figure 29D:
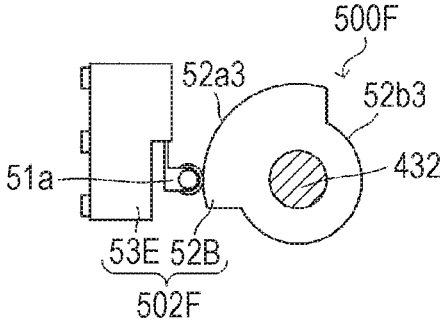
FIG. 29D is a cross-sectional view taken along line $C_{6b}$-$C_{6b}$ in FIG. 29A.
Figure 29E:
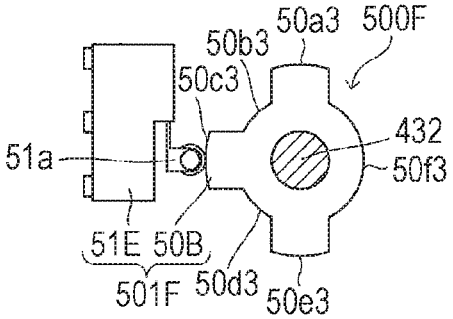
FIG. 29E is a cross-sectional view taken along line $C_{6c}$-$C_{6c}$ in FIG. 29A.
Figure 30:
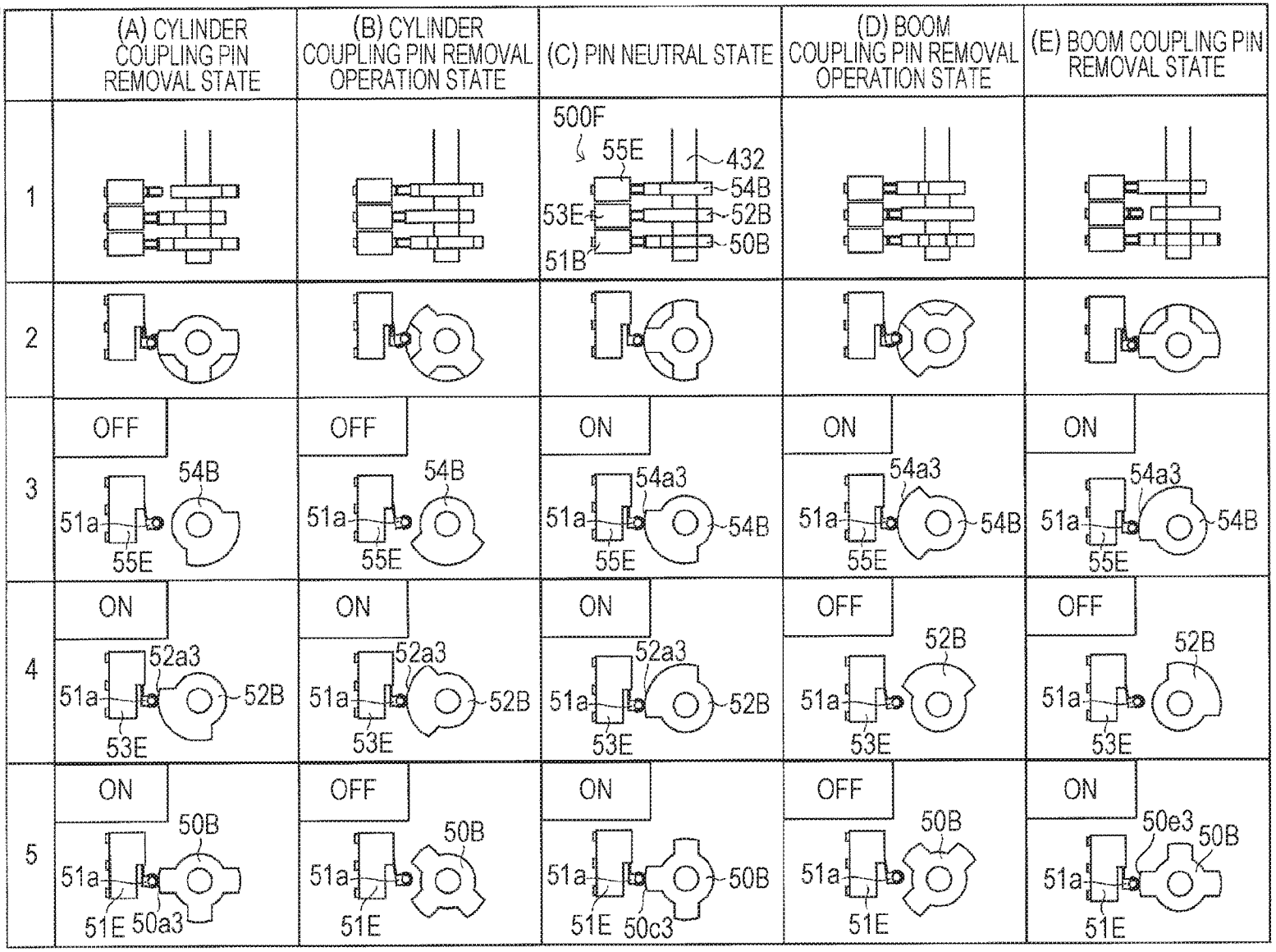
FIG. 30 is a view for describing an operation of the position information detection device of the crane according to the seventh embodiment.

A seventh embodiment according to the present invention will be described with reference to FIGS. 29A to 30. In the case of the present embodiment, the structure of a position information detection device 500F is different from that of the position information detection device 500A in the second embodiment described above. The structure of the other portion is the same as that in the second embodiment. Hereinafter, the structure of the position information detection device 500F will be described. Incidentally, FIGS. 29A to 29E are views corresponding to FIGS. 21A to 21E referred to in the above description of the third embodiment. In addition, FIG. 30 is a view corresponding to FIG. 22 referred to in the above description of the third embodiment.

The position information detection device 500F includes a first detection device 501F, a second detection device 502F, and a third detection device 503F.

The first detection device 501F includes the first detected portion 50B and the first sensor unit 51E. The configuration of the first detected portion 50B is the same as that in the third embodiment described above. In addition, the configuration of the first sensor unit 51E is the same as that in the sixth embodiment described above.

The second detection device 502F includes the second detected portion 52B and the second sensor unit 53E. The configuration of the second detected portion 52B is the same as that in the third embodiment described above. In addition, the configuration of the second sensor unit 53E is the same as that of the first sensor unit 51E.

The third detection device 503F includes the third detected portion 54B and a third sensor unit 55E. The configuration of the third detected portion 54B is the same as that in the third embodiment described above. In addition, the configuration of the third sensor unit 55E is the same as that of the first sensor unit 51E.

In the case of the present embodiment, the position information detection device 500F detects which one of the pin neutral state, the boom coupling pin removal operation state, the boom coupling pin removal state, the cylinder coupling pin removal operation state, and the cylinder coupling pin removal state corresponds to the states of the boom coupling pins 144*a* and the cylinder coupling pins 454*a* and 454*b*. Hereinafter, this point will be described with reference to FIG. 30.

When the electric motor 41 (refer to FIG. 7) rotates forward from a state of the position information detection device 500F, the state corresponding to the pin neutral state (state illustrated in column C in FIG. 30), the position information detection device 500F enters a state corresponding to the boom coupling pin removal operation state (state illustrated in column D in FIG. 30).

In the state corresponding to the boom coupling pin removal operation state, the lever 51*a* of the first sensor unit 51E does not come into contact with the first detected portion 50B. The output of the first sensor unit 51E in this state is OFF (refer to D-5 in FIG. 30).

In addition, in the state corresponding to the boom coupling pin removal operation state, the lever 51*a* of the second sensor unit 53E does not come into contact with the second detected portion 52B. The output of the second sensor unit 53E in this state is OFF (refer to D-4 in FIG. 30).

In addition, in the state corresponding to the boom coupling pin removal operation state, the lever 51*a* of the third sensor unit 55E comes into contact with the first large-diameter portion 54*a*3 of the third detected portion 54B. The output of the third sensor unit 55E in this state is ON (refer to D-3 in FIG. 30).

The position information detection device 500F detects that the boom coupling pins 144*a* and the cylinder coupling pins 454*a* and 454*b* are in the boom coupling pin removal operation state, based on a combination of the output (OFF) of the first sensor unit 51E, the output (OFF) of the second sensor unit 53E, and the output (ON) of the third sensor unit 55E as described above. Then, the control unit (unillustrated) causes the electric motor 41 to continue to operate, based on the detection result of the position information detection device 500F.

When the electric motor 41 rotates further forward from the state of the position information detection device 500F, the state corresponding to the boom coupling pin removal operation state (state illustrated in column D in FIG. 30), the position information detection device 500F enters a state corresponding to the boom coupling pin removal state (state illustrated in column E in FIG. 30).

In the state corresponding to the boom coupling pin removal state, the lever 51*a* of the first sensor unit 51E comes into contact with the third large-diameter portion 50*e*3 of the first detected portion 50B. The output of the first sensor unit 51E in this state is ON (refer to E-5 in FIG. 30).

In addition, in the state corresponding to the boom coupling pin removal state, the lever 51*a* of the second sensor unit 53E does not come into contact with the second detected portion 52B. The output of the second sensor unit 53E in this state is OFF (refer to E-4 in FIG. 30).

In addition, in the state corresponding to the boom coupling pin removal state, the lever 51*a* of the third sensor unit 55E comes into contact with the first large-diameter portion 54*a*3 of the third detected portion 54B. The output of the third sensor unit 55E in this state is ON (refer to E-3 in FIG. 30).

The position information detection device 500F detects that the boom coupling pins 144*a* and the cylinder coupling pins 454*a* and 454*b* are in the boom coupling pin removal state, based on a combination of the output (ON) of the first sensor unit 51E, the output (OFF) of the second sensor unit 53E, and the output (ON) of the third sensor unit 55E as described above. Then, the control unit (unillustrated) stops the operation of the electric motor 41 based on the detection result of the position information detection device 500F.

When the electric motor 41 (refer to FIG. 7) rotates reversely from the state of the position information detection device 500F, the state corresponding to the pin neutral state (state illustrated in column C in FIG. 30), the position information detection device 500F enters a state corresponding to the cylinder coupling pin removal operation state (state illustrated in column B in FIG. 30).

In the state corresponding to the cylinder coupling pin removal operation state, the lever 51*a* of the first sensor unit 51E does not come into contact with the first detected portion 50B. The output of the first sensor unit 51E in this state is OFF (refer to B-5 in FIG. 30).

In addition, in the state corresponding to the cylinder coupling pin removal operation state, the lever 51*a* of the second sensor unit 53E comes into contact with the first large-diameter portion 52*a*3 of the second detected portion 52B. The output of the second sensor unit 53E in this state is ON (refer to B-4 in FIG. 30).

In addition, in the state corresponding to the cylinder coupling pin removal operation state, the lever 51*a* of the third sensor unit 55E does not come into contact with the third detected portion 54B. The output of the third sensor unit 55E in this state is OFF (refer to B-3 in FIG. 30).

The position information detection device 500F detects that the boom coupling pins 144*a* and the cylinder coupling pins 454*a* and 454*b* are in the cylinder coupling pin removal operation state, based on a combination of the output (OFF) of the first sensor unit 51E, the output (ON) of the second sensor unit 53E, and the output (OFF) of the third sensor unit 55E as described above. Then, the control unit (unillustrated) causes the electric motor 41 to continue to operate, based on the detection result of the position information detection device 500F.

When the electric motor 41 rotates further reversely from the state of the position information detection device 500F, the state corresponding to the cylinder coupling pin removal operation state (state illustrated in column B in FIG. 30), the position information detection device 500F enters a state corresponding to the cylinder coupling pin removal state (state illustrated in column A in FIG. 30).

In the state corresponding to the cylinder coupling pin removal state, the lever 51*a* of the first sensor unit 51E comes into contact with the first large-diameter portion 50*a*3 of the first detected portion 50B. The output of the first sensor unit 51E in this state is ON (refer to A-5 in FIG. 30).

In addition, in the state corresponding to the cylinder coupling pin removal state, the lever 51*a* of the second sensor unit 53E comes into contact with the first large-diameter portion 52*a*3 of the second detected portion 52B. The output of the second sensor unit 53E in this state is ON (refer to A-4 in FIG. 30).

In addition, in the state corresponding to the cylinder coupling pin removal state, the lever 51*a* of the third sensor unit 55E does not come into contact with the third detected portion 54B. The output of the third sensor unit 55E in this state is OFF (refer to A-3 in FIG. 30).

The position information detection device 500F detects that the boom coupling pins 144*a* and the cylinder coupling pins 454*a* and 454*b* are in the boom coupling pin removal state, based on a combination of the output (ON) of the first sensor unit 51E, the output (ON) of the second sensor unit 53E, and the output (OFF) of the third sensor unit 55E as described above. Then, the control unit (unillustrated) stops the operation of the electric motor 41 based on the detection result of the position information detection device 500F. Other configurations and effects are the same as those in the third embodiment described above.

8. Eighth Embodiment

Figure 31A:
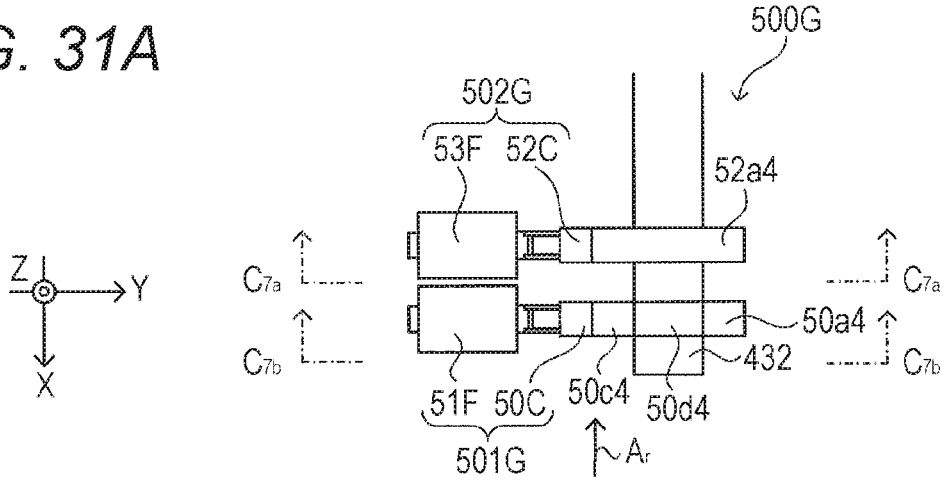
FIG. 31A is a view illustrating a position information detection device of the crane according to an eighth embodiment of the present invention.
Figure 31B:
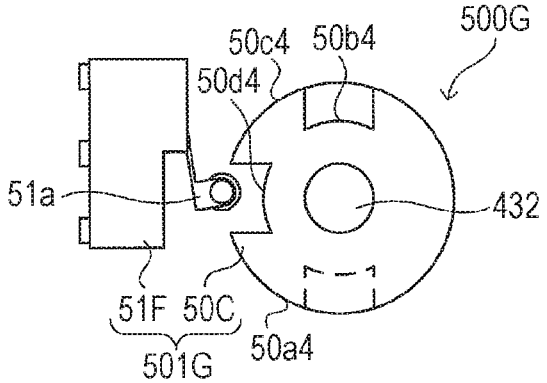
FIG. 31B is a view of the position information detection device illustrated in FIG. 31A as seen from the direction of arrow $A_r$.
Figure 31C:
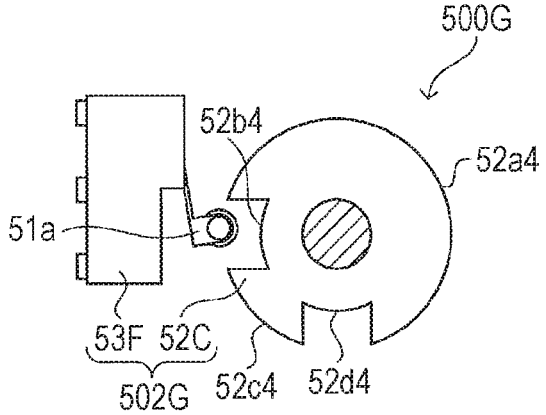
FIG. 31C is a cross-sectional view taken along line $C_{7a}$-$C_{7a}$ in FIG. 31A.
Figure 31D:
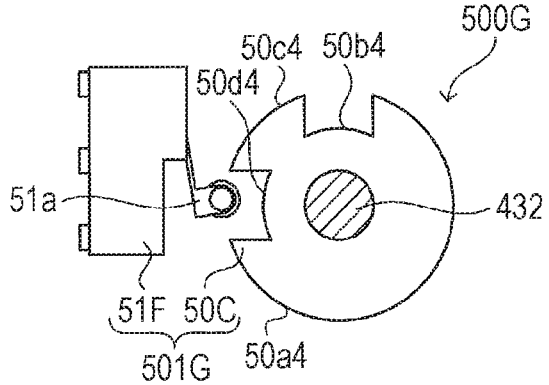
FIG. 31D is a cross-sectional view taken along line $C_{7b}$-$C_{7b}$ in FIG. 31A.
Figure 32:
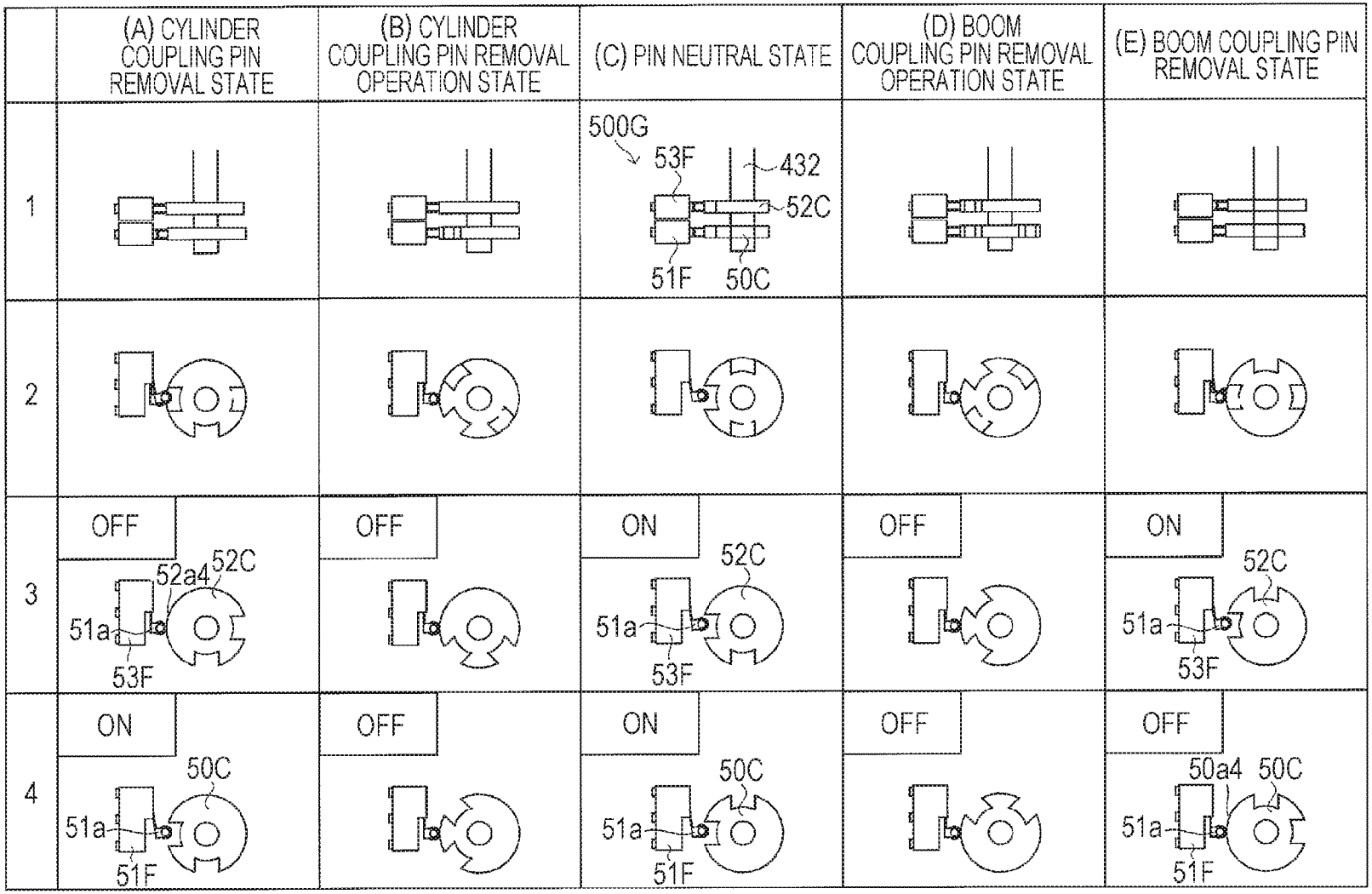
FIG. 32 is a view for describing an operation of the position information detection device of the crane according to the eighth embodiment.

An eighth embodiment according to the present invention will be described with reference to FIGS. 31A to 32. In the case of the present embodiment, the structure of a position information detection device 500G is different from that of the position information detection device 500A in the second embodiment described above. The structure of the other portion is the same as that in the second embodiment. Hereinafter, the structure of the position information detection device 500G will be described. Incidentally, a configuration in FIGS. 31A to 31D is the same as that in FIGS. 19A to 19D described above. In addition, a configuration in FIG. 32 is the same as that in FIG. 20.

The position information detection device 500G includes a first detection device 501G and a second detection device 502G.

The first detection device 501G includes the first detected portion 50C and a first sensor unit 51F. The configuration of the first detected portion 50C is the same as that in the fourth embodiment described above. In addition, the configuration of the first sensor unit 51F is substantially the same as that in the sixth embodiment described above. However, in the case of the present embodiment, the condition where the output of the first sensor unit 51F becomes ON is reverse to the above-described case of the sixth embodiment.

The second detection device 502G includes the second detected portion 52C and a second sensor unit 53F. The configuration of the second detected portion 52C is the same as that in the fourth embodiment described above. In addition, the configuration of the second sensor unit 53F is the same as that of the first sensor unit 51F.

The position information detection device 500G as described above detects which one of the pin neutral state, the boom coupling pin removal state, and the cylinder coupling pin removal state corresponds to the states of the cylinder coupling pins 454*a* and 454*b* and the boom coupling pins 144*a*, based on a combination of an output of the first sensor unit 51F and an output of the second sensor unit 53F. Hereinafter, this point will be described with reference to FIG. 32.

When the electric motor 41 (refer to FIG. 7) rotates forward from a state of the position information detection device 500G, the state corresponding to the pin neutral state (state illustrated in column C in FIG. 32), the position information detection device 500G enters a state corresponding to the boom coupling pin removal operation state (state illustrated in column D in FIG. 32) and then a state corresponding to the boom coupling pin removal state (state illustrated in column E in FIG. 32).

In the state corresponding to the boom coupling pin removal state, the lever 51*a* of the first sensor unit 51F comes into contact with the first large-diameter portion 50*a*4 of the first detected portion 50C. The output of the first sensor unit 51F in this state is OFF (refer to E-4 in FIG. 32).

In addition, in the state corresponding to the boom coupling pin removal state, the lever 51*a* of the second sensor unit 53F does not come into contact with the second detected portion 52C. The output of the second sensor unit 53F in this state is ON (refer to E-3 in FIG. 32).

The position information detection device 500G detects that the boom coupling pins 144*a* and the cylinder coupling pins 454*a* and 454*b* are in the boom coupling pin removal state, based on a combination of the output (OFF) of the first sensor unit 51F and the output (ON) of the second sensor unit 53F as described above. Then, the control unit (unillustrated) stops the operation of the electric motor 41 based on the detection result of the position information detection device 500G.

Meanwhile, when the electric motor 41 (refer to FIG. 7) rotates reversely from the state of the position information detection device 500G, the state corresponding to the pin neutral state (state illustrated in column C in FIG. 32), the position information detection device 500G enters a state corresponding to the cylinder coupling pin removal operation state (state illustrated in column B in FIG. 32) and then a state corresponding to the cylinder coupling pin removal state (state illustrated in column A in FIG. 32).

In the state corresponding to the cylinder coupling pin removal state, the lever 51*a* of the first sensor unit 51F does not come into contact with the first detected portion 50C. The output of the first sensor unit 51F in this state is ON (refer to A-4 in FIG. 32).

In addition, in the state corresponding to the cylinder coupling pin removal state, the lever 51*a* of the second sensor unit 53F comes into contact with the first large-diameter portion 52*a*4 of the second detected portion 52C. The output of the second sensor unit 53F in this state is OFF (refer to A-3 in FIG. 32).

The position information detection device 500G detects that the boom coupling pins 144*a* and the cylinder coupling pins 454*a* and 454*b* are in the cylinder coupling pin removal state, based on a combination of the output (ON) of the first sensor unit 51F and the output (OFF) of the second sensor unit 53F as described above. Then, the control unit (unillustrated) stops the operation of the electric motor 41 based on the detection result of the position information detection device 500G. Other configurations and effects are the same as those in the fourth embodiment described above.

9. Ninth Embodiment

Figure 33A:
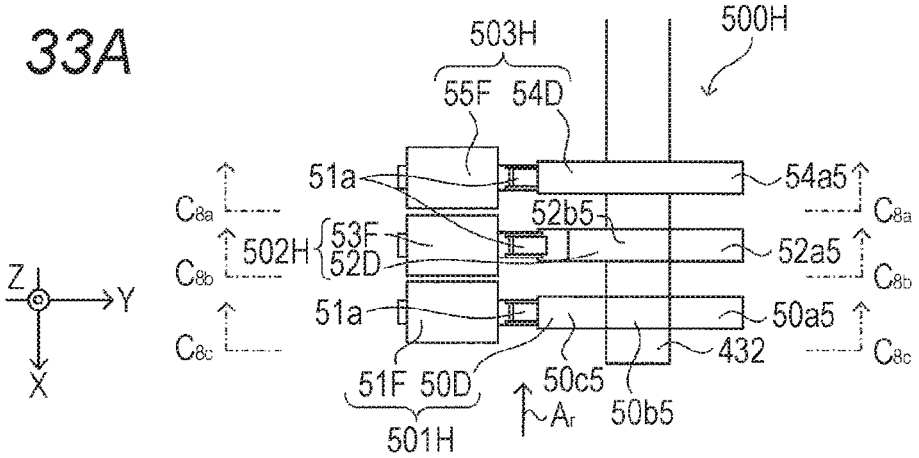
FIG. 33A is a view illustrating a position information detection device of the crane according to a ninth embodiment of the present invention.
Figure 33B:
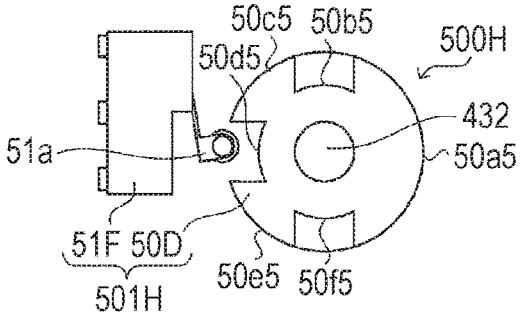
FIG. 33B is a view of the position information detection device illustrated in FIG. 33A as seen from the direction of arrow $A_r$.
Figure 33C:
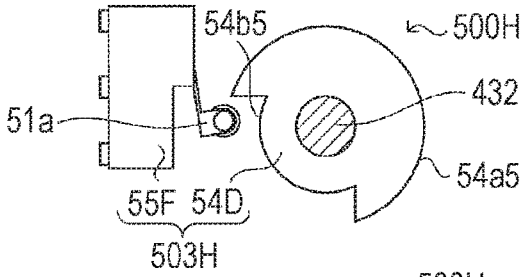
FIG. 33C is a cross-sectional view taken along line $C_{8a}$-$C_{8a}$ in FIG. 33A.
Figure 33D:
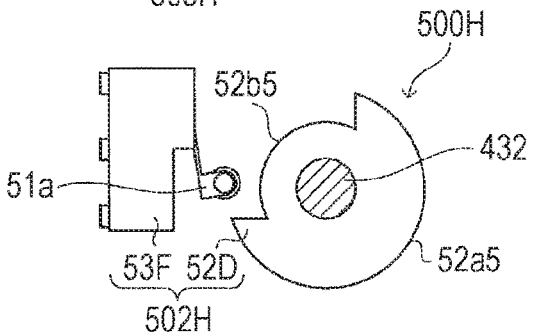
FIG. 33D is a cross-sectional view taken along line $C_{8b}$-$C_{8b}$ in FIG. 33A.
Figure 33E:
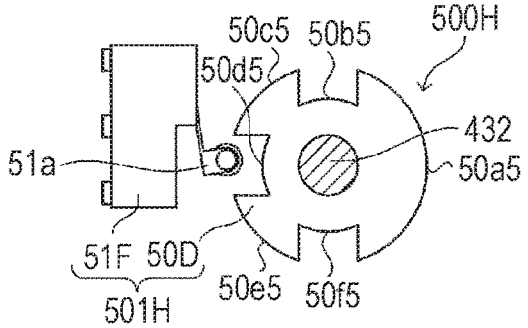
FIG. 33E is a cross-sectional view taken along line $C_{8c}$-$C_{8c}$ in FIG. 33A.
Figure 34:
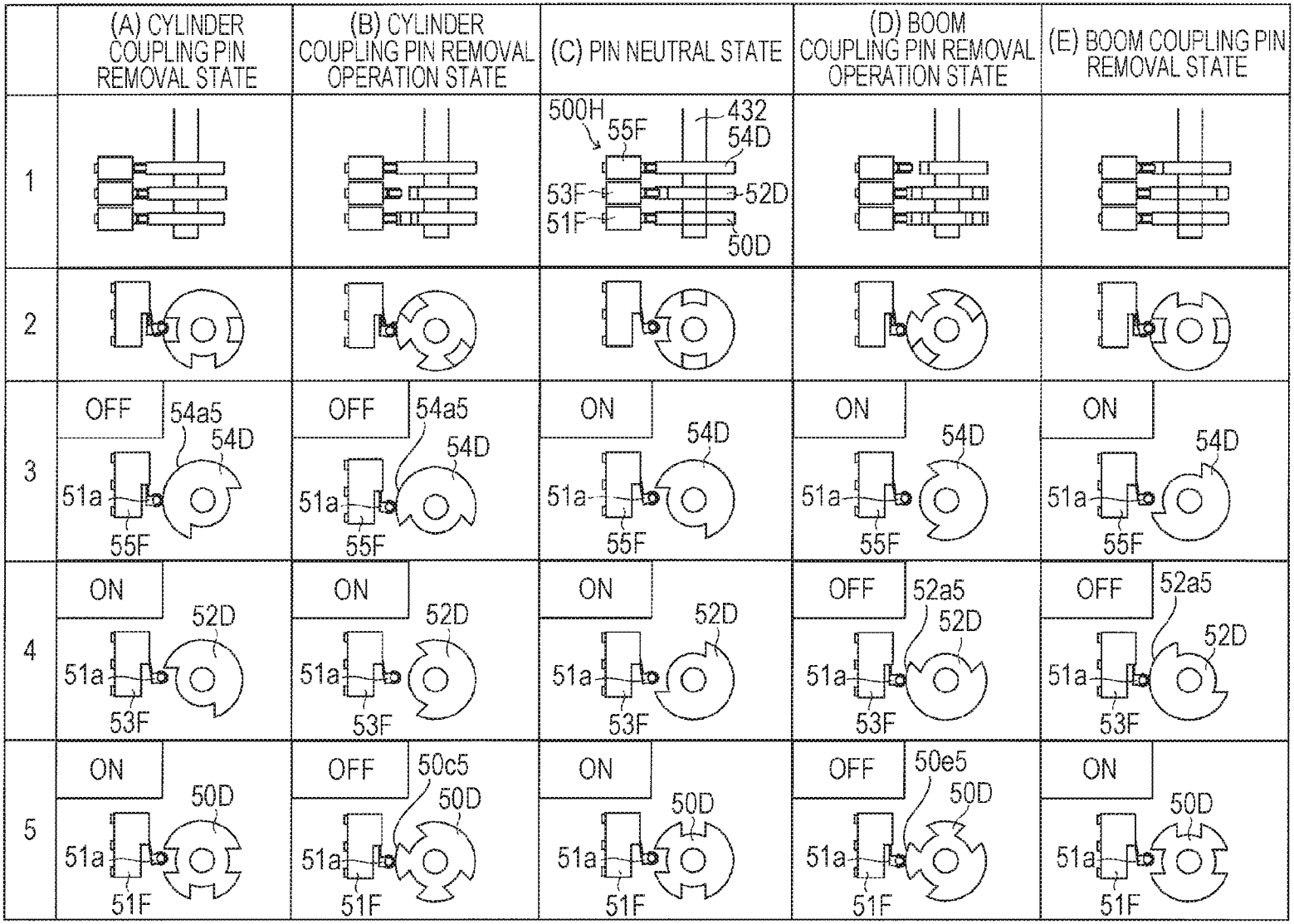
FIG. 34 is a view for describing an operation of the position information detection device of the crane according to the ninth embodiment.

A ninth embodiment according to the present invention will be described with reference to FIGS. 33A to 34. In the case of the present embodiment, the structure of a position information detection device 500H is different from that of the position information detection device 500A in the second embodiment described above. The structure of the other portion is the same as that in the second embodiment. Hereinafter, the structure of the position information detection device 500H will be described. Incidentally, FIGS. 33A to 33E are views corresponding to FIGS. 21A to 21E referred to in the above description of the third embodiment. In addition, FIG. 34 is a view corresponding to FIG. 22 referred to in the above description of the third embodiment.

The position information detection device 500H includes a first detection device 501H, a second detection device 502H, and a third detection device 503H.

The first detection device 501H includes the first detected portion 50D and the first sensor unit 51F. The configuration of the first detected portion 50D is the same as that in the fifth embodiment described above. In addition, the configuration of the first sensor unit 51F is the same as that in the eighth embodiment described above.

The second detection device 502H includes the second detected portion 52D and the second sensor unit 53F. The configuration of the second detected portion 52D is the same as that in the fifth embodiment described above. In addition, the configuration of the second sensor unit 53F is the same as that of the first sensor unit 51F.

The third detection device 503H includes the third detected portion 54D and a third sensor unit 55F. The configuration of the third detected portion 54D is the same as that in the fifth embodiment described above. In addition, the configuration of the third sensor unit 55F is the same as that of the first sensor unit 51F.

In the case of the present embodiment, the position information detection device 500H detects which one of the pin neutral state, the boom coupling pin removal operation state, the boom coupling pin removal state, the cylinder coupling pin removal operation state, and the cylinder coupling pin removal state corresponds to the states of the boom coupling pins 144*a* and the cylinder coupling pins 454*a* and 454*b*. Hereinafter, this point will be described with reference to FIG. 34.

When the electric motor 41 (refer to FIG. 7) rotates forward from a state of the position information detection device 500H, the state corresponding to the pin neutral state (state illustrated in column C in FIG. 34), the position information detection device 500H enters a state corresponding to the boom coupling pin removal operation state (state illustrated in column D in FIG. 34).

In the state corresponding to the boom coupling pin removal operation state, the lever 51*a* of the first sensor unit 51F comes into contact with the third large-diameter portion 50*e*5 of the first detected portion 50D. The output of the first sensor unit 51F in this state is OFF (refer to D-5 in FIG. 34).

In addition, in the state corresponding to the boom coupling pin removal operation state, the lever 51*a* of the second sensor unit 53F comes into contact with the first large-diameter portion 52*a*5 of the second detected portion 52D. The output of the second sensor unit 53F in this state is OFF (refer to D-4 in FIG. 34).

In addition, in the state corresponding to the boom coupling pin removal operation state, the lever 51*a* of the third sensor unit 55F does not come into contact with the third detected portion 54D. The output of the third sensor unit 55F in this state is ON (refer to D-3 in FIG. 34).

The position information detection device 500H detects that the boom coupling pins 144*a* and the cylinder coupling pins 454*a* and 454*b* are in the boom coupling pin removal operation state, based on a combination of the output (OFF) of the first sensor unit 51F, the output (OFF) of the second sensor unit 53F, and the output (ON) of the third sensor unit 55F as described above. Then, the control unit (unillustrated) causes the electric motor 41 to continue to operate, based on the detection result of the position information detection device 500H.

When the electric motor 41 rotates further forward from the state of the position information detection device 500H, the state corresponding to the boom coupling pin removal operation state (state illustrated in column D in FIG. 34), the position information detection device 500H enters a state corresponding to the boom coupling pin removal state (state illustrated in column E in FIG. 34).

In the state corresponding to the boom coupling pin removal state, the lever 51*a* of the first sensor unit 51F does not come into contact with the first detected portion 50D. The output of the first sensor unit 51F in this state is ON (refer to E-5 in FIG. 34).

In addition, in the state corresponding to the boom coupling pin removal state, the lever 51*a* of the second sensor unit 53F comes into contact with the first large-diameter portion 52*a*5 of the second detected portion 52D. The output of the second sensor unit 53F in this state is OFF (refer to E-4 in FIG. 34).

In addition, in the state corresponding to the boom coupling pin removal state, the lever 51*a* of the third sensor unit 55F does not come into contact with the third detected portion 54D. The output of the third sensor unit 55F in this state is ON (refer to E-3 in FIG. 34).

The position information detection device 500H detects that the boom coupling pins 144*a* and the cylinder coupling pins 454*a* and 454*b* are in the boom coupling pin removal state, based on a combination of the output (ON) of the first sensor unit 51F, the output (OFF) of the second sensor unit 53F, and the output (ON) of the third sensor unit 55F as described above. Then, the control unit (unillustrated) stops the operation of the electric motor 41 based on the detection result of the position information detection device 500H.

When the electric motor 41 (refer to FIG. 7) rotates reversely from the state of the position information detection device 500H, the state corresponding to the pin neutral state (state illustrated in column C in FIG. 34), the position information detection device 500H enters a state corresponding to the cylinder coupling pin removal operation state (state illustrated in column B in FIG. 34).

In the state corresponding to the cylinder coupling pin removal operation state, the lever 51*a* of the first sensor unit 51F comes into contact with the second large-diameter portion 50*c*5 of the first detected portion 50D. The output of the first sensor unit 51F in this state is OFF (refer to B-5 in FIG. 34).

In addition, in the state corresponding to the cylinder coupling pin removal operation state, the lever 51*a* of the second sensor unit 53F does not come into contact with the second detected portion 52D. The output of the second sensor unit 53F in this state is ON (refer to B-4 in FIG. 34).

In addition, in the state corresponding to the cylinder coupling pin removal operation state, the lever 51*a* of the third sensor unit 55F comes into contact with the first large-diameter portion 54*a*5 of the third detected portion 54D. The output of the third sensor unit 55F in this state is OFF (refer to B-3 in FIG. 34).

The position information detection device 500H detects that the boom coupling pins 144*a* and the cylinder coupling pins 454*a* and 454*b* are in the cylinder coupling pin removal operation state, based on a combination of the output (OFF) of the first sensor unit 51F, the output (ON) of the second sensor unit 53F, and the output (OFF) of the third sensor unit 55F as described above. Then, the control unit (unillustrated) causes the electric motor 41 to continue to operate, based on the detection result of the position information detection device 500H.

When the electric motor 41 rotates further reversely from the state of the position information detection device 500H, the state corresponding to the cylinder coupling pin removal operation state (state illustrated in column B in FIG. 34), the position information detection device 500H enters a state corresponding to the cylinder coupling pin removal state (state illustrated in column A in FIG. 34).

In the state corresponding to the cylinder coupling pin removal state, the lever 51*a* of the first sensor unit 51F does not come into contact with the first detected portion 50D. The output of the first sensor unit 51F in this state is ON (refer to A-5 in FIG. 34).

In addition, in the state corresponding to the cylinder coupling pin removal state, the lever 51*a* of the second sensor unit 53F does not come into contact with the second detected portion 52D. The output of the second sensor unit 53F in this state is ON (refer to A-4 in FIG. 34).

In addition, in the state corresponding to the cylinder coupling pin removal state, the lever 51*a* of the third sensor unit 55F comes into contact with the first large-diameter portion 54*a*5 of the third detected portion 54D. The output of the third sensor unit 55F in this state is OFF (refer to A-3 in FIG. 34).

The position information detection device 500H detects that the boom coupling pins 144*a* and the cylinder coupling pins 454*a* and 454*b* are in the boom coupling pin removal state, based on a combination of the output (ON) of the first sensor unit 51F, the output (ON) of the second sensor unit 53F, and the output (OFF) of the third sensor unit 55F as described above. Then, the control unit (unillustrated) stops the operation of the electric motor 41 based on the detection result of the position information detection device 500H. Other configurations and effects are the same as those in the fifth embodiment described above.

The content of the specification, drawings, and abstract included in Japanese Patent Application No. 2018-026426 filed on Feb. 16, 2018 is incorporated herein by reference in its entirety.

INDUSTRIAL APPLICABILITY

The crane according to the present invention is not limited to the rough terrain crane and may be various cranes such as an all terrain crane, a truck crane, and a loading truck crane (also referred to as a cargo crane). In addition, the crane according to the present invention is not limited to the movable crane, and may be other cranes including a telescopic boom.

REFERENCE SIGNS LIST

1 MOVABLE CRANE
10 TRAVELING BODY
101 WHEEL
11 OUTRIGGER
12 TURNING TABLE
14 TELESCOPIC BOOM
141 DISTAL END BOOM ELEMENT
141*a* CYLINDER PIN RECEIVING PORTION
141*b* BOOM PIN RECEIVING PORTION
142 INTERMEDIATE BOOM ELEMENT
142*a* CYLINDER PIN RECEIVING PORTION
142*b* FIRST BOOM PIN RECEIVING PORTION
142*c* SECOND BOOM PIN RECEIVING PORTION
142*d* THIRD BOOM PIN RECEIVING PORTION
143 PROXIMAL END BOOM ELEMENT
144*a*, 144*b* BOOM COUPLING PIN
144*c* PIN SIDE RECEIVING PORTION
15 RAISING AND LOWERING CYLINDER
16 WIRE
17 HOOK
2 ACTUATOR
3 TELESCOPING CYLINDER
31 ROD MEMBER
32 CYLINDER MEMBER
4 PIN DISPLACEMENT MODULE
40 HOUSING
400 FIRST HOUSING ELEMENT
400*a*, 400*b* THROUGH-HOLE
401 SECOND HOUSING ELEMENT
401*a*, 401*b* THROUGH-HOLE
41 ELECTRIC MOTOR
410 MANUAL OPERATION PORTION
42 BRAKE MECHANISM
43 TRANSMISSION MECHANISM
431 SPEED REDUCER
431*a* SPEED REDUCER CASE
432 TRANSMISSION SHAFT
44 POSITION INFORMATION DETECTION DEVICE
44*a* DETECTION UNIT
44*b* CONTROL UNIT
45 CYLINDER COUPLING MECHANISM
450 FIRST TOOTH-MISSING GEAR
450*a* FIRST TOOTH PORTION
451 FIRST RACK BAR
451*a* FIRST RACK TOOTH PORTION
451*b* SECOND RACK TOOTH PORTION
451*c* THIRD RACK TOOTH PORTION
452 FIRST GEAR MECHANISM
452*a*, 452*b*, 452*c* GEAR ELEMENT
453 SECOND GEAR MECHANISM
453*a*, 453*b* GEAR ELEMENT
454*a*, 454*b* CYLINDER COUPLING PIN
454*c*, 454*d* PIN SIDE RACK TOOTH PORTION
455 FIRST BIASING MECHANISM
455*a*, 455*b* COIL SPRING
46 BOOM COUPLING MECHANISM
460 SECOND TOOTH-MISSING GEAR
460*a* SECOND TOOTH PORTION
460*b* POSITIONING TOOTH
461*a*, 461*b* SECOND RACK BAR
461*c* DRIVE RACK TOOTH PORTION
461*d* FIRST END SURFACE
461*e*, 461*f* SYNCHRONOUS RACK TOOTH PORTION
461*g*, 461*h* LOCKING CLAW PORTION
462 SYNCHRONOUS GEAR
463 SECOND BIASING MECHANISM
463*a*, 463*b* COIL SPRING
47 LOCK MECHANISM
470 FIRST PROTRUSION
471 SECOND PROTRUSION
472 CAM MEMBER
472*a* FIRST CAM RECEIVING PORTION
472*b* SECOND CAM RECEIVING PORTION
48 STOPPER SURFACE
49 INTEGRAL TOOTH-MISSING GEAR
49*a* TOOTH PORTION
500A, 500B, 500C, 500D, 500E, 500F, 500G, 500H POSITION INFORMATION DETECTION DEVICE
501A, 501B, 501C, 501D, 501E, 501F, 501G, 501H FIRST DETECTION DEVICE
50A, 50B, 50C, 50D FIRST DETECTED PORTION
50*a*2, 50*a*3, 50*a*4, 50*a*5 FIRST LARGE-DIAMETER PORTION
50*b*2, 50*b*3, 50*b*4, 50*b*5 FIRST SMALL-DIAMETER PORTION
50*c*2, 50*c*3, 50*c*4, 50*c*5 SECOND LARGE-DIAMETER PORTION
50*d*2, 50*d*3, 50*d*4, 50*d*5 SECOND SMALL-DIAMETER PORTION
50*e*3, 50*e*5 THIRD LARGE-DIAMETER PORTION
50*f*3, 50*f*5 THIRD SMALL-DIAMETER PORTION
51A, 51B, 51C, 51D, 51E, 51F FIRST SENSOR UNIT
51*a* LEVER
502A, 502B, 502C, 502D, 502E, 502F, 502G, 502H SECOND DETECTION DEVICE
52A, 52B, 52C, 52D SECOND DETECTED PORTION
52*a*2, 52*a*3, 52*a*4, 52*a*5 FIRST LARGE-DIAMETER PORTION
52*b*2, 52*b*3, 52*b*4, 52*b*5 FIRST SMALL-DIAMETER PORTION
52*c*2, 52*c*4 SECOND LARGE-DIAMETER PORTION
52*d*2, 52*d*4 SECOND SMALL-DIAMETER PORTION
53A, 53B, 53C, 53D, 53E, 53F SECOND SENSOR UNIT
503B, 503D, 503F, 503H THIRD DETECTION DEVICE
54B, 54D THIRD DETECTED PORTION
54*a*3, 54*a*5 FIRST LARGE-DIAMETER PORTION
54*b*3, 54*b*5 FIRST SMALL-DIAMETER PORTION
55B, 55D, 55E, 55F THIRD SENSOR UNIT

The invention claimed is:

1. A crane comprising:

a telescopic boom including an inner boom element and an outer boom element that overlap each other to be extendable and contractible;

a telescoping actuator that displaces one boom element of the inner boom element and the outer boom element in a telescoping direction;

a first coupling member that releasably couples the telescoping actuator to the one boom element;

a second coupling member that releasably couples the inner boom element and the outer boom element;

an electric drive source provided in the telescoping actuator;

a first coupling mechanism that displaces one coupling member of the first coupling member and the second coupling member by using power of the electric drive source, to cause the members coupled by the one coupling member to switch between a coupled state and a non-coupled state; and a position information detection device that detects information relating a position of the one coupling member based on an output of the electric drive source.

2. The crane according to claim 1, wherein the electric drive source is a single electric drive source.

3. The crane according to claim 1 or 2, further comprising:

a second coupling mechanism that displaces another coupling member of the first coupling member and the second coupling member by using power of the electric drive source, to cause the members coupled by the other coupling member to switch between a coupled state and a non-coupled state, wherein the position information detection device detects information relating a position of the other coupling member based on an output of the electric drive source.

4. The crane according to claim 3, further comprising:

a speed reducer that reduces the power of the electric drive source to transmit the reduced power to the first coupling mechanism; and a brake mechanism that holds states of the first coupling mechanism and the second coupling mechanism in a state where the electric drive source is stopped.

5. The crane according to claim 4, wherein during braking, when an external force having a predetermined magnitude or higher is applied to the first coupling mechanism or the second coupling mechanism, the brake mechanism allows the electric drive source to rotate according to the external force.

6. The crane according to claim 4, wherein the brake mechanism is disposed closer to an electric drive source side than the speed reducer.

7. The crane according to claim 4, wherein the electric drive source, the speed reducer, and the brake mechanism are provided coaxially with an output shaft of the electric drive source.

8. The crane according to claim 4, wherein the position information detection device detects information relating the position based on power of the electric drive source, the power not being reduced by the speed reducer.

9. The crane according to claim 4, wherein the position information detection device detects information relating the position based on power of the electric drive source, the power being reduced by the speed reducer.

10. The crane according to claim 3, further comprising:

a switch gear that selectively transmits the power of the electric drive source to any one coupling mechanism of the first coupling mechanism and the second coupling mechanism.

11. The crane according to claim 10, wherein the switch gear further includes a lock mechanism that prevents operation of the other coupling mechanism of the first coupling mechanism and the second coupling mechanism in a state where the power of the electric drive source is transmitted to the one coupling mechanism.

12. The crane according to claim 3, wherein the first coupling mechanism includes a first biasing mechanism which causes the first coupling mechanism to make a state transition such that the members coupled by the one coupling member enter the coupled state, in a state where the electric drive source is stopped, and the second coupling mechanism includes a second biasing mechanism that causes the second coupling mechanism to make a state transition such that the members coupled by the other coupling member enter the coupled state, in a state where the electric drive source is stopped.

13. The crane according to claim 1, wherein the position information detection device is provided in an output shaft of the electric drive source or a rotary member that rotates according to rotation of the output shaft.

14. The crane according to claim 13, wherein the position information detection device includes a proximity sensor.

15. The crane according to claim 13, wherein the position information detection device includes an encoder.

16. The crane according to claim 13, wherein the position information detection device includes a limit switch.

* * * * *